US007901060B2

(12) United States Patent
Shimizu et al.

(10) Patent No.: US 7,901,060 B2
(45) Date of Patent: Mar. 8, 2011

(54) INK-JET RECORDING APPARATUS

(75) Inventors: Yoichiro Shimizu, Kasugai (JP); Naoya Okazaki, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 993 days.

(21) Appl. No.: 11/691,254

(22) Filed: Mar. 26, 2007

(65) Prior Publication Data

US 2007/0188565 A1 Aug. 16, 2007

Related U.S. Application Data

(63) Continuation-in-part of application No. PCT/JP2006/309467, filed on May 11, 2006.

(30) Foreign Application Priority Data

May 13, 2005 (JP) ..... 2005-140494
Dec. 14, 2005 (JP) ..... 2005-360586
Dec. 14, 2005 (JP) ..... 2005-360587

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS 6,007,193 A * 12/1999 Kashimura et al. ..... 347/92
6,863,390 B2 * 3/2005 Arai et al. ..... 347/94
7,303,271 B2 * 12/2007 Shimizu et al. ..... 347/94
7,404,630 B2 * 7/2008 Shimizu ..... 347/87
2005/0088494 A1 4/2005 Shimizu et al.
2005/0206691 A1 9/2005 Takata et al.

FOREIGN PATENT DOCUMENTS

CN 1608853 A 4/2005
JP 3520658 B2 2/2004
JP 2004-255862 A 9/2004
JP 2005-280075 A 10/2005
WO 2004/069545 A1 8/2004

OTHER PUBLICATIONS

International Bureau, International Search Report for Related Application No. PCT/JP2006/309467, mailed Aug. 15, 2006.
The State Intellectual Property Office of the People's Republic of China, Notification of the Second Office Action in counterpart Patent Application No. CN 200680003483.4, mailed Jul. 28, 2010.

* cited by examiner

*Primary Examiner* — Anh T. N. Vo
(74) *Attorney, Agent, or Firm* — Baker Botts L.L.P.

(57) ABSTRACT

A volume of an ink-deliver chamber is efficiently utilized to dampen pressure changes of ink within the chamber, and prevent air bubbles produced in the chamber from flowing into an ink-jet recording head. In addition, an ink-jet recording apparatus having a plurality of ink-deliver chambers in a small space, is provided. Two ink cases are stacked on each other, which include two ink-deliver chambers that accommodate different inks. Open sides of the four ink-deliver chambers are closed by flexible films. An ink-deliver chamber has an ink-flow inlet through which ink is introduced, and an ink-flow outlet through which ink flows to the ink-jet recording head, and the ink-flow inlet and outlet are provided at respective positions that are substantially most distant from each other such that almost all portions of an inner space of the ink-deliver chamber, where ink flows, are located between the ink-flow inlet and outlet.

25 Claims, 31 Drawing Sheets

INK-JET RECORDING APPARATUS

This is a Continuation-in-Part of International Application No. PCT/JP2006/309467 filed May 11, 2006, which claims the benefits of Japanese Patent Application No. 2005-140494 filed May 13, 2005, Japanese Patent Application No. 2005-360586 filed Dec. 14, 2005, and Japanese Patent Application No. 2005-360587 filed Dec. 14, 2005, the disclosures of which are hereby incorporated by reference in their entirety.

BACKGROUND OF THE INVENTION

1. Field of the Invention

The present invention relates to an ink-jet recording apparatus that ejects, from a nozzle thereof, ink toward a recording medium and thereby records an image thereon.

2. Discussion of Related Art

There has been known an ink-jet recording apparatus that includes a carriage; an ink-jet recording head mounted on the carriage; an ink tank provided at a position remote from the carriage; and a tube that supplies the ink from the ink tank to the ink-jet recording head.

In this sort of ink-jet recording apparatus, the carriage is moved with acceleration and accordingly pressure changes are produced in the ink-supply channels. If those pressure changes are directly transmitted to the nozzles of the ink-jet recording head, then the properties of droplets of inks, ejected by the recording head, are changed so that an image may be recorded with a lowered quality because of, e.g., occurrence of white spots. To deal with this problem, Patent Document 1 proposes to employ a method in which an ink-deliver chamber equipped with a damping means that damps the pressure changes is provided above the ink-jet recording head, so as to attenuate the adverse influences of acceleration produced by the movement of the carriage.

The damping means, disclosed by Publication of Japanese Patent No. 3520658, includes a damper frame having elliptic pressure-absorb chambers (i.e., ink-deliver chambers), and the inks supplied from the ink tanks via the tubes flow into respective flow passages that are connected to respective inlets of the pressure-absorb chambers from the underside in a tangential direction, and flow from respective outlets formed at respective lower portions of the pressure-absorb chambers toward the ink-jet recording head. Each of the pressure-absorb chambers (i.e., the ink-deliver chambers) has one surface that is defined by a flexible film.

SUMMARY OF THE INVENTION

To attenuate the pressure changes of the inks supplied via the tubes, it is desirable to form, in each of the pressure-absorb chambers (i.e., the ink-deliver chambers), the ink-flow inlet and the ink-flow outlet such that the inlet and the outlet be distant from each other by the largest possible distance. On the other hand, if air bubbles produced from the inks flowing in the pressure-absorb chambers move into the ink-jet recording head, then the recording head may fail to eject droplets of the inks. Therefore, it is desirable that the inks quickly flow from the ink-flow inlets to the ink-flow outlets before the air dissolved in each of the inks grows into the air bubbles.

In addition, in the case where different sorts of inks such as different color inks are used, it is needed to employ the same number of damping means as the total number of the different inks, and accordingly the layout of the damping means and respective connecting devices to connect between those damping means and the ink-jet recording head may be complicated and/or the sizes thereof may be increased.

It is therefore an object of the present invention to provide at least one of an ink-jet recording apparatus wherein respective volumes of a plurality of ink-deliver chambers are efficiently utilized to attenuate the pressure changes produced therein, and air bubbles produced in the ink-deliver chambers are effectively prevented from moving into an ink-jet recording head, and an ink-jet recording apparatus wherein a plurality of ink-deliver chambers are provided in a small space.

According to a first aspect of the present invention, there is provided an ink-jet recording apparatus, comprising a plurality of ink tanks which store a plurality of sorts of inks, respectively; a plurality of tubes which respectively supply the inks stored by the ink tanks; a buffer tank having a plurality of ink-deliver chambers which respectively accommodate the inks supplied from the ink tanks via the tubes; and an ink-jet recording head to which the ink-deliver chambers deliver the inks, respectively, and which ejects droplets of the inks toward a recording medium while the buffer tank and the ink-jet recording head are moved relative to the recording medium, wherein the ink-deliver chambers have respective inner spaces, respective ink-flow inlets through which the respective inks supplied via the respective tubes flow into the respective inner spaces, and respective ink-flow outlets through which the respective inks flow from the respective inner spaces into respective ink-deliver passages each of which communicates with the ink-jet recording head, and wherein the ink-flow inlet and the ink-flow outlet of each of the ink-deliver chambers are provided at respective positions that are substantially most distant from each other such that almost all portions of the inner space of the each ink-deliver chamber are located between the ink-flow inlet and the ink-low outlet of the each ink-deliver chamber.

In the present ink-jet recording apparatus, the ink-flow inlet and the ink-flow outlet of each ink-deliver chamber are provided at the respective positions that are substantially the most distant from each other such that almost all portions of the inner space of the each ink-deliver chamber are located between the ink-flow inlet and the ink-low outlet. Therefore, the respective volumes of the ink-deliver chambers are efficiently utilized to attenuate the pressure changes produced therein. In order that the ink-flow inlet and outlet of each ink-deliver chamber may be provided at the respective positions that are substantially the most distant from each other such that almost all portions of the inner space of the each ink-deliver chamber are located between the ink-flow inlet and the ink-low outlet, it is preferred that assuming that the ink-flow inlet and outlet of each ink-deliver chamber are distant from each other in a first direction, a distance between the ink-flow inlet and outlet be not less than 70% of a maximum dimension of the inner space of the each ink-deliver chamber in the first direction, more preferably, not less than 80% of the maximum dimension.

The above-indicated first direction may be perpendicular to a scanning direction in which the ink-jet recording head is moved relative to the recording medium. In many cases, the buffer tank has a plurality of first portions to receive, via the respective tubes, the respective inks stored by the respective ink tanks, and a plurality of second portions to deliver those inks to the ink-jet recording head, such that the first portions and the second portions are distant from each other in a direction perpendicular to the scanning direction. In those cases, generally, the inks flow in directions intersecting the scanning direction, and this is technically preferable. In the particular case where the above-indicated first direction is perpendicular to the scanning direction, the respective volumes of the ink-deliver chambers can be efficiently utilized to attenuate the changes of pressure of the inks. Most preferably, the first direction is perpendicular to not only the scanning direction but also upward and downward directions.

It is also preferred that the ink-flow inlet and outlet of each ink-deliver chamber be remote from each other in not only the first direction but also a second direction perpendicular to the first direction. In this case, a proportion of a portion of the inner space of each ink-deliver chamber that is located between the ink-flow inlet and outlet thereof may be increased and accordingly the volume of each ink-deliver chamber may be more efficiently utilized. In another particular case where each ink-deliver chamber has a quadrangular cross-section shape having a first pair of sides parallel to each other in the first direction and a second pair of sides parallel to each other in the second direction, the proportion of the portion of the inner space of each ink-deliver chamber that is located between the ink-flow inlet and outlet thereof may be sufficiently increased by determining, as the distance between the ink-flow inlet and outlet in the second direction, not less than 20% of a maximum dimension of the inner space in the second direction, more preferably, not less than 30% of the maximum dimension, most preferably, not less than 40% of the maximum dimension.

In yet another particular case where each ink-deliver chamber has a flat shape wherein a dimension thereof in a third direction perpendicular to the first and second directions is smaller than respective dimensions thereof in the first and second directions, the volume of each ink-deliver chamber may be efficiently utilized by making the ink-flow inlet and outlet thereof remote from each other in only one of the first and second directions. In this case, it is preferred that the second direction be perpendicular to the first direction and the upward and downward directions and that the third direction be the upward and downward directions. Furthermore, the above-indicated condition that the ink-flow inlet and outlet of each ink-deliver chamber are remote from each other in not only the first direction but also the second direction, may be expressed such that the ink-flow inlet and outlet of each ink-deliver chamber are remote from each other in the first direction and a straight line connecting between the ink-flow inlet and outlet is inclined relative to the first direction. In many cases, a length of an ink-flow passage in which ink flows can be increased by inclining the above-indicated straight line relative to the first direction. The above-indicated particular case where each ink-deliver chamber has the quadrangular cross-section shape is a typical one of those cases. Preferably, an angle contained by the first direction and the straight line is not less than 10 degrees, more preferably, not less than 20 degrees.

According to a second aspect of the present invention, there is provided an ink-jet recording apparatus, comprising a plurality of ink tanks which store a plurality of sorts of inks, respectively; a buffer tank having a plurality of ink-deliver chambers which respectively accommodate the inks supplied from the ink tanks; an ink-jet recording head which ejects droplets of the inks delivered by the ink-deliver chambers, toward a recording medium; and a moving device which moves the buffer tank and the ink-jet recording head in a direction intersecting a direction in which the recording medium is fed, wherein each of the ink-jet recording head and the ink-deliver chambers has a flat shape in which respective dimensions thereof in a first direction and a second direction that are perpendicular to each other are greater than a dimension thereof in a third direction perpendicular to the first direction and the second direction, and the ink-jet recording head and the ink-deliver chambers are arranged in the third direction.

In the present ink-jet recording apparatus, each of the ink-jet recording head and the ink-deliver chambers has the flat shape with respect to the third direction, and the ink-jet recording head and the ink-deliver chambers are arranged in the third direction. Therefore, an overall size of the ink-jet recording apparatus including the buffer tank and the ink-jet recording head can be reduced.

The ink-jet recording head and the ink-deliver chambers may be arranged such that the head and the chambers are held in contact with each other, such that the head and the chambers are spaced from each other, or such that some of the head and the chambers are held in contact with each other and the others are spaced from each other.

The first, second, and third directions recited with respect to the present, second ink-jet recording apparatus may be the same as those recited in the explanations provided with respect to the first ink-jet recording apparatus in accordance with the first aspect of the present invention.

According to a third aspect of the present invention, there is provided an ink-jet recording apparatus, comprising a plurality of ink-deliver chambers which accommodate a plurality of sorts of inks, respectively; a plurality of ink-deliver passages through which the inks are delivered from the ink-deliver chambers, respectively; an ink-jet recording head which has a plurality of ink-supply inlets which communicate with the plurality of ink-deliver passages, respectively; and a plurality of air-discharge valves each of which can be opened and closed, wherein the ink-deliver chambers are arranged in upward and downward directions such that the ink-deliver chambers extend parallel to each other, the ink-deliver passages extend in the upward and downward directions over respective substantially same lengths, each of the ink-deliver chambers communicates with an intermediate portion of a corresponding one of the ink-deliver passages, respective upper portions of the ink-deliver passages provide respective air-collect spaces each of which collects an air, respective lower open ends of the ink-deliver passages provide respective ink-deliver outlets which communicate with the respective ink-supply inlets of the ink-jet recording head, respective upper open ends of the ink-deliver passages provide respective air-discharge outlets which are provided along a plane, and the respective air-discharge outlets communicate with an outer space via the respective air-discharge valves.

In the present ink-jet recording apparatus, the ink-deliver chambers are arranged in the upward and downward directions such that the ink-deliver chambers extend parallel to each other. Therefore, the ink-deliver chambers can have substantially same operational characteristics. In addition, the ink-deliver chambers can have respective sufficiently large volumes, while a height of the recording apparatus as a whole need not be increased so much. Thus, the present recording apparatus can effectively attenuate the changes of pressure of the inks and thereby record high-quality images on the recording media. Moreover, since the ink-deliver passages extend in the upward and downward directions over the respective substantially same lengths, each of the ink-deliver passages can effectively promote the separation of air from a corresponding one of the inks flowing into a corresponding one of the ink-supply inlets of the ink-jet recording head, so that the separated air may be collected in the upper portion of the each ink-deliver passage and then discharged into the outside space via the air-discharge outlet of the upper portion.

Meanwhile, Japanese Patent Application Publication No. 2005-280075, for example, discloses a conventional ink-jet recording apparatus that ejects droplets of ink toward a recording medium and thereby records an image thereon. More specifically described, the conventional ink-jet recording apparatus includes a plurality of ink-deliver chambers that accommodate a plurality of sorts of inks, respectively; a plurality of ink-deliver passages through which the inks are delivered by the ink-deliver chambers; and an ink-jet recording head having a plurality of ink-supply inlets that communicate with the ink-deliver passages, respectively. The plurality of ink-deliver chambers consist of four ink-deliver chambers that accommodate four sorts of inks, respectively, and three of them are each of an upright type so that an air collected in an upper portion of each of the three upright-type chambers may damp the changes of pressure of the corresponding ink. Since, however, the height of the recording apparatus as a whole is limited, the volume of each of the three upright-type chambers is also limited. Therefore, the respective upper portions of the upright-type chambers cannot collect respective sufficiently large amounts of air and accordingly cannot exhibit respective sufficiently high damping effects.

In contrast, in the above-indicated, third ink-jet recording apparatus in accordance with the third aspect of the present invention, the ink-deliver chambers can have respective sufficiently large volumes, while the height of the recording apparatus as a whole need not be increased so much. Thus, the recording apparatus can effectively attenuate the changes of pressure of the inks.

In a particular case where respective upper or lower surfaces of the ink-deliver chambers are closed by respective flexible films, the changes of pressure of the inks in the ink-deliver chambers can be more effectively damped by respective deformations of those flexible films, because the flexible films can be easily formed to have respective large areas.

According to a fourth aspect of the present invention, there is provided an ink-jet recording apparatus, comprising at least one ink-deliver chamber which accommodates at least one ink; at least one ink-deliver passage which extends in upward and downward directions, through which the at least one ink is delivered from the at least one ink-deliver chamber, and which includes a lower portion that is located at a position lower than the at least one ink-deliver chamber and that has an ink-deliver outlet; an ink-jet recording head having at least one ink-supply inlet to which the at least one ink is supplied through the ink-deliver outlet of the at least one ink-deliver passage; and at least one ink-connect portion which maintains or promotes a connection between the ink delivered from the at least one ink-deliver chamber and the ink present in the lower portion of the at least one ink-deliver passage.

In the present, fourth ink-jet recording apparatus, the at least one ink-connect portion maintains or promotes the connection between the ink delivered from the at least one ink-deliver chamber and the ink present in the lower portion of the at least one ink-deliver passage. That is, the connection, i.e., flowing of the ink as a fluid is effectively prevented from being cut, i.e., temporarily stopped by the air gradually accumulated in the upper portion of the ink-deliver passage. Therefore, a probability that the air may be sucked into the ink-jet recording head and the recording head may fail to print characters or may print defective characters is lowered.

In the above-indicated conventional ink-jet recording apparatus, when each of the ink-deliver chambers delivers the corresponding ink to the corresponding ink-deliver passage, air bubbles are naturally separated from the ink and the separated air bubbles are collected in the upper portion of the ink-deliver passage. Thus, the air is prevented from flowing into the ink-jet recording head. In addition, the thus collected air is discharged, as needed, via a corresponding air-discharge outlet that can be opened and closed by a corresponding air-discharge valve. However, in this type of ink-jet recording apparatus, if more than a prescribed amount of air is accumulated in the upper portion of each ink-deliver passage, then the accumulated air may cut, i.e., temporarily stop the connection, i.e., flowing of the ink from the ink-deliver chamber to the ink-jet recording head. And, if the connection of the ink is cut, then the probability that the air may be sucked into the ink-jet recording head and the recording head may fail to print characters or may print defective characters is raised. Moreover, if, in that event, a purging operation is carried out for the ink-jet recording head, then the accumulated air may expand before the ink is sucked from the ink-deliver chamber, so that the air may be sucked into the recording head and accordingly the recording head may fail to print characters. In order to prevent the cutting of the connection of the ink, it is needed not to accumulate an excessively large amount of air in the upper portion of each ink-deliver passage.

In contrast to the conventional ink-jet recording apparatus, the present, fourth ink-jet recording apparatus enjoys the advantages that the connection of the ink as the fluid is prevented from being cut by the air collected in the upper portion of the ink-deliver passage and that the probability that the collected air may be sucked into the ink-jet recording head and the recording head may fail to print characters or may print defective characters is lowered.

DETAILED DESCRIPTION OF THE PREFERRED EMBODIMENTS

Hereinafter, there will be described preferred embodiments of the present invention by reference to the drawings.

(Ink-Jet Recording Apparatus)

Figure 1:
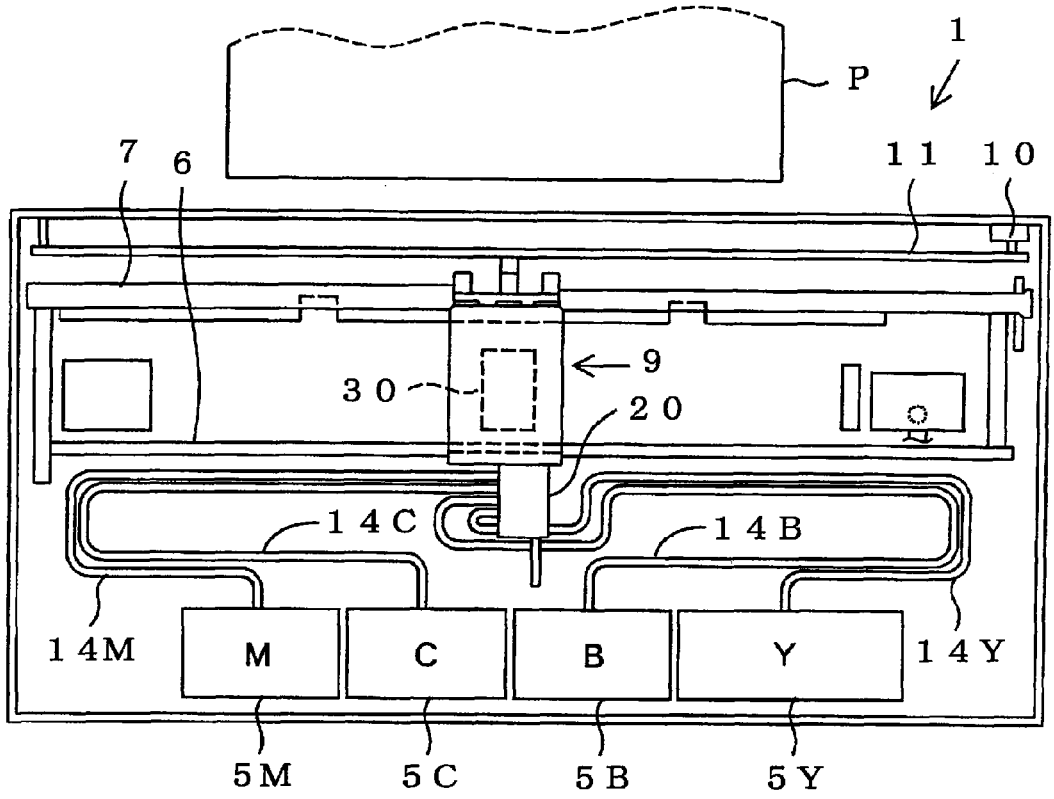
FIG. 1 is a plan view for explaining relevant elements of an ink-jet recording apparatus as a first embodiment of the present invention.

First, there will be described relevant elements of an ink-jet recording apparatus 1 by reference to FIG. 1. FIG. 1 is a plan view for explaining the relevant elements of the ink-jet recording apparatus 1.

Inside the ink-jet recording apparatus 1, there are provided two guide bars 6, 7 that cooperate with each other to support a head holder 9 that also functions as a movable carriage. The head holder 9 holds an ink-jet recording head 30 that ejects droplets of inks toward a recording sheet, P, so as to record an image thereon. The head holder 9 is fixed to an endless belt 11 that is circulated by an electric motor 10 and, when the motor 10 is driven or rotated, the head holder 9 is reciprocated along the two guide bars 6, 7. Thus, the head holder 9, the electric motor 10, and the endless belt 11 cooperate with each other to provide a moving device that moves the ink-jet recording head 30 relative to the recording sheet P as a recording medium.

In addition, an ink tank 5M that stores a magenta ink, an ink tank 5C that stores a cyan ink, an ink tank 5B that stores a black ink, and an ink tank 5Y that stores a yellow ink are provided at respective fixed positions in a housing of the ink-jet recording apparatus 1. The four ink tanks 5M through 5Y are connected to a tube joint 20 via four flexible tubes 14M, 14C, 14B, 14Y, respectively.

(Head Holder)

Next, there will be described relevant elements of the head holder 9.

In the following description, a surface from, and a direction in, which droplets of the inks are ejected from the head holder 9 will be referred to as the "lower" surface and the "downward" direction, respectively; and a surface opposite to the lower surface and a direction opposite to the downward direction will be referred to as the "upper" surface and the "upward" direction, respectively. In addition, respective directions toward left-hand and right-hand ends of the ink-jet recording apparatus 1, as seen in FIG. 1, will be referred to as the "leftward" and "rightward" directions, respectively; and respective directions toward lower and upper ends of the ink-jet recording apparatus 1, as seen in FIG. 1, will be referred to as the "frontward" and "rearward" directions, respectively.

In addition, suffixes M, C, B, Y, given to reference numerals, indicate relations to the magenta ink, the cyan ink, the black ink, and the yellow ink, respectively.

Figure 3:
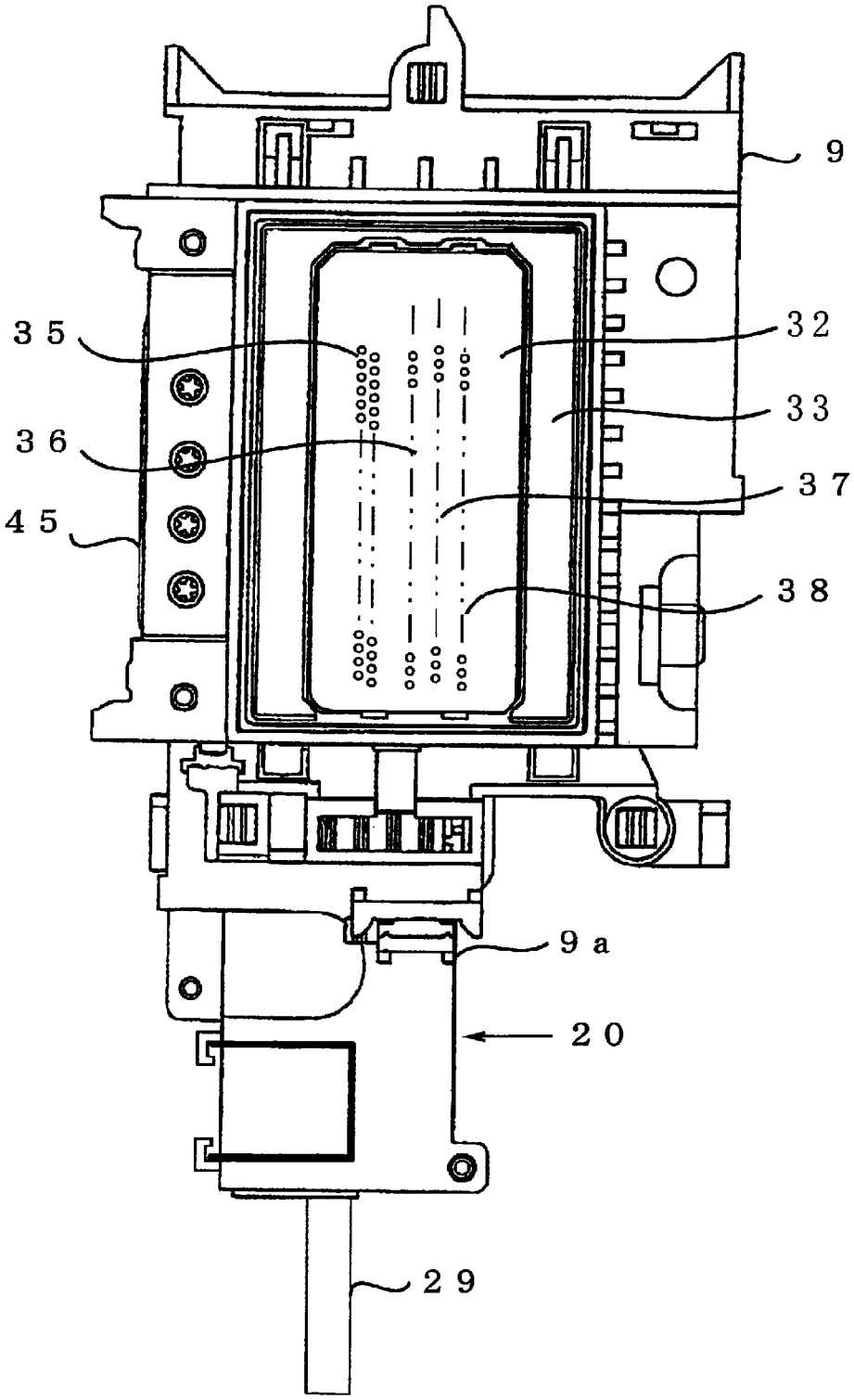
FIG. 3 is a view of a nozzle-opening surface of the head holder 9 shown in FIG. 2.
Figure 4:
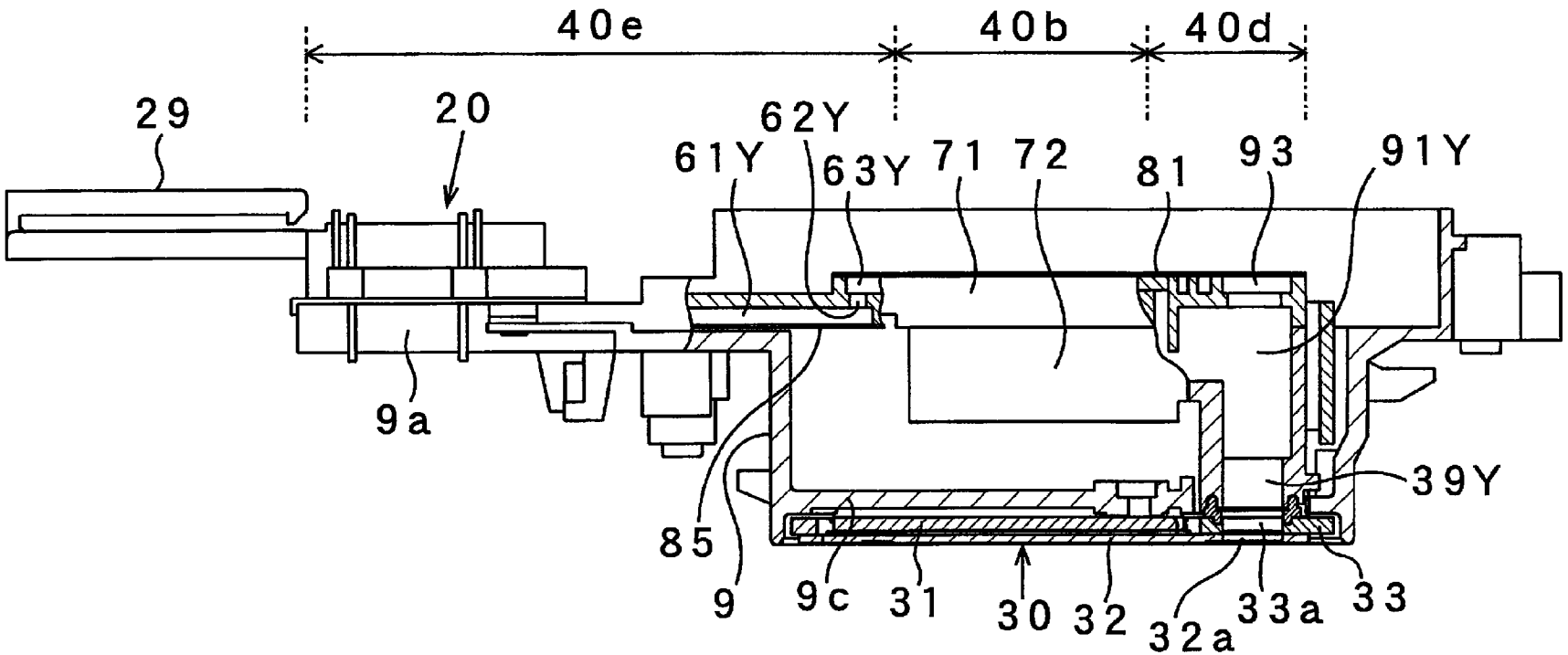
FIG. 4 is a cross-section view taken along Arrows 4-4 in FIG. 2 (or FIG. 15).

As shown in FIG. 4, the head holder 9 has a box-like configuration having an upper opening, and the ink-jet recording head 30 is held by a lower surface of a bottom wall 9*c* of the head holder 9. The ink-jet recording head 30 includes a cavity portion 32 having a multiplicity of ink-flow passages, and a piezoelectric actuator 31 that is stacked on the cavity portion 32 and that selectively applies an ejection pressure to an arbitrary one of the inks present in the ink-flow passages of the cavity portion 32. The cavity portion 32 has, in a lower surface thereof, nozzle arrays 35, 36, 37, 38 (FIG. 3) corresponding to the four inks, and additionally has, in an upper surface thereof, four ink-supply inlets corresponding to the four inks, respectively. In FIG. 4, only the ink-supply inlet 32*a* into which the yellow ink flows is shown. A reinforcing frame 33 having a central opening is fixed, by adhesion, to an upper surface of the ink-jet recording head 30. The reinforcing frame 33 additionally has four ink-flow openings corresponding to the four ink-supply inlets of the cavity portion 32, respectively. In FIG. 4, only the ink-flow opening 33*a* corresponding to the yellow-ink supply inlet 32*a* is shown.

(Buffer Tank 40)

The buffer tank 40 is provided above the bottom wall 9*c* of the head holder 9. Regarding the upward and downward directions, the buffer tank 40 has such an arrangement that an upper ink case 71 and a lower ink case 72 extend parallel to each other and are joined to each other. In addition, regarding the frontward and rearward directions, the buffer tank 40 has such an arrangement that an ink-introduce portion 40*e*, a buffer portion 40*b*, and an ink-output portion 40*d* are arranged in the order of description.

In the buffer portion 40*b*, the upper ink case 71 has a partition wall 71*c* (FIGS. 11 and 12) that separates an inner space into upper and lower portions. Thus, the upper ink case 71 has an upper, yellow-ink deliver chamber 41 (FIG. 6) that accommodates and delivers the yellow ink, and a lower, magenta-ink deliver chamber 42 (FIG. 7) that accommodates and delivers the magenta ink, such that the two ink-deliver chambers 41, 42 are adjacent to each other via the partition wall 71*c*.

In addition, the lower ink case 72 has a partition wall 72*c* (FIGS. 13 and 14) that separates an inner space into upper and lower portions. Thus, the lower ink case 72 has an upper, cyan-ink deliver chamber 43 (FIG. 8) that accommodates and delivers the cyan ink, and a lower, black-ink deliver chamber 44 (FIG. 9) that accommodates and delivers the black ink, such that the two delivery chambers 43, 44 are adjacent to each other via the partition wall 72*c*.

That is, the four ink-deliver chambers 41, 42, 43, 44 are arranged in the upward and downward directions such that the four chambers 41 through 44 extend parallel to each other and such that the first pair of chambers 41, 42 are formed in one, upper ink case 71 and the second pair of chambers 43, 44 are formed in the other, lower ink case 72. Thus, the buffer tank 40 temporarily stores the yellow ink, the magenta ink, the cyan ink, and the black ink in respective layers that are arranged in the order of description in the downward direction.

Since the four ink-deliver chambers 41 through 44 extend parallel to each other, and are arranged in the upward and downward directions (i.e., are aligned with each other in the upward and downward directions), the four chambers 41 through 44 have substantially same operational characteristics regarding the delivering of the inks to the ink-jet recording head 30. In addition, the four ink-deliver chambers 41 through 44 can have respective sufficiently large volumes, without needing to increase a height of the buffer tank 40 or a height of the ink-jet recording apparatus 1 as a whole. Therefore, the ink-jet recording apparatus 1 can effectively damp the changes of pressure of the inks and thereby can record images with a high quality.

The ink-output portion 40*d* includes the same number of ink-deliver passages 91Y, 91M, 91C, 91B as the number of the ink-deliver chambers 41 through 44, and the ink-deliver passages 91Y through 91B are provided in rear of the buffer portion 40*b* such that the ink-deliver passages 91Y through 91B are arranged in an array in a scanning direction in which the ink-jet recording head 30 is moved. The ink-deliver passages 91Y through 91B each extend in the upper and lower ink cases 71, 72, and have, as respective lower open ends thereof, respective ink-deliver outlets 39Y, 39M, 39C, 39B that communicate with the respective ink-supply inlets (only the ink-supply inlet 32*a* is shown) of the ink-jet recording head 30 via the respective ink-flow openings (only the ink-flow opening 33*a* is shown) of the reinforcing frame 33.

The four ink-deliver passages 91Y through 91B corresponding to the four inks, respectively, are formed by separating, with separation walls 91*g*, respective inner spaces of respective tubular walls 91*e*, 91*f* of the upper and lower ink cases 71, 72. When the tubular wall 91*e* and the separation walls 91*g* of the upper ink case 71 and the tubular wall 91*f* and the separation walls 91*g* of the lower ink case 72 are aligned with each other, and are bonded to each other by, e.g., supersonic welding or adhesion, then the ink-deliver passages 91Y through 91B are each formed continuously in the upper and lower ink cases 71, 72 while the two ink cases 71, 72 are joined to, and integrated with, each other.

Thus, in the respective rear portions of the upper and lower ink cases 71, 72, the ink-deliver passages 91Y through 91B extend in the upward and downward directions.

The ink-introduce portion 40*e* includes an extension portion 40*a* that is extended frontward from the buffer portion 40*b*. As shown in FIG. 4, the extension portion 40*a* is supported by a support arm 9*a* that is extended horizontally frontward from a front end of the head holder 9. The tube joint 20 is attached to an upper surface of a front portion of the extension portion 40*a*. The tube joint 20 includes, as a front end portion thereof, a cable-hold portion 29 that holds a flexible flat cable, not shown, such that the flexible flat cable is passed through a slit of the cable-hold portion 29 in the leftward and rightward directions in FIG. 1.

Figure 2:
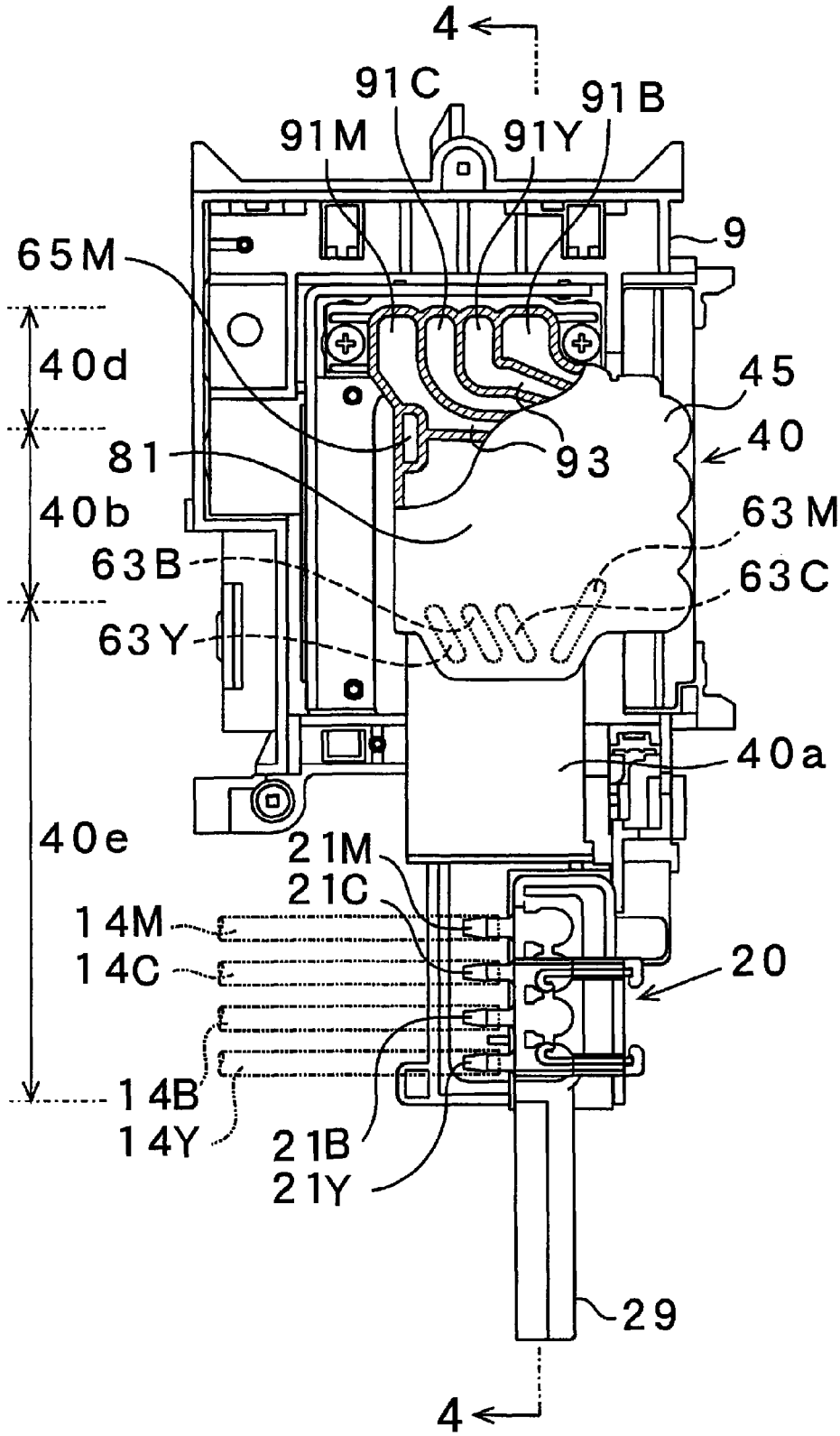
FIG. 2 is a plan view of a head holder 9 of the ink-jet recording apparatus.

As shown in FIG. 2, the tube joint 20 includes connection portions 21M, 21C, 21B, 21Y to which the tubes 14M through 14Y are connected, respectively, such that the connection portions 21M through 21Y are arranged in an array in the frontward direction, and project in the leftward direction. The connection portions 21M through 21Y have respective inner ink-flow passages into which the respective inks flow from the tubes 14M through 14Y connected thereto.

Figure 5:
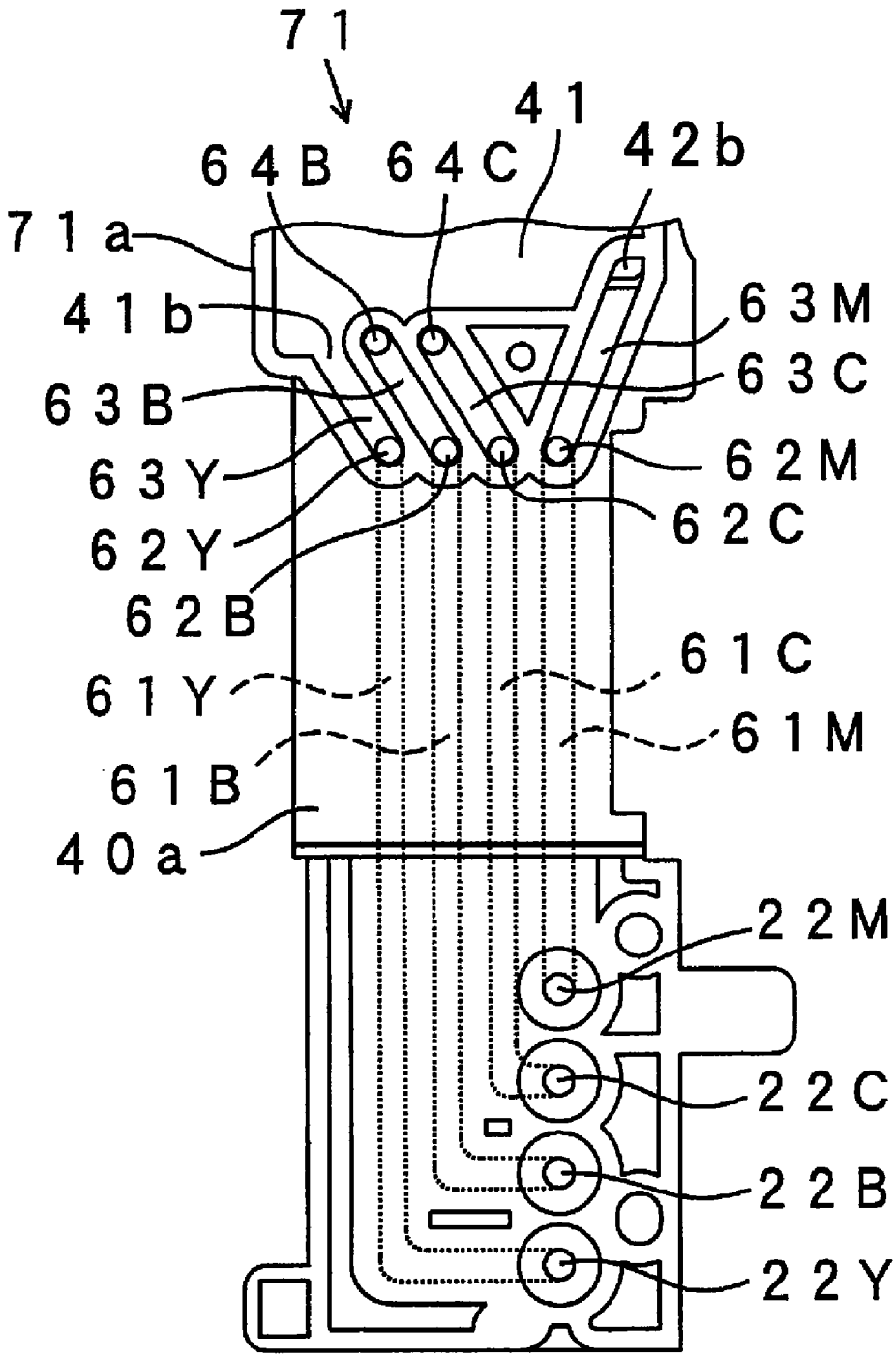
FIG. 5 is a plan view of ink-introduce passages provided in an extension portion 40*a* of a buffer tank 40 of the head holder 9 shown in FIG. 2.

As shown in FIG. 5, in an upper surface of the extension portion 40*a* that corresponds to a lower surface of the tube joint 20, ink-introduce inlets 22M, 22C, 22B, 22Y that communicate with the respective inner ink-flow passages of the connection portions 21M through 21Y (FIG. 2) are formed to open, and are arranged in an array in the order of description in the frontward direction.

The extension portion 40*a* has, in a lower surface thereof, ink-introduce passages 61M, 61C, 61B, 61Y that are connected, at respective front ends thereof, to the ink-introduce inlets 22M through 22Y. The ink-introduce passages 61M, 61C, 61B, 61Y are each defined by a groove (e.g., a recessed groove employed in the present embodiment) that extends in the frontward and rearward directions, and are arranged, in the lower surface of the extension portion 40*a*, in the leftward and rightward directions.

Figure 11:
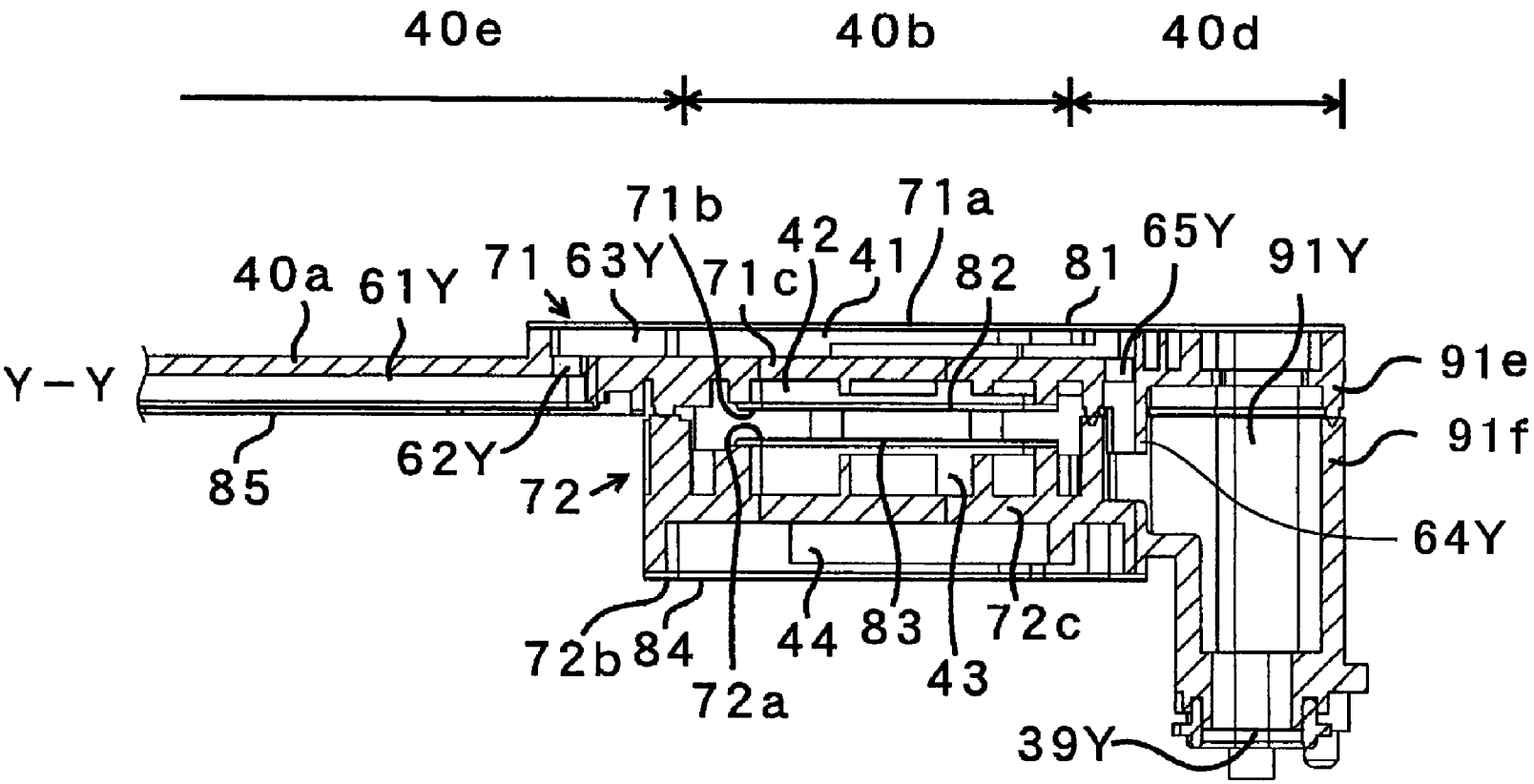
FIG. 11 is a cross-section view taken along Arrows Y-Y in FIG. 10.

The ink-introduce passages 61M through 61Y given in the form of the grooves have respective lower openings that are commonly closed by a film 85 (FIGS. 4 and 11). The film 85 cooperates with those grooves to constitute the ink-introduce passages 61M through 61Y.

The extension portion 40*a* is integrally formed with, and connected to, the partition wall 71*c* of the upper ink case 71. The ink-introduce passages 61M through 61Y are connected, at respective rear ends thereof, to respective ink-introduce passages 63M, 63C, 63B, 63Y, formed in the upper surface of the extension portion 40*a*, via respective ink-introduce holes 62M, 62C, 62B, 62Y formed through a thickness of the extension portion 40*a* in the upward and downward directions.

As will be described later, the left-hand-end ink-introduce passage 63Y and the right-hand-end ink-introduce passage 63M (FIG. 5) are connected to the yellow-ink deliver chamber 41 and the magenta-ink deliver chamber 42 of the upper ink case 71, respectively; and the intermediate, two ink-introduce passages 63C, 63B are connected to the cyan-ink deliver chamber 43 and the black-ink deliver chamber 44 of the lower ink case 72, respectively.

A lower surface 71*b* of the upper ink case 71 that is opposed to an upper surface 72*a* of the lower ink case 72 has, at a position that is, in its plan view, aligned with respective rear ends of the intermediate two ink-introduce passages 63C, 63B, a tubular wall 92*a* (FIG. 7) projecting downward from the lower surface 71*b* toward the upper surface 72*a*; and the upper surface 72*a* of the lower ink case 72 that is opposed to the lower surface 71*b* of the upper ink case 71 has, at a position that is, in its plan view, aligned with the respective rear ends of the intermediate two ink-introduce passages 63C, 63B, a tubular wall 92*b* (FIG. 8) projecting upward from the upper surface 72*a* toward the lower surface 71*b*. Two ink-introduce passages 64B, 64C are each formed through the two tubular walls 92*a*, 92*b*, and are connected, at respective upper open ends thereof, to the respective rear ends of the two ink-introduce passages 63C, 63B.

If the two tubular walls 92*a*, 92*b* are joined to each other by a bonding means such as supersonic welding or adhesion, then the two ink-introduce passages 63C, 63B of the upper ink case 71 are connected to the two ink-deliver chambers 43, 44 of the lower ink case 72 via the two ink-introduce passages 64B, 64C of the same 72. In addition, the joining of the two tubular walls 92*a*, 92*b* cooperates with the joining of the two tubular walls 91*e*, 91*f* to connect and integrate the upper and lower ink cases 71, 72 to and with each other.

(Each Ink-Deliver Chamber 41 through 44)

Next, relevant elements of each of the ink-deliver chambers 41 through 44 will be described by reference to the drawings.

(Ink-Deliver Chamber 41)

Figure 6:
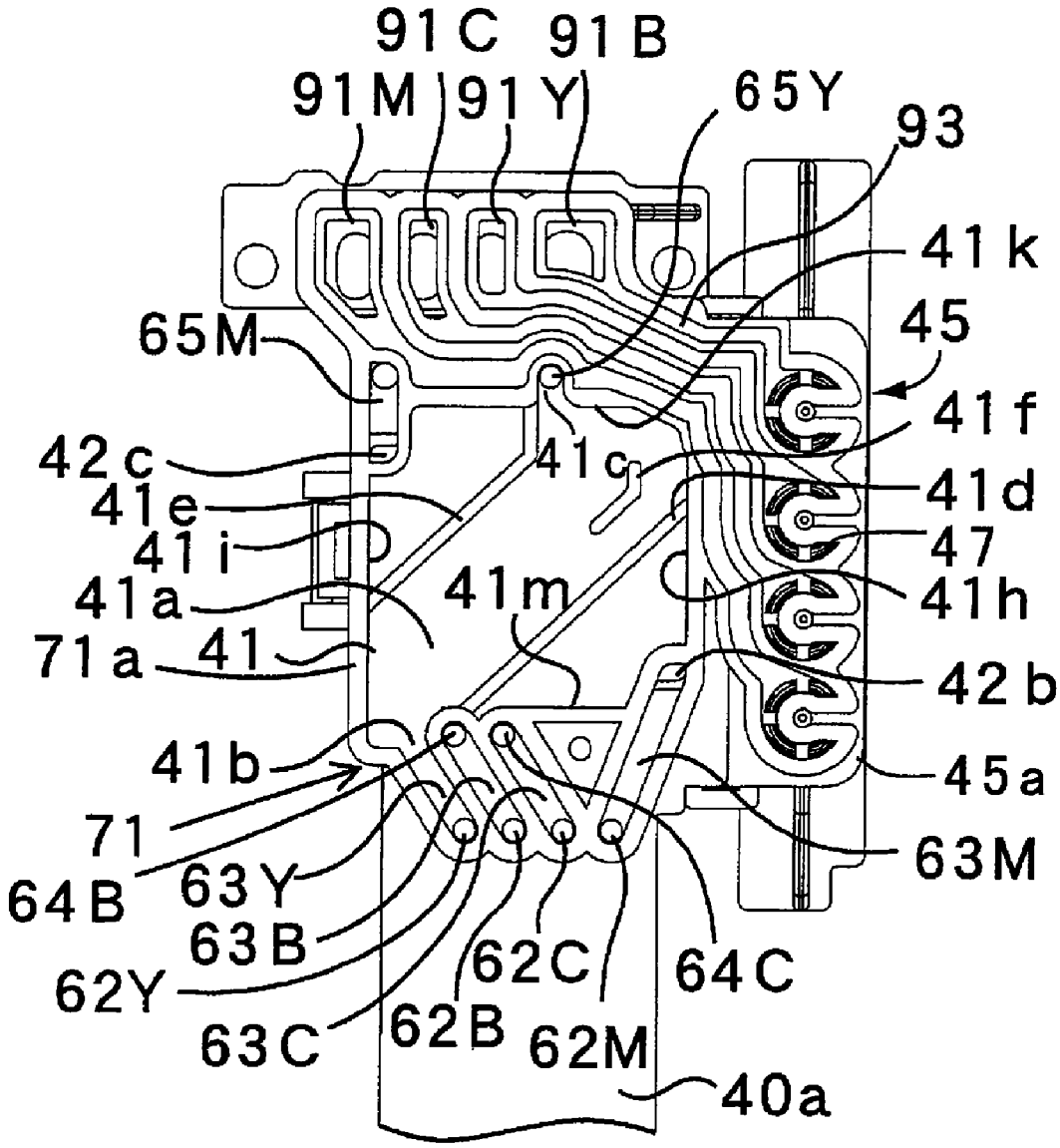
FIG. 6 is a top plan view of an upper ink case 71 of the head holder 9.

As shown in FIG. 6, in the buffer portion 40*b* of the buffer tank 40, the yellow-ink deliver chamber 41 is formed in the upper surface 71*a* of the partition wall 71*c* (FIG. 11) of the upper ink case 71, such that the yellow-ink deliver chamber 41 has a flat inner space whose cross section is generally quadrangular, and has an upper opening that is also generally quadrangular. The yellow-ink deliver chamber 41 has four side surfaces that are defined by a left-hand side wall 41*i*, a right-hand side wall 41*h*, a rear side wall 41*k*, and a front side wall 41*m*. The yellow-ink deliver chamber 41 has, at a left-hand and front corner contained by the left-hand side wall 41*i* and the front side wall 41*m*, an ink-flow inlet 41*b* that communicates with the rear end of the ink-introduce passage 63Y.

The yellow-ink deliver chamber 41 additionally has an ink-flow outlet 41*c* through which the yellow ink flows from the deliver chamber 41. The ink-flow outlet 41*c* opens, in the deliver chamber 41, at a position located on the right-hand side of the middle of the rear side wall 41*k* and spaced leftward from a right-hand and rear corner of the deliver chamber 41.

Thus, the yellow-ink flow inlet 41*b* and the yellow-ink flow outlet 41*c* are provided at respective positions that are, in view of their circumstances, as near as possible to respective diagonal positions of the yellow-ink deliver chamber 41. That is, the yellow-ink flow inlet 41*b* and the yellow-ink flow outlet 41*c* are provided at respective positions that are substantially the most distant from each other such that almost all portions of the inner space of the deliver chamber 41 are located between the two positions.

The yellow-ink flow inlet 41*b* and the yellow-ink flow outlet 41*c* are distant from each other in a direction (i.e., an example of a first direction) that is perpendicular to not only the scanning direction but also the upward and downward directions, and a straight line connecting between the inlet 41*b* and the outlet 41*c* is inclined relative to the first direction. These are also true with the other ink-deliver chambers 42, 43, 44.

The yellow-ink flow outlet 41*c* is connected to the ink-deliver passage 91Y (FIGS. 7 and 11) via a connection passage 65Y, formed through a thickness of the partition wall 71*c* of the upper ink case 71, from a bottom surface 41*a* of the yellow-ink deliver chamber 41 to the lower surface 71*b* (FIG. 7) of the partition wall 71*c*. A lower end of the connection passage 65Y opens in the ink-deliver passage 91Y at a position lower than an upper end of the passage 91Y. That is, a lower portion of the connection passage 65Y is defined by a guide wall 64Y projecting downward from the lower surface 71*b* of the upper ink case 71, so that the yellow ink is delivered from the ink-flow outlet 41*c* to a lower portion of the ink-deliver passage 91Y. The four ink-deliver passages 91Y, 91M, 91C, 91B are expanded frontward into a space between the yellow-ink deliver chamber 41 and the black-ink deliver chamber 44, so as to be aligned with the connection passage 65Y, a connection passage 65M, a cyan-ink flow outlet 43*c*, and a black-ink flow outlet 44*c*, respectively, in the upward and downward directions. The connection passage 65Y can be said as an extension of the yellow-ink flow outlet 41*c*, and the connection passage 65M can be said as an extension of a magenta-ink flow outlet 42*c*.

Respective upper openings of the yellow-ink deliver chamber 41, the four ink-introduce passages 63Y, 63B, 63C, 63M, and four air-discharge passages 93, described later, are closed by a flexible film 81 as a flexible diaphragm (FIGS. 2, 4 and 11). Respective upper surfaces of respective side walls that define the ink-introduce passages 63Y through 63M and the air-discharge passages 93 are flush with respective upper surfaces of the four side walls 41*h*, 41*i*, 41*k*, 41*m* of the yellow-ink deliver chamber 41. The flexible film 81 is bonded to those upper surfaces by a bonding means such as adhesion or thermal welding. Thus, the yellow-ink deliver chamber 41, the ink-introduce passages 63Y through 63M, and the air-discharge passages 93 are formed in the upper ink case 71.

Three ribs 41*d*, 41*e*, 41*f* project upward from the bottom surface 41*a* of the yellow-ink deliver chamber 41, such that the two ribs 41*d*, 41*f* are located on one side of, and spaced from, the straight line connecting between the yellow-ink flow inlet and outlet 41*b*, 41*c* and the rib 41*e* is located on the opposite side of, and spaced from, the same line. Each of the ribs 41*d*, 41*e* has a quadrangular cross section, and has a height equal to substantially half a depth of the ink-deliver chamber 41 (i.e., a distance between the bottom surface 41*a* and the film 81). Thus, the two ribs 41*d*, 41*e* are spaced from the film 81 so as not to restrict displacing of the flexible film 81. The two ribs 41*d*, 41*e* cooperate with each other to guide a quick flow of the yellow ink from the ink-flow inlet 41*b* to the ink-flow outlet 41*c*. The third rib 41*f* bent at an intermediate portion thereof, is located between the two ribs 41*d*, 41*e*, and cooperates with the second rib 41*e*, also bent at an intermediate portion thereof, to guide the flow of the yellow ink to the ink-flow outlet 41*c*.

(Magenta-Ink Deliver Chamber 42)

Figure 7:
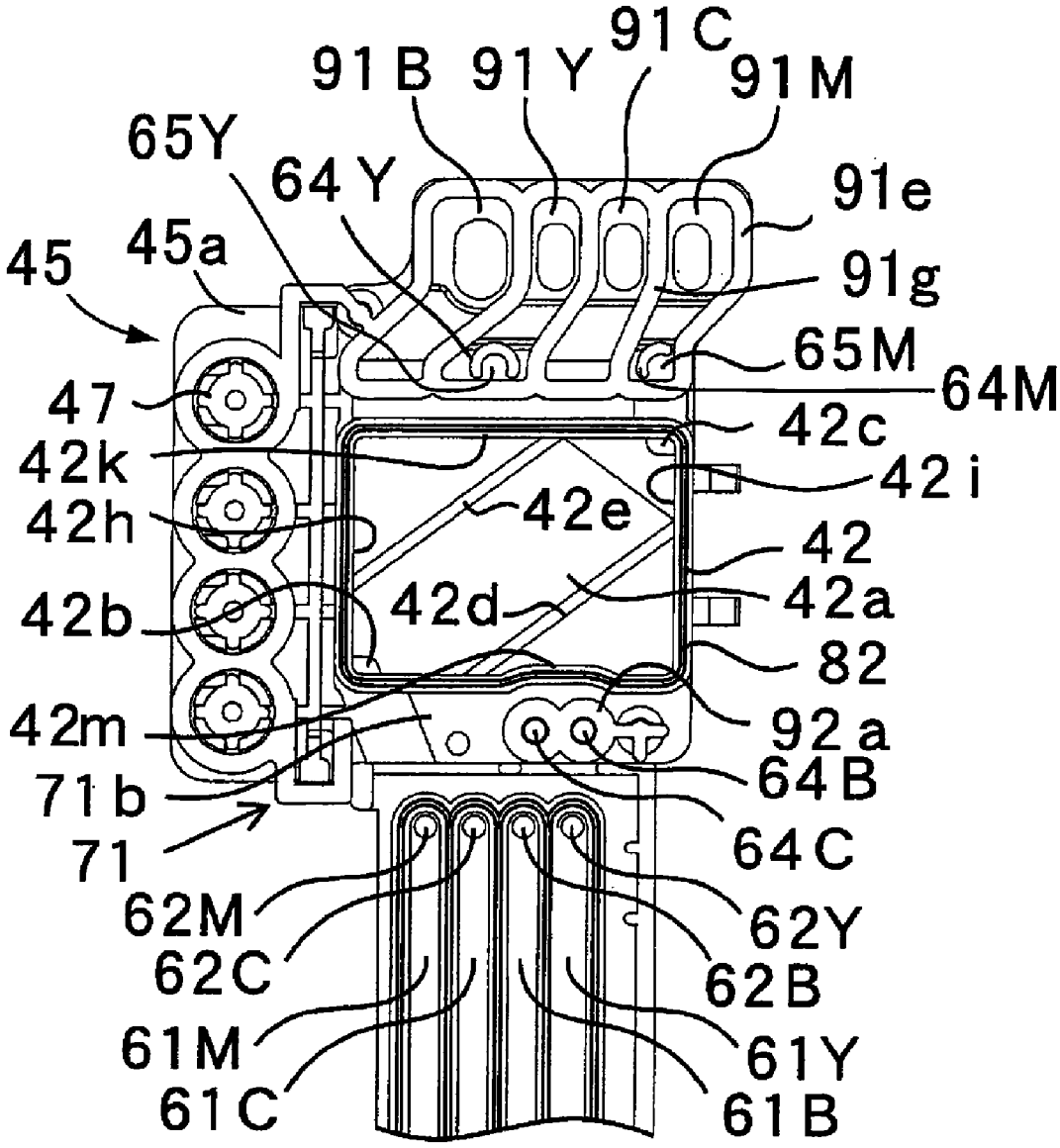
FIG. 7 is a bottom plan view of the upper ink case 71.

Next, the magenta-ink deliver chamber 42 will be described by reference to FIG. 7. Since FIG. 7 is a bottom view of the upper ink case 71, "left" and "right" in FIG. 6 are reversed in FIG. 7, i.e., correspond to—right—and—left—in FIG. 7, respectively. In the following description, however, the terms "left" and "right" defined in relation with FIG. 6 are also used in relation with FIG. 7.

Figure 12:
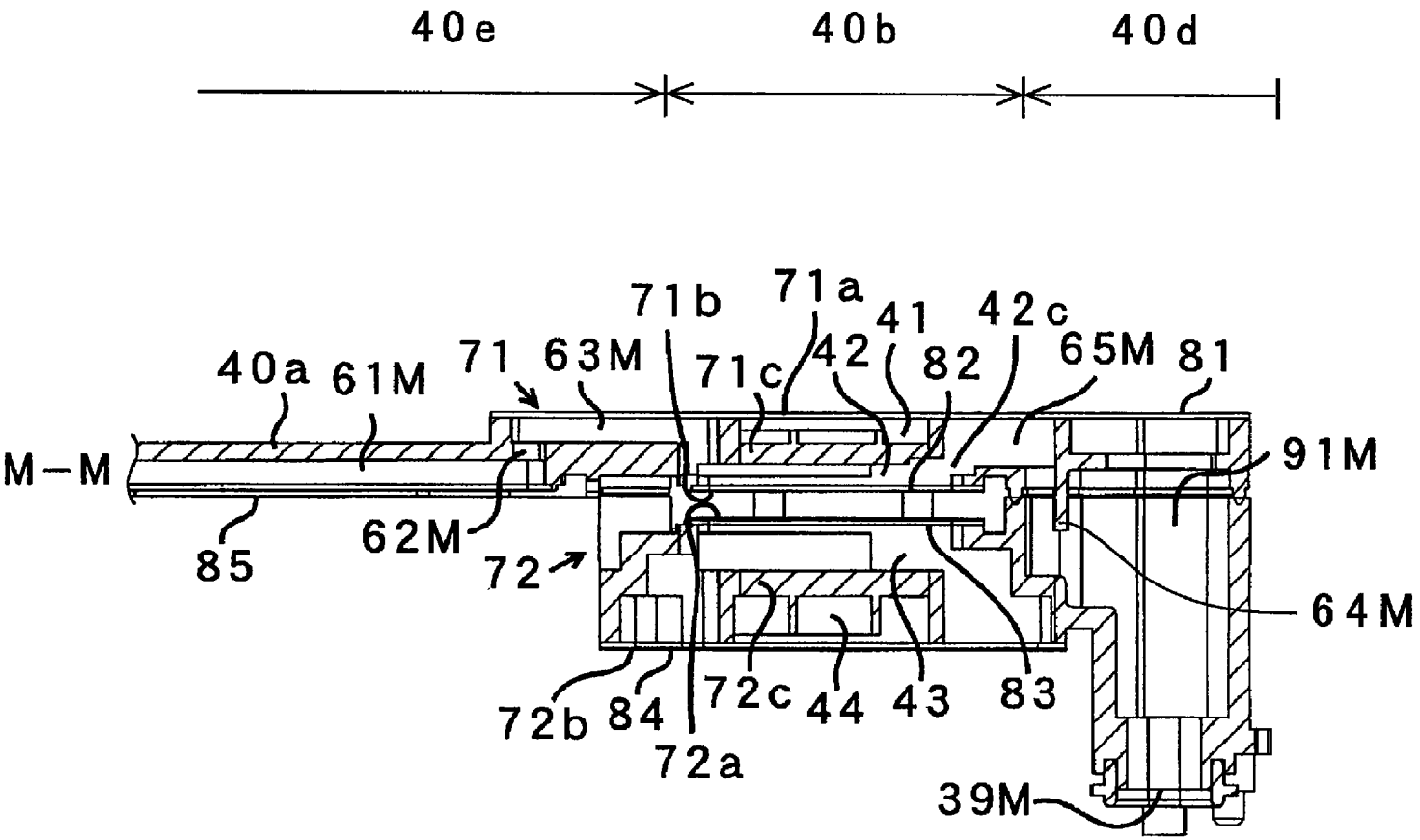
FIG. 12 is a cross-section view taken along Arrows M-M in FIG. 10.

As shown in FIG. 7, in the buffer portion 40*b* of the buffer tank 40, the magenta-ink deliver chamber 42 is formed in the lower surface 71*b* of the partition wall 71*c* of the upper ink case 71, such that the magenta-ink deliver chamber 42 has a flat inner space whose cross section is generally quadrangular, and has a lower opening that is also generally quadrangular. The magenta-ink deliver chamber 42 is defined by four side walls, i.e., a left-hand side wall 42*i*, a right-hand side wall 42*h*, a rear side wall 42*k*, and a front side wall 42*m*. As shown in FIG. 12, the magenta-ink deliver chamber 42 is provided adjacent to the yellow-ink deliver chamber 41 via the partition wall 71*c*.

The magenta-ink deliver chamber 42 has an ink-flow inlet 42*b* that is formed through the thickness of the upper ink case 71, is connected to the rear end of the ink-introduce passage 63M (FIG. 6), and opens in a bottom surface 42*a* of the deliver chamber 41, at a right-hand and rear corner thereof (FIG. 7).

The magenta-ink deliver chamber 42 additionally has an ink-flow outlet 42*c* through which the magenta ink flows from the deliver chamber 42. The ink-flow outlet 42*c* is formed through the thickness of the upper ink case 71, and opens, in the bottom surface 42*a* of the deliver chamber 42, at a left-hand and rear corner thereof that is diagonal relative to the ink-flow inlet 42*b*.

The upper ink case 71 (or the partition wall 71*c* thereof) has, in the upper surface 71*a* thereof, a connection passage 65M at a position that is aligned with the ink-flow outlet 42*c* and is located outside the yellow-ink deliver chamber 41. One end of the connection passage 65M is connected to the ink-flow outlet 42*c* formed through the thickness of the partition wall 71*c*, and the other end of the same 65M is formed through the thickness of the partition wall 71*c* and is connected to the magenta-ink deliver passage 91M.

A lower end of the connection passage 65M opens, in the ink-deliver passage 91M, at a position lower than an upper end of the same 91M. Thus, a lower portion of the rear end portion of the connection passage 65M is defined by a guide wall 64M projecting downward from the upper ink case 71, so that the magenta ink is delivered from the ink-flow outlet 42*c* to a lower portion of the ink-deliver passage 91M.

As described above, the magenta-ink flow outlet 42*c* is formed through the thickness of the partition wall 71*c* that separates the upper ink case 71 into the two ink-deliver chambers 41, 42, and is connected to the ink-deliver passage 91M via the connection passage 65M. Thus, the magenta-ink flow outlet 42*c* is an example of an ink-flow outlet of an ink-deliver chamber, formed in one of opposite surfaces of a case, that is formed through a thickness of the case in a direction from the one surface to the other surface and is connected to an ink-deliver passage.

Thus, the magenta-ink flow inlet 42*b* and the magenta-ink flow outlet 42*c* are provided at respective substantially diagonal positions of the magenta-ink deliver chamber 42. That is, the magenta-ink flow inlet 42*b* and the magenta-ink flow outlet 42*c* are provided at respective positions that are substantially the most distant from each other such that almost all portions of the inner space of the deliver chamber 42 are located between the two positions.

That is, the magenta-ink flow inlet 42*b* and the magenta-ink flow outlet 42*c* are provided at respective positions that are substantially the most distant from each other such that almost all portions of the inner space of the deliver chamber 42 where the magenta ink flows are located between the two positions.

In addition, the yellow-ink deliver chamber 41 and the magenta-ink deliver chamber 42 are provided adjacent to each other via the partition wall 71*c* of the upper ink case 71, such that the yellow-ink flow inlet 41*b* and the magenta-ink flow inlet 42*b* are provided at respective different positions along the partition wall 71*c* and the yellow-ink flow outlet 41*c* and the magenta-ink flow inlet 42*c* are provided at respective different positions along the partition wall 71*c*. Thus, in a plan view of the upper ink case 71, a straight line connecting between the yellow-ink flow inlet 41*b* and the yellow-ink flow outlet 41*c* and a straight line connecting between the magenta-ink flow inlet 42*b* and the magenta-ink flow outlet 42*c* have such a positional relationship in which the two straight lines intersect each other like two diagonal lines of a quadrangle.

That is, the yellow-ink flow inlet 41*b* and the yellow-ink flow outlet 41*c* are distant from each other, and the magenta-ink flow inlet 42*b* and the magenta-ink flow outlet 42*c* are distant from each other, in the direction (i.e., an example of the first direction) that is perpendicular to not only the scanning directions but also the upward and downward directions, and the straight line connecting between the yellow-ink flow inlet 41*b* and the yellow-ink flow outlet 41*c* and the straight line connecting between the magenta-ink flow inlet 42*b* and the magenta-ink flow outlet 42*c* are inclined, relative to the first direction, in opposite directions each away from the first direction. These are also true with the other pair of ink-deliver chambers 43, 44.

A lower opening of the magenta-ink deliver chamber 42 is closed by a flexible film 82 as a flexible diaphragm (FIG. 12). The film 82 is bonded to respective upper surfaces of the side walls 42*h*, 42*i*, 42*k*, 42*m* of the ink-deliver chamber 42, by a bonding means such as adhesion or thermal welding. Thus, the magenta-ink deliver chamber 42 is formed.

Thus, the upper ink case 71 includes a chamber-define wall having upper and lower openings, and the two flexible films 81, 82 that close the upper and lower openings, respectively. The chamber-define wall includes the partition wall 71*c* that separates the upper ink case 71 into the upper and lower ink-deliver chambers 41, 42; the upper, side walls 41*h*, 41*i*, 41*k*, 41*m*; and the lower, side walls 42*h*, 42*i*, 42*k*, 42*m*.

Two ribs 42*d*, 42*e* project downward from the bottom surface 42*a* of the magenta-ink deliver chamber 42, such that the two ribs 42*d*, 42 extend parallel to each other and are distant by respective substantially equal distances from a diagonal line connecting between the magenta-ink flow inlet 42*b* and the magenta-ink flow outlet 42*c*. Each of the ribs 42*d*, 42*e* has a quadrangular cross section, and has a height equal to substantially half a depth of the deliver chamber 42 (i.e., a distance between the bottom surface 42*a* and the film 82). Thus, the ribs 42*d*, 42*e* are spaced from the film 82 so as not to restrict the displacing of the flexible film 82. The two ribs 42*d*, 42*e* cooperate with each other to guide a quick flow of the magenta ink from the ink-flow inlet 42*b* to the ink-flow outlet 42*c*.

(Cyan-Ink Deliver Chamber 43)

Figure 8:
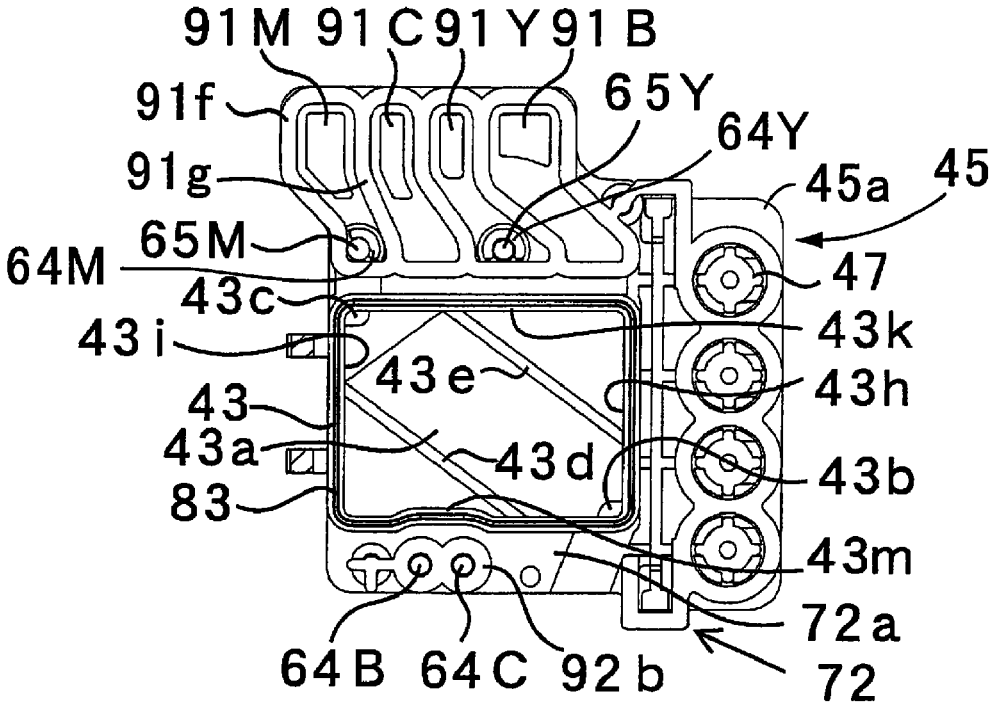
FIG. 8 is a top plan view of a lower ink case 72 of the head holder 9.
Figure 9:
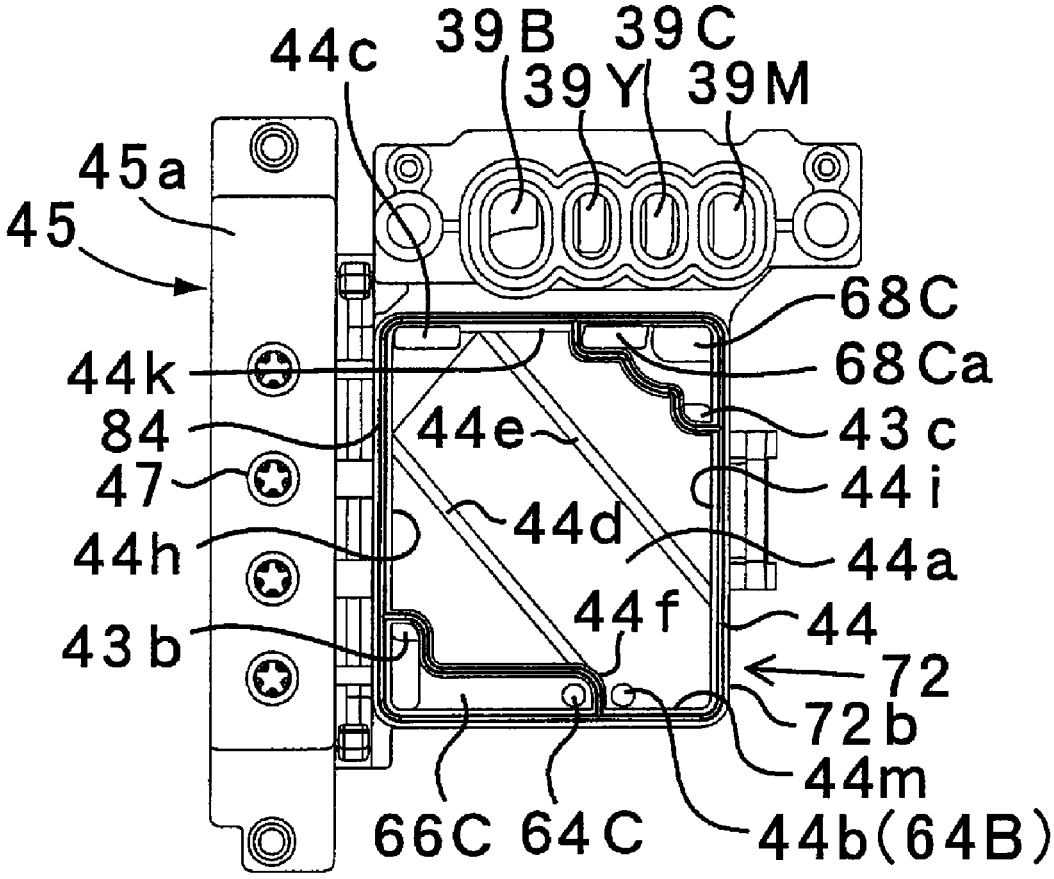
FIG. 9 is a bottom plan view of the lower ink case 72.

Next, the cyan-ink deliver chamber 43 will be described by reference to FIGS. 8 and 9. Since FIG. 9 is a bottom view of the lower ink case 72, "left" and "right" in FIG. 8 are reversed in FIG. 9, i.e., correspond to—right—and —left—in FIG. 9, respectively. In the following description, however, the terms "left" and "right" defined in relation with FIG. 8 are also used in relation with FIG. 9.

As shown in FIG. 8, the cyan-ink deliver chamber 43 having a shape similar to that of the magenta-ink deliver chamber 42, is formed in the upper surface 72*a* (FIG. 13) of the partition wall 72*c* of the lower ink case 72, at a position corresponding to the magenta-ink deliver chamber 42. The cyan-ink deliver chamber 43 is defined by four side walls, i.e., a left-hand side wall 43*i*, a right-hand side wall 43*h*, a rear side wall 43*k*, and a front side wall 43*m*, such that the deliver chamber 43 opens upward. Two ribs 43*d*, 43*e* similar to the two ribs 43*d*, 43*e* project upward from a bottom surface 43*a* of the cyan-ink deliver chamber 43.

Like the lower opening of the magenta-ink deliver chamber 42, the upper opening of the cyan-ink deliver chamber 43 is closed by a flexible film 83 having a generally rectangular shape.

The upper and lower ink cases 71, 72 are joined to each other such that the film 82 closing the magenta-ink deliver chamber 42 and the film 83 closing the cyan-ink deliver chamber 43 are spaced from, and opposed to, each other and extend parallel to each other.

The cyan-ink deliver chamber 43 has an ink-flow inlet 43*b* that is formed through the thickness of the lower ink case 72, is connected to one end of an ink-introduce passage 66C formed in the lower surface 72*b* of the lower ink case 72, and opens, in the bottom surface 43*a* of the deliver chamber 43, at a right-hand and front corner thereof. More specifically described, the ink-introduce passage 66C is formed along the right-hand and front corner of the deliver chamber 43, outside of the same 43, such that the passage 66C has an L-shaped profile, and the other end of the passage 66C is connected to a lower end of the ink-introduce passage 64C.

Thus, the ink-introduce passage 63C (FIG. 6) formed in the upper surface 71*a* of the upper ink case 71 communicates with the ink-flow inlet 43*b* of the cyan-ink deliver chamber 43 via the ink-introduce passage 64C formed through the respective thickness of the upper and lower ink cases 71, 72, and the ink-introduce passage 66C.

The cyan-ink deliver chamber 43 additionally has an ink-flow outlet 43*c* through which the cyan ink flows from the deliver chamber 43. The ink-flow outlet 43*c* is formed through the thickness of the lower ink case 72, opens, in the bottom surface 43*a* of the deliver chamber 43, at a left-hand and rear corner thereof that is diagonal relative to the ink-flow inlet 43*b*, and is connected to one end of a connection passage 68C (FIG. 9) formed in the lower surface 72*b* of the lower ink case 72.

As shown in FIG. 9, the connection passage 68C is formed along a left-hand and rear corner of the black-ink deliver chamber 44, outside the same 44, such that the passage 68C has an L-shaped profile. Respective rear end portions of the connection passage 68C and the black-ink deliver chamber 44 overlap, in their plan view, respective lengthwise intermediate portions of the ink-deliver passages 91M, 91C, 91Y, 91B, and an other end 68Ca of the connection passage 68C is formed through the thickness of the lower ink case 72 in a direction from the lower surface 72*b* thereof to the upper surface 72*a* thereof and is connected to the ink-deliver passage 91C.

More specifically described, the cyan-ink flow outlet 43*c* is formed through the thickness of the partition wall 72*c* that separates the lower ink case 72 into the two ink deliver chambers 43, 44, and is connected to the ink-deliver passage 91C via the connection passage 68C. Thus, the cyan-ink flow outlet 43*c* is an example of an ink-flow outlet of an ink-deliver chamber, formed in one of opposite surfaces of a case, that is formed through a thickness of the case in a direction from the one surface to the other surface and is connected to an ink-deliver passage. This is also true with the ink-flow outlet 44*c* of the black-ink deliver chamber 44.

(Black-Ink Deliver Chamber 44)

Next, the black-ink deliver chamber 44 will be described by reference to FIG. 9.

As shown in FIG. 9, the black-ink deliver chamber 44 is formed in the lower surface 72*b* of the partition wall 72*c* of the lower ink case 72, such that the black-ink deliver chamber 44 has a flat inner space whose cross section is generally quadrangular, and has a lower opening that is also generally quadrangular. The black-ink deliver chamber 44 is defined by four side surfaces, i.e., a left-hand side wall 44*i*, a right-hand side wall 44*h*, a rear side wall 44*k*, and a front side wall 44*m*. The black-ink deliver chamber 44 is provided adjacent to the cyan-ink deliver chamber 43 via the partition wall 72*c*.

In addition, the ink-introduce passage 66C is provided adjacent to the right-hand and front corner of the black-ink deliver chamber 44, and the connection passage 68C is provided adjacent to the left-hand and rear corner of the deliver chamber 44, such that each of the ink-introduce passage 66C and the connection passage 68C is separated from the deliver chamber 44.

A front portion of the black-ink deliver chamber 44 overlaps, in its plan view, the ink-introduce passage 64B, and the ink-introduce passage 64B is formed through a thickness of the partition wall 72*c* of the lower ink case 72, in the upward and downward directions, so as to open at a left-hand and front corner of a bottom surface 44*a* of the black-ink deliver chamber 44. Thus, a lower open end of the ink-introduce passage 64B defines an ink-flow inlet 44*b* of the black-ink deliver chamber 44.

An ink-flow outlet 44*c* of the black-ink deliver chamber 44 from which the black ink flows opens at a right-hand and rear corner of the bottom surface 44*a* of the deliver chamber 44, and is formed through the thickness of the partition wall 72*c* of the lower ink case 72, in the upward and downward directions, so as to communicate with the ink-deliver passage 91B.

Thus, the black-ink flow inlet 44*b* and the black-ink flow outlet 44*c* are provided at respective substantially diagonal positions of the black-ink deliver chamber 44. That is, the black-ink flow inlet 44*b* and the black-ink flow outlet 44*c* are provided at respective positions that are substantially the most distant from each other such that almost all portions of the deliver chamber 44 are located between the two positions.

In addition, the black-ink deliver chamber 44 and the cyan-ink deliver chamber 43 are provided adjacent to each other via the partition wall 72*c* of the lower ink case 72, such that the black-ink flow inlet 44*b* and the cyan-ink flow inlet 43*b* are provided at respective different positions along the partition wall 72*c* and the black-ink flow outlet 44*c* and the cyan-ink flow inlet 43*c* are provided at respective different positions along the partition wall 72*c*.

Thus, in a plan view of the lower ink case 72, a straight line connecting between the black-ink flow inlet 44*b* and the black-ink flow outlet 44*c* and a straight line connecting between the cyan-ink flow inlet 43*b* and the cyan-ink flow outlet 43*c* have such a positional relationship in which the two straight lines intersect each other like two different diagonal lines of a quadrangle.

Figure 14:
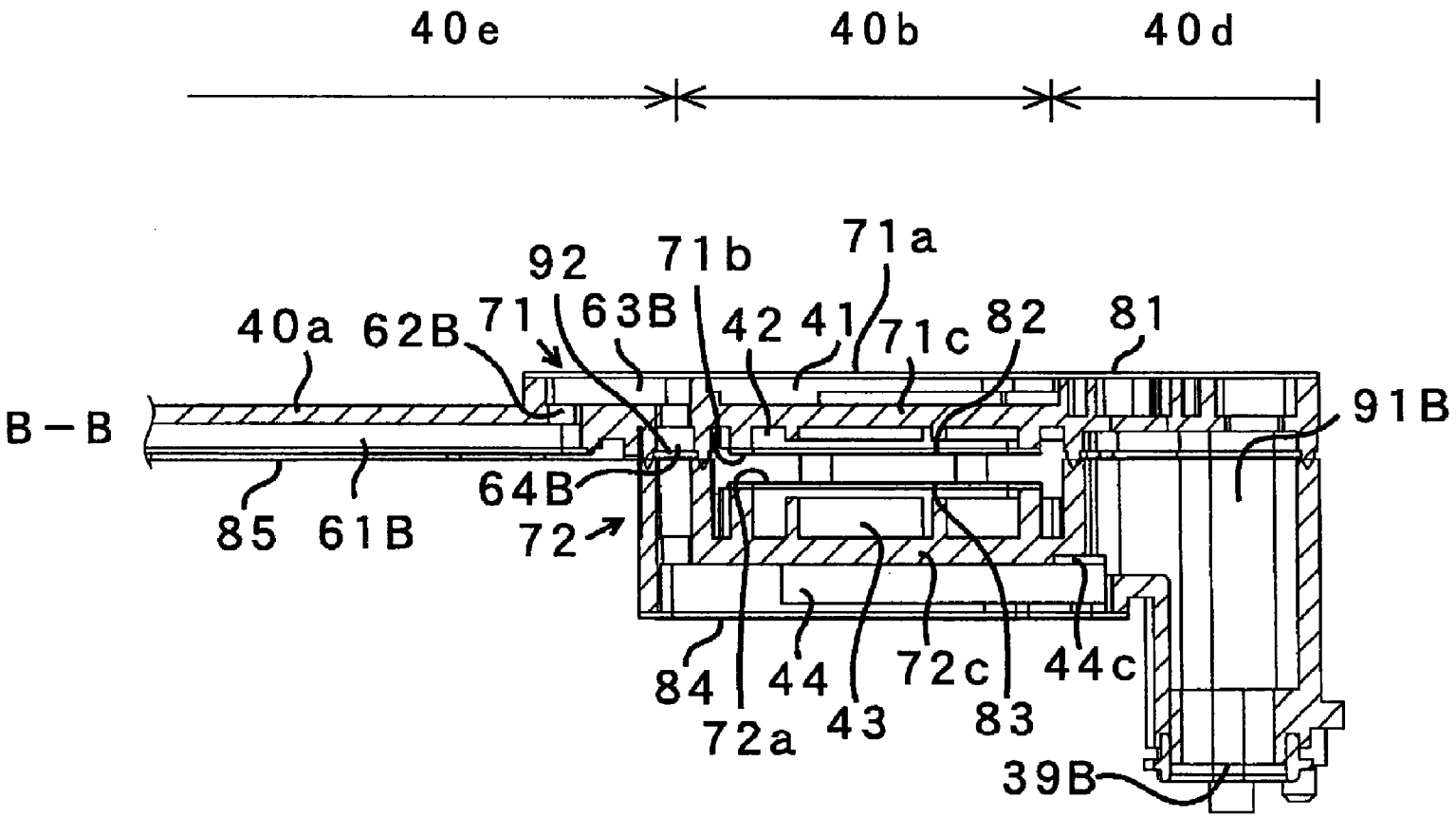
FIG. 14 is a cross-section view taken along Arrows B-B in FIG. 10.

Respective lower openings of the black-ink deliver chamber 44, the ink-introduce passage 66C, and the connection passage 68C are closed by a flexible film 84 as a flexible diaphragm (FIG. 14). Respective lower surfaces of the side walls that define the black-ink deliver chamber 44, the ink-introduce passage 66C, and the connection passage 68C are contained by a same plane, and the flexible film 84 is bonded to those lower surfaces by a bonding means such as adhesion or thermal welding. Thus, the black-ink deliver chamber 44, the ink-introduce passage 66C, and the connection passage 68C are formed in the lower ink case 72.

Two ribs 44*d*, 44*e* project downward from the bottom surface 44*a* of the black-ink deliver chamber 44, such that the rib 44*d* is located on one side of, and spaced from, a straight line connecting between the black-ink flow inlet and outlet 44*b*, 44*c* and the rib 44*e* is located on the opposite side of, and spaced from, the same line. Each of the ribs 44*d*, 44*e* has a quadrangular cross section, and has a height equal to substantially half a depth of the deliver chamber 44 (i.e., a distance between the bottom surface 44*a* and the film 84). Thus, the ribs 44*d*, 44*e* are spaced from the film 84 so as not to restrict the displacing of the flexible film 84. The two ribs 44*d*, 44*e* cooperate with each other to guide a quick flow of the black ink from the ink-flow inlet 44*b* to the ink-flow outlet 44*c*.

(Air Discharging Device)

The ink-deliver passages 91Y through 91B that are provided above the ink-deliver outlets 39Y through 39B open in the upper surface 71*a* of the upper ink case 71, and communicate with an air-discharge valve device 45, provided in a right-hand side portion of the buffer portion 40*b*, via four air-discharge passages 93 (FIG. 10) provided in the form of grooves in the upper surface 71*a* of the upper ink case 71. The air-discharge valve device 45 includes an air-discharge valve box 45*a* as a container; and four air-discharge valves 47Y, 47M, 47C, 47B that can close and open the four air-discharge passages 93, respectively.

Normally, the air-discharge valves 47Y through 47B are in their closed states, so that when the inks supplied from the tubes 14Y through 14B flow through the ink-deliver chambers 41 through 44 and the ink-deliver passages 91Y through 91B, respectively, the air bubbles contained in the inks naturally move upward so as to be collected in respective upper portions of the ink-deliver passages 91Y through 91B. When each of the air-discharge valves 47Y through 47B is placed in its open state, the air collected in the upper portion of a corresponding one of the ink-deliver passages 91Y through 91B is discharged into the outside space.

(Flow of Ink)

Figure 10:
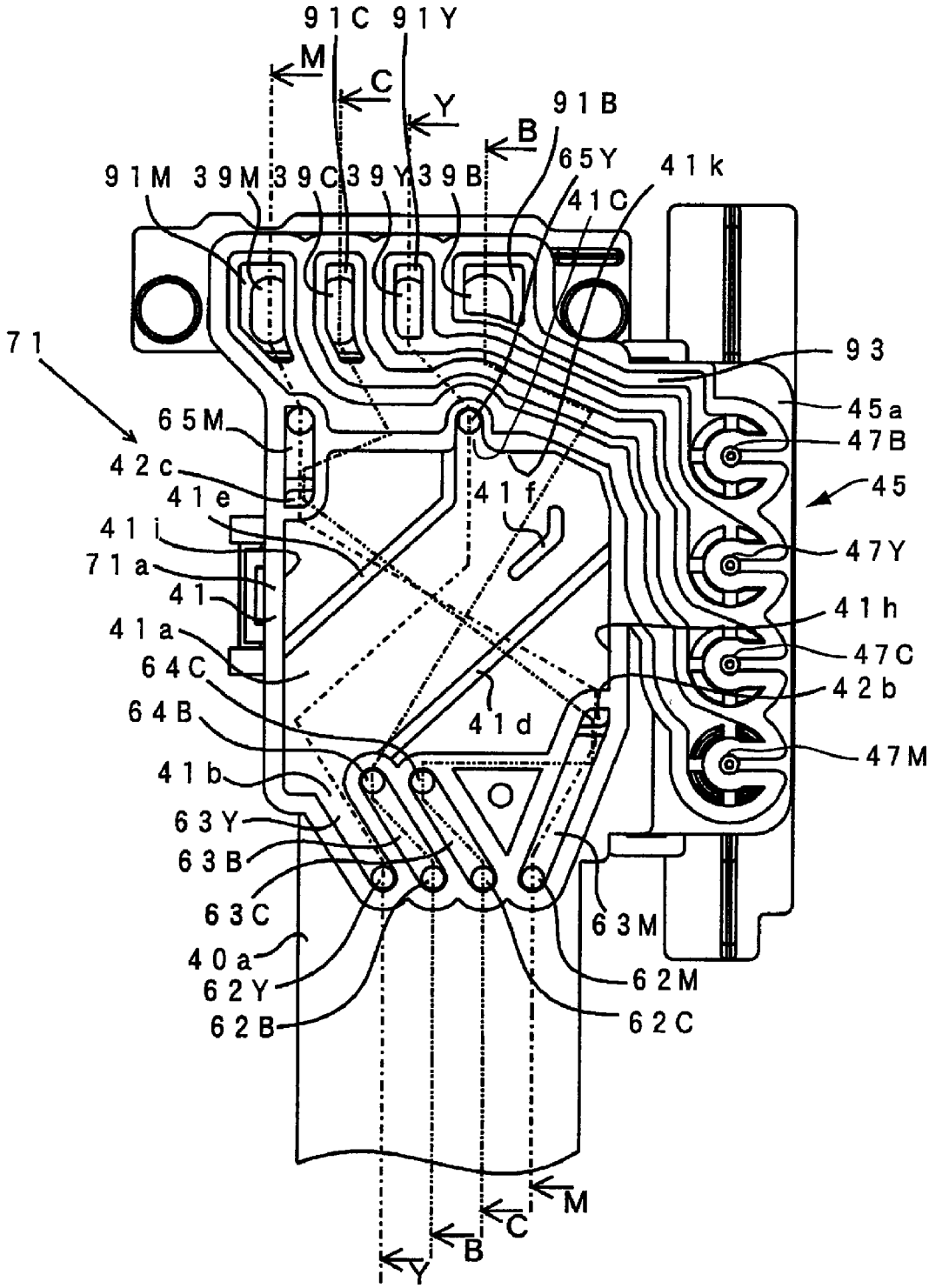
FIG. 10 is an enlarged top plan view of the upper ink case 71.

The yellow ink flows through a path provided in the cross section, shown in FIG. 11, that is taken along Y-Y in FIG. 10. More specifically described, the yellow ink first flows into the ink-introduce inlet 22Y (FIG. 5), then flows through the ink-introduce passages 61Y, 63Y, and flows into the ink-deliver chamber 41 via the ink-flow inlet 41*b* (FIG. 6).

As shown in FIG. 6, the yellow ink, introduced into the ink-deliver chamber 41, flows from the inlet 41*b* to the outlet 41*c* through almost all portions of the inner space of the chamber 41. The yellow ink, delivered from the ink-deliver chamber 41, first flows into the ink-deliver passage 91Y, and then is supplied to the ink-jet recording head 30 via the ink-deliver outlet 39Y, as shown in FIG. 11.

The magenta ink first flows through a path provided in the cross section, shown in FIG. 12, that is taken along M-M in FIG. 10. More specifically described, the magenta ink flows into the ink-introduce inlet 22M (FIG. 5), then flows through the ink-introduce passages 61M, 63M, and flows into the ink-deliver chamber 42 provided on the opposite side 71*b* of the upper ink case 71 via the ink-flow inlet 42*b* (FIG. 7).

As shown in FIG. 7, the magenta ink, introduced into the ink-deliver chamber 42, flows from the inlet 42*b* to the outlet 42*c*. The magenta ink, delivered from the ink-deliver chamber 42, flows into the ink-deliver passage 91M, and then is supplied to the ink-jet recording head 30 via the ink-deliver outlet 39M, as shown in FIG. 12.

Figure 13:
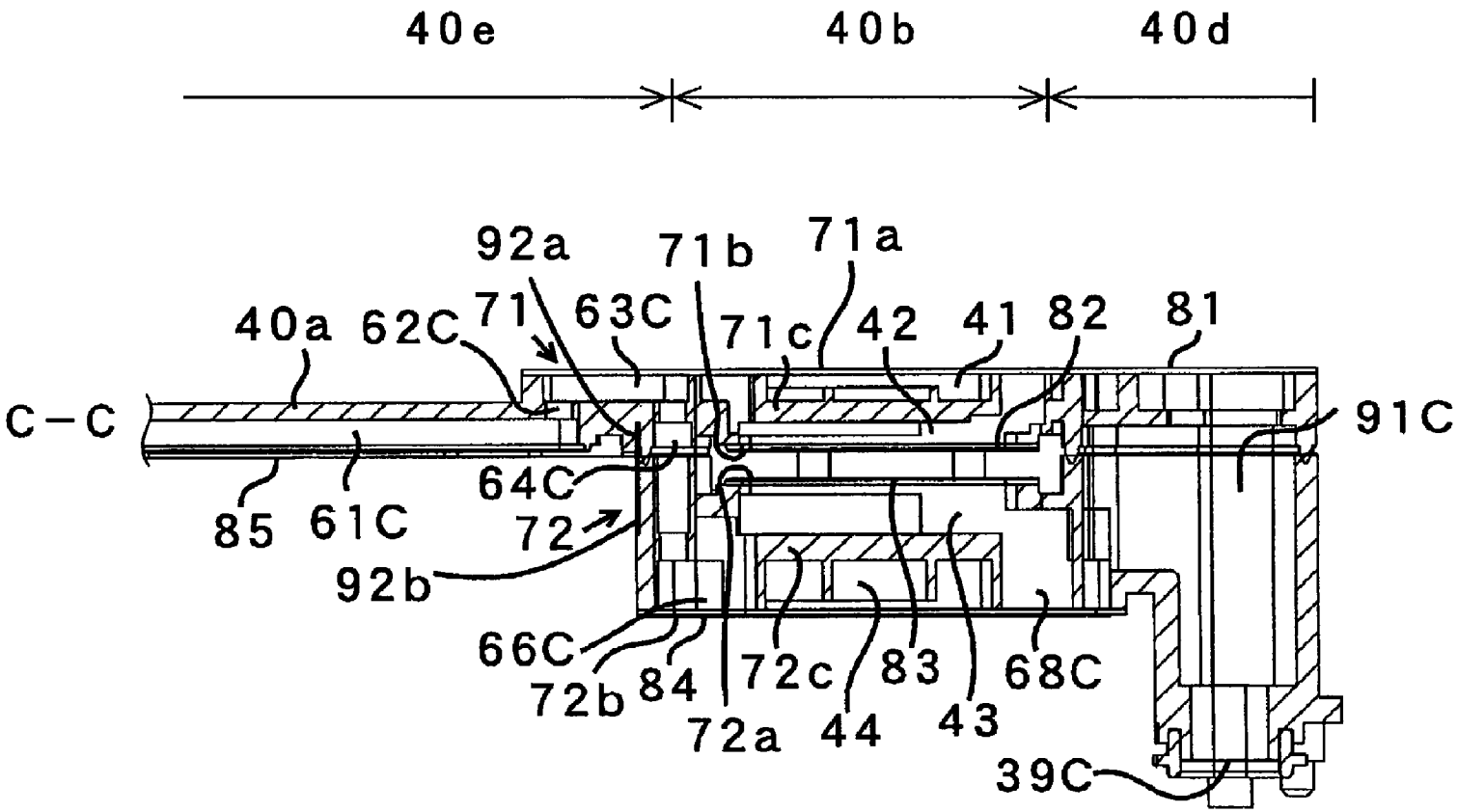
FIG. 13 is a cross-section view taken along Arrows C-C in FIG. 10.

The cyan ink flows through a path provided in the cross section, shown in FIG. 13, that is taken along C-C in FIG. 10. More specifically described, the cyan ink flows into the ink-introduce inlet 22C (FIG. 5), then flows through the ink-introduce passages 61C, 63C, further flows into the ink-introduce passage 64C formed through the respective partition walls 71*c*, 72*c* of the two ink cases 71, 72, so as to flow into the ink-introduce passage 66C provided on the lower side 72*b* of the lower ink case 72, and finally flows into the ink-deliver chamber 43, provided on the upper side 72*a* of the lower ink case 72, via the ink-flow inlet 43*b* (FIG. 8).

As shown in FIG. 8, the cyan ink, introduced into the ink-deliver chamber 43, flows from the inlet 43*b* to the outlet 43*c*. The cyan ink, delivered from the ink-deliver chamber 43, flows into the ink-deliver passage 91C, and then is supplied to the ink-jet recording head 30 via the ink-deliver outlet 39C, as shown in FIG. 13.

The black ink flows through a path provided in the cross section, shown in FIG. 14, that is taken along B-B in FIG. 10. More specifically described, the black ink flows into the ink-introduce inlet 22B (FIG. 5), then flows through the ink-introduce passages 61B, 63B, and flows into the ink-deliver chamber 44, provided on the lower side 72*b* of the lower ink case 72, via the ink-introduce passage 64B formed through the respective partition walls 71*c*, 72*c* of the two ink cases 71, 72.

As shown in FIG. 9, the black ink, introduced into the ink-deliver chamber 44, flows from the ink-flow inlet 44*b* to the ink-flow outlet 44*c*. The black ink, delivered from the ink-deliver chamber 44, flows into the ink-deliver passage 91B, and then is supplied to the ink-jet recording head 30 via the ink-deliver outlet 39B, as shown in FIG. 14.

Advantages of First Embodiment (1) As is apparent from the foregoing description of the ink-jet recording apparatus 1 as the first embodiment, each of the ink-deliver chambers 41, 42, 43, 44 is constructed such that a corresponding one of the ink-flow inlets 41*b*, 42*b*, 43*b*, 44*b* and a corresponding one of the ink-flow outlets 41*c*, 42*c*, 43*c*, 44*c* are provided at respective positions that are substantially the most distant from each other such that almost all portions of the inner space of the each ink-deliver chamber are located between the corresponding ink-flow inlet and the corresponding ink-flow outlet. Therefore, each of the inks flows through almost all portions of the inner space of the corresponding ink-deliver chamber 41 through 44. Thus, the inner space of each ink-deliver chamber 41 through 44 can be efficiently utilized to damp the changes of pressure of the corresponding ink supplied from the corresponding tube 14 and discharge the air bubbles contained in the each ink. In particular, since one surface of each ink-deliver chamber 41 through 44 is closed by the corresponding flexible film 81 through 84 having the large area, the changes of pressure of the corresponding ink can be effectively damped by the displacing of the flexible film.

In addition, since, in each ink-deliver chamber 41 through 44, the corresponding ink flows substantially linearly from the ink-flow inlet thereof toward the ink-flow outlet thereof, the ink can be quickly delivered from the corresponding ink tank 5 to the ink-jet recording head 30 while only a small amount of air bubbles grows in the ink. In particular, since the ribs 41*d*, 41*e*, 41*f*, 42*d*, 42*e*, 43*d*, 43*e*, 44*d*, 44*e* are provided on either side of the straight line connecting between the ink-flow inlet and the ink-flow outlet, the flowing of the ink is enhanced and the recording head 30 is prevented from failing to eject droplets of the ink because of the air bubbles contained in the ink.

Since the black-ink deliver chamber 44 is provided as an outermost one of the ink-deliver chambers 41 through 44 that extend parallel to each other, the deliver chamber 44 can easily have the larger volume than those of the other deliver chambers 41 through 43 so as to compensate for the large amount of consumption of the black ink.

(2) Each of the ink-deliver chambers 41 through 44 has the inner space flat along the plane containing the straight line connecting between the corresponding ink-flow inlet 41*b* through 44*b* and the corresponding ink-flow outlet 41*c* through 44*c*. The four ink-deliver chambers 41 through 44 extend parallel to the corresponding planes, and are arranged in a direction perpendicular to those planes. Therefore, the thickness of the buffer tank 40 in that direction can be decreased.

The yellow-ink deliver chamber 41 and the magenta-ink deliver chamber 41 are provided adjacent to each other via the partition wall 71*c* of the upper ink case 71; and the cyan-ink deliver chamber 43 and the black-ink deliver chamber 44 are provided adjacent to each other via the partition wall 72*c* of the lower ink case 72. The upper ink case 71 has the opposite openings that are opposite to each other with respect to the partition wall 71*c* and that are closed by the flexible films 81, 82, respectively; and the lower ink case 72 has the opposite openings that are opposite to each other with respect to the partition wall 72*c* and that are closed by the flexible films 83, 84, respectively.

In the first embodiment, the chamber-define wall that constitutes each ink case 71, 72 includes the partition wall 71*c*, 72*c* that separates the inner space of the each ink case into two ink-deliver chambers; and the two groups of side walls which are provided on the upper and lower sides of the partition wall, respectively, and each group of which includes the left-hand side wall, the right-hand side wall, the rear side wall, and the front side wall. This chamber-define wall has the upper and lower openings that are closed by the two films, respectively, so as to define the two ink-deliver chambers 41, 42, or 43, 44, respectively.

The chamber-define wall of the upper ink case 71 has the upper surface 71*a* in which the ink-introduce passages 63Y through 63B and the ink-introduce passages 64B, 64C are formed. The rear end portion of the ink-introduce passage 63M (to which the ink-flow inlet 42*b* is connected) and the ink-introduce passages 64B, 64C are formed through the partition wall 71*c* of the upper ink case 71. Moreover, the respective partition walls 71*c*, 72*c* of the two ink cases 71, 72 include the tubular walls 91*e*, 91*f* that define the ink-deliver passages 91Y through 91B, and the separation walls 91*g*, and the ink-deliver passages 91Y through 91B are formed through the respective partition walls 71*c*, 72*c* of the two ink cases 71, 72.

The respective ink-flow inlets 41*b*, 42*b* of the two ink-deliver chambers 41, 42 are provided at the respective different positions along the partition wall 71*c*, and the respective ink-flow outlets 41*c*, 42*c* of the two ink-deliver chambers 41, 42 are provided at the respective different positions along the partition wall 71*c*. Similarly, the respective ink-flow inlets 43*b*, 44*b* of the two ink-deliver chambers 43, 44 are provided at the respective different positions along the partition wall 72*c*, and the respective ink-flow outlets 43*c*, 44*c* of the two ink-deliver chambers 43, 44 are provided at the respective different positions along the partition wall 72*c*. That is, each pair of ink-deliver chambers are provided adjacent to each other via the corresponding partition wall 71*c*, 72*c*, and the respective ink-flow inlets of the two ink-deliver chambers are provided at the respective different positions along the partition wall 71*c*, 72*c*, and the respective ink-flow outlets of the two ink-deliver chambers are provided at the respective different positions along the partition wall 71*c*, 72*c*. Therefore, as compared with the case where four ink-deliver chambers are provided in four ink cases, respectively, the ink-deliver chambers 41 through 44 can be provided in a smaller space.

Moreover, in the first embodiment, the buffer tank 40 is constituted by the two ink cases 71, 72 that are stacked on each other such that the two cases 71, 72 extend parallel to each other and are opposed to each other. Therefore, the ink passages can be provided in the small space and the thickness of the buffer tank 40 in the direction in which the two ink cases 71, 72 are stacked on each other can be decreased.

The ink-deliver passages 91Y through 91B corresponding to the ink-deliver chambers 41 through 44, respectively, are arranged in one array along one side of the buffer tank 40, and open to face the ink-jet recording head 30. At least one of the respective ink-flow outlets of the two ink-deliver chambers respectively formed in the opposite surfaces of each ink case 71, 72 is formed through the thickness of the each ink case in the direction from one of the opposite surfaces to the other surface so as to communicate with the corresponding ink-deliver passage 91. Thus, the ink passages can be provided in the small space and an over-all size of the head holder 9 including the ink-jet recording head 30 and the buffer tank 40 can be reduced.

(3) One ink case 71 has the four ink-introduce passages 63Y, 63M, 63C, 63B that are connected, at respective one ends thereof, to the four tubes 14Y through 14B, and the two ink-introduce passages 63C, 63B are formed through the respective partition walls 71*c*, 72*c* of the two ink cases 71, 72 so as to be connected, at the respective other ends thereof, to the cyan-ink deliver chamber 43 and the black-ink deliver chamber 44. Thus, the ink-introduce passages 63Y through 63B can be easily connected, and the two ink cases 71, 72 can be stacked on each other in the small space.

In addition, since one ink case 71 has the four ink-introduce passages 63Y, 63M, 63C, 63B that are connected to the four tubes 14Y through 14B, respectively, an overall-size of the head holder 9 including the connection portion where the tubes 14 are connected to the ink case 71 can be reduced.

(4) The ink-flow inlet and outlet 42*b*, 42*c* of the magenta-ink deliver chamber 42, provided on the lower side 71*b* of the upper ink case 71 opposed to the upper side 72*a* of the lower ink case 72, are located inside the ink-introduce passages 64B, 64C formed through the respective partition walls 71*c*, 72*c* of the two ink cases 71, 72 and inside the ink-deliver passages 91Y through 91B. Thus, the ink-introduce passages 64B, 64C and the ink-deliver passages 91Y through 91B are not provided inside the contour of the magenta-ink deliver chamber 42 and accordingly the deliver chamber 42 can have a simple shape such as a quadrangle. Therefore, the flow passage can be easily formed which assures that the magenta ink quickly flows from the ink-flow inlet 42*b* to the ink-flow outlet 42*c*. This is also true with the cyan-ink deliver chamber 43.

In addition, the flexible film 82, 83 that closes the lower or upper opening of the ink-deliver chamber 42, 43 can have a simple shape such as a quadrangle. Therefore, when the pressure of the magenta or cyan ink changes, the film 82, 83 can be substantially largely displaced to damp the pressure changes. Moreover, the film 82, 83 can be easily obtained by cutting a large sheet of film material into pieces of films having prescribed dimensions. Thus, the films can be uselessly used, and can be bonded to the ink cases 71, 72 without needing accurate positioning of the films relative to the ink cases 71, 72.

The four ink-introduce passages 63Y through 63M are arranged in one array in one surface of one ink case 71. Therefore, the ink-flow passages can be provided in the small space. In addition, the two ink-flow passages 63Y, 63M located at the opposite ends of the array of ink-flow passages 63Y through 63M are respectively connected to the two ink-deliver chambers 41, 42 of the one ink case 71 having the ink-introduce passages 63Y through 63M, and the other, two ink-flow passages 63C, 63B located in the middle portion of the array of ink-flow passages 63Y through 63M are respectively connected to the two ink-deliver chambers 43, 44 of the other ink case 72. Therefore, the two ink-flow passages 63Y, 63M can be easily provided such that those passages 63Y, 63M do not interfere with the two ink-deliver chambers 42, 43 respectively provided in the respective surfaces of the two ink cases 71, 72 that are opposed to each other. Thus, the above-describe advantages can be easily obtained.

The black-ink deliver chamber 44 may be modified to have a simpler quadrangular cross-section shape. However, since the black-ink deliver chamber 44 has the quadrangular shape containing the ink-introduce passage 66C and the connection passage 68C, as shown in FIG. 9, the film 84 that closes not only the deliver chamber 44 but also those passages 66C, 68C can advantageously have a simple shape such as a quadrangle.

(5) The respective upper ends of the ink-deliver passages 91Y, 91M, 91C, 91B communicate with the atmosphere via the air-discharge valve device 45 that can be opened and closed. Therefore, the air bubbles that grow in the ink-deliver chambers 41 through 44 and the ink-deliver passages 91Y through 91B can be discharged into the outside space.

In the first embodiment, the direction parallel to the guide shafts 6, 7 that cooperate with each other to guide the head holder 9 is defined as the scanning direction; the direction that substantially perpendicularly intersects not only the scanning direction but also the upward and downward directions is defined as a first direction; the leftward and rightward directions parallel to the scanning direction are defined as a second direction; and the upward and downward directions are defined as a third direction.

In the first embodiment, a distance between the ink-flow inlet and outlet of each of the ink-deliver chambers 41 through 44 is not less than 90% of a dimension of the inner space of the each ink-deliver chamber in the first direction. With respect to the second direction, a distance between the ink-flow inlet and outlet of the yellow-ink deliver chamber 41 is not less than 30% of a dimension of the inner space of the chamber 41; a distance between the ink-flow inlet and outlet of each of the magenta-ink and cyan-ink deliver chambers 42, 43 is not less than 80% of a dimension of the inner space the each chamber 42, 43; and a distance between the ink-flow inlet and outlet of the black-ink deliver chamber 44 is not less than 40% of a dimension of the inner space of the chamber 44. Thus, in each of the ink-deliver chambers 41 through 44, a corresponding one of the ink-flow inlets and a corresponding one of the ink-flow outlets are provided at the respective positions that are substantially the most distant from each other such that almost all portions of the inner space of the each ink-deliver chamber are located between the corresponding ink-flow inlet and the corresponding ink-flow outlet.

The ink-flow inlet and outlet of each of the ink-deliver chambers 41 through 44 are provided at the respective positions that are as possible as near to the respective diagonal positions of the each ink-deliver chamber. That is, with respect to the first direction, the ink-flow inlet and outlet are distant from each other, and the straight line connecting between the ink-flow inlet and outlet is inclined relative to the first direction. An angle of inclination of the straight line connecting between the ink-flow inlet and outlet of the yellow-ink deliver chamber 41, relative to the first direction, is not less than 15 degrees; an angle of inclination of the straight line connecting between the ink-flow inlet and outlet of each of the magenta-ink and cyan-ink deliver chambers 42, 43, relative to the first direction, is not less than 40 degrees; and an angle of inclination of the straight line connecting between the ink-flow inlet and outlet of the black-ink deliver chamber 44, relative to the first direction, is not less than 30 degrees. In addition, the straight line connecting between the ink-flow inlet and outlet of one ink-deliver chamber and the straight line connecting between the ink-flow inlet and outlet of another ink-deliver chamber provided adjacent to the one ink-deliver chamber are inclined, relative to the first direction, in the opposite directions each away from the first direction. This is true with not only the first pair of adjacent ink-deliver chambers 41, 42 but also the second pair of adjacent ink-deliver chambers 43, 44.

In the first embodiment, each of the ink-deliver chambers 41 through 44 has a flat shape having, in the third direction perpendicular to the first and second directions, a smaller dimension than the respective dimensions thereof in the first and second directions. Only if the ink-flow inlet and outlet of the each ink-deliver chamber are provided at respective positions distant from each other in each of the first and second directions, a large portion of the inner space of the each ink-deliver chamber can be provided between the ink-flow inlet and outlet. Thus, the inner volume of the each ink-deliver chamber can be efficiently utilized.

The first embodiment may be modified such that the upward and downward directions are defined as the second direction and the direction parallel to the scanning direction is defined as the third direction.

Additional Embodiment 1

Figure 15:
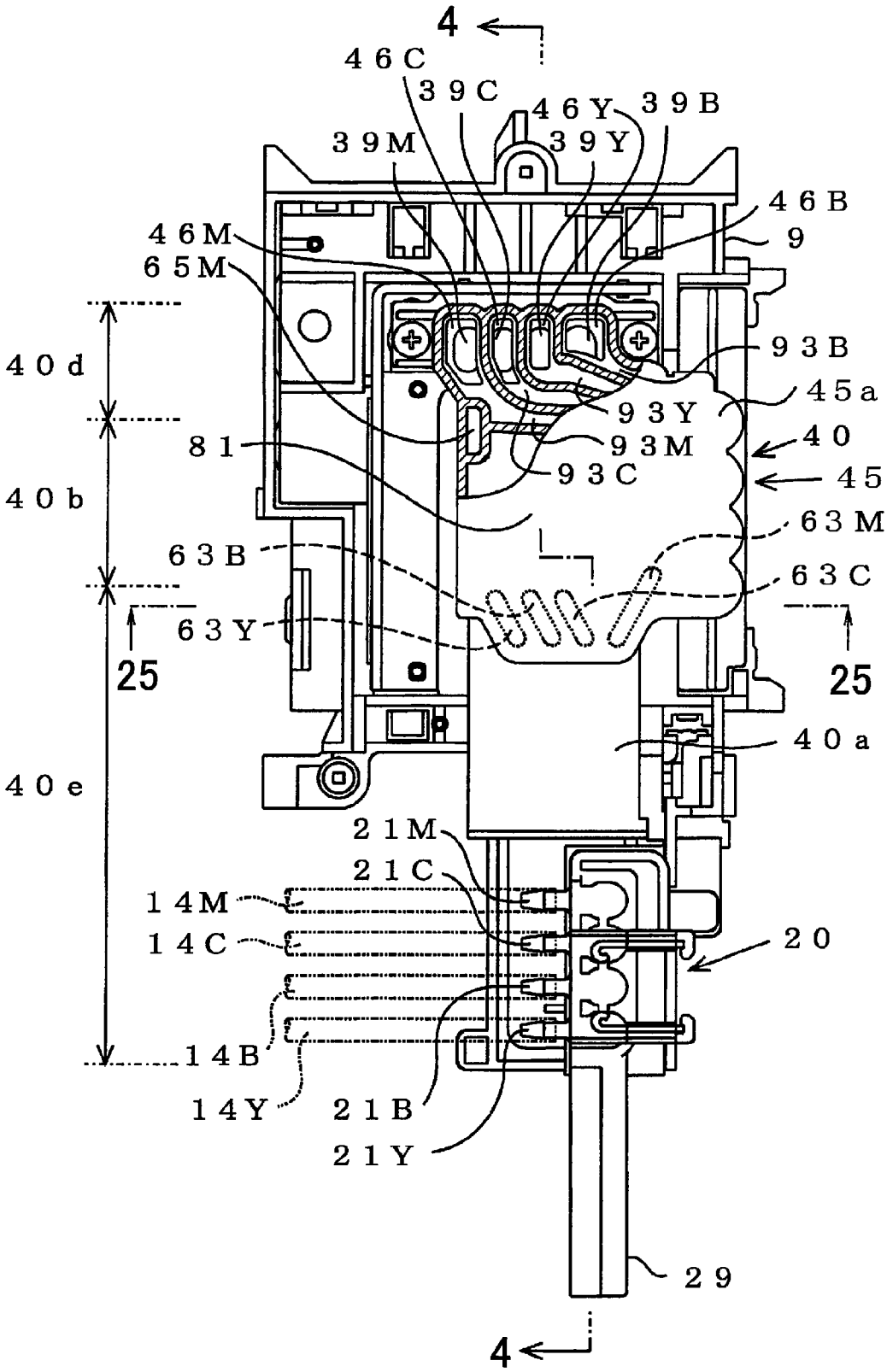
FIG. 15 is a plan view of a head holder 9 of another ink-jet recording apparatus as a second embodiment of the present invention.
Figure 16:
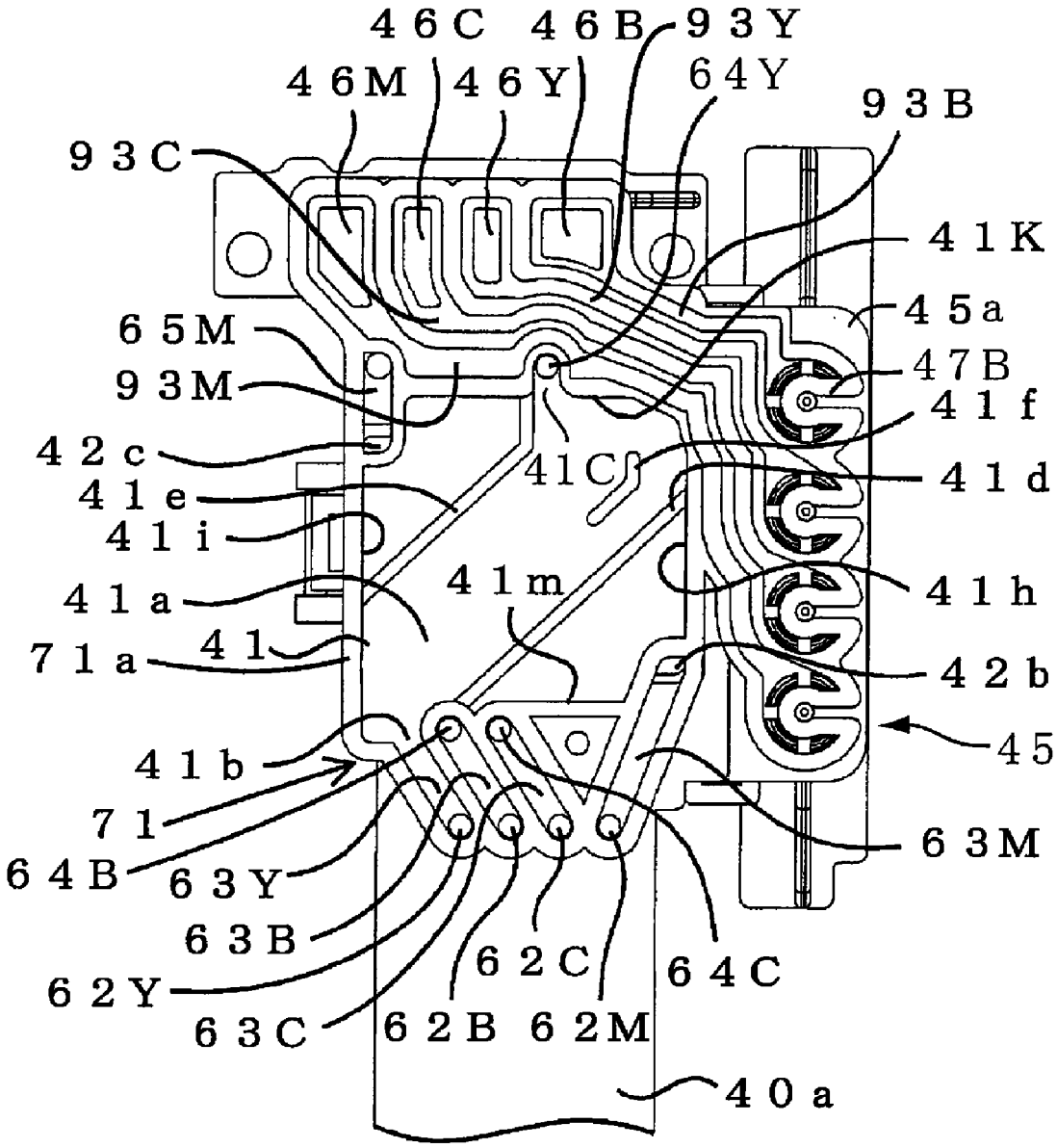
FIG. 16 is a top plan view of an upper ink case 71 employed in the second embodiment.

Regarding the first embodiment, a manner in which the air collected in the respective upper portions of the four ink-deliver passages 91M through 91B is discharged has not been described in detail because that manner has no particular limitations and accordingly any known technique may be employed. The following, second embodiment is an example of most preferred techniques with respect to the manner in which the air is discharged. Since the second embodiment relates to an ink-jet recording apparatus having a construction identical with that of the ink-jet recording apparatus as the first embodiment, except for a portion relating to the function of discharging air, the same reference numerals as used in the first embodiment are used to designate the corresponding elements of the second embodiment and the description thereof is omitted. The ink-jet recording apparatus as the second embodiment are shown in FIGS. 15 through 24 corresponding to FIGS. 2 and 6 through 14, respectively. Although FIGS. 15 through 24 show the same constituent elements as employed in the first embodiment, additional reference numerals such as 46 are used to describe, in detail, the portion relating to the function of discharging air. In addition, a cross-section view taken along Arrows 4-4 in FIG. 15 is the same as the cross-section view shown in FIG. 4.

Like the buffer tank 40 employed in the first embodiment, a buffer tank 40 employed in the second embodiment has four flat ink-deliver chambers 41 through 44 having respective horizontally extending postures. More specifically described, the four ink-deliver chambers 41 through 44 are arranged in upward and downward directions such that the four chambers extend parallel to each other. The two ink-deliver chambers 41, 42 are formed in an upper ink case 71; and the other, two ink-deliver chambers 43, 44 are formed in a lower ink case 72 (FIGS. 21 through 24). The four ink-deliver chambers 41 through 44 communicate with four ink-deliver passages 91Y through 91B, respectively.

The four ink-deliver passages 91Y through 91B extend in the upward and downward directions such that the four passages have respective substantially same lengths (FIGS. 21 through 24). The four ink-deliver chambers 41 through 44 communicate with respective side surfaces of the four ink-deliver passages 91Y through 91B, so that the four chambers deliver respective inks to the four passages. Therefore, respective upper portions of the four ink-deliver passages 91Y through 91B function as air-collect spaces that collect respective air that are first contained by, and then separated from, the respective inks.

Since the four ink-deliver passages 91Y through 91B extend in the upward and downward directions over the respective substantially same lengths, the four passages 91Y through 91B can effectively separate the respective air from the respective inks to be supplied to respective ink-supply inlets (only the inlet 32*a* is shown in FIG. 4) of an ink-jet recording head 30, so that the respective air is temporarily collected in the respective upper portions of the four passages 91Y through 91B. The thus collected air can be discharged into an outside space through respective air-discharge outlets 46M, 46C, 46Y, 46B that can be opened and closed by an air-discharge valve device 45, described later.

The four ink-deliver passages 91Y through 91B extend in the upper and lower ink cases 71, 72, parallel to each other, in the upward and downward directions. Respective lower open ends of the four passages 91Y through 91B define respective ink-deliver outlets 39Y through 39B that communicate with the respective ink-supply inlets (only the inlet 32*a* is shown in FIG. 4) of the ink-jet recording head 30, via respective ink-flow openings (only the opening 33*a* is shown in FIG. 4) of a reinforcing frame 33. Meanwhile, respective upper open ends of the four passages 91Y through 91B provide the respective air-discharge outlets 46Y through 46B that are provided along a single plane. Thus, the four ink-deliver passages 91Y through 91B communicate with the outer space via the respective air-discharge outlets 46Y through 46B that can be opened and closed by the air-discharge valve device 45, described later.

Thus, respective upper portions of the four ink-deliver passages 91Y through 91B are formed in the upper ink case 71 so as to communicate with the respective air-discharge outlets 46Y through 46B; and respective lower portions of the four passages 91Y through 91B are formed in the lower ink case 72 so as to communicate with the respective ink-deliver outlets 39Y through 39B.

Figure 17:
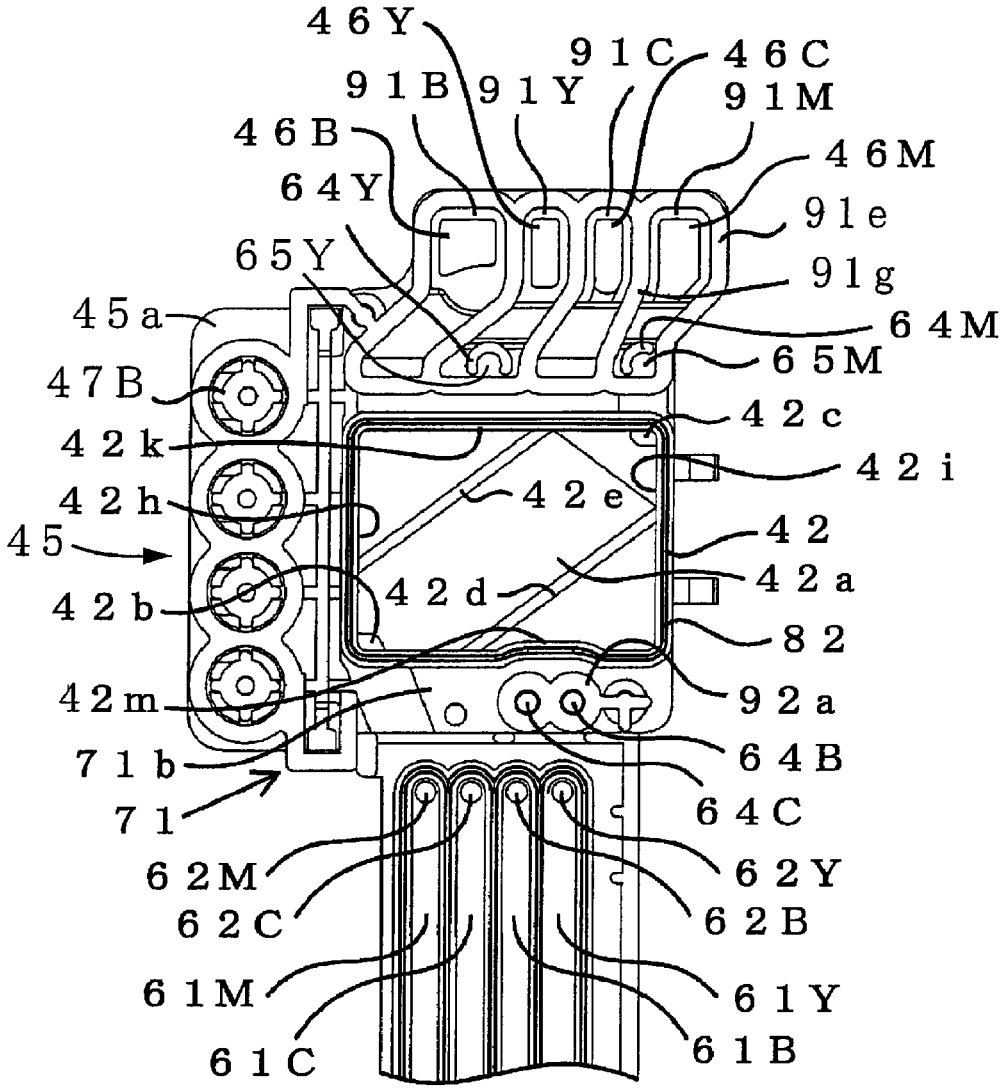
FIG. 17 is a bottom plan view of the upper ink case 71 shown in FIG. 16.
Figure 18:
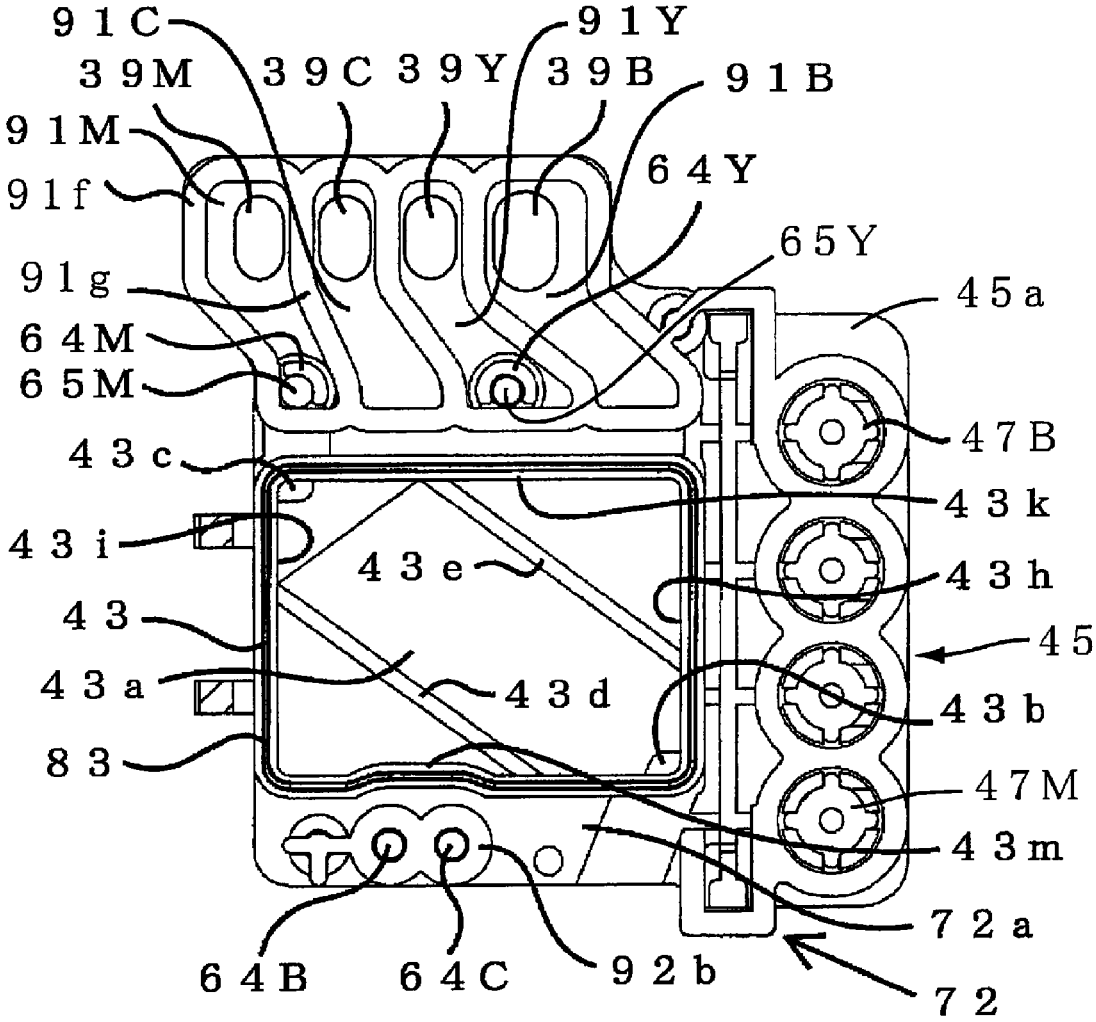
FIG. 18 is a top plan view of a lower ink case 72 employed in the second embodiment.
Figure 19:
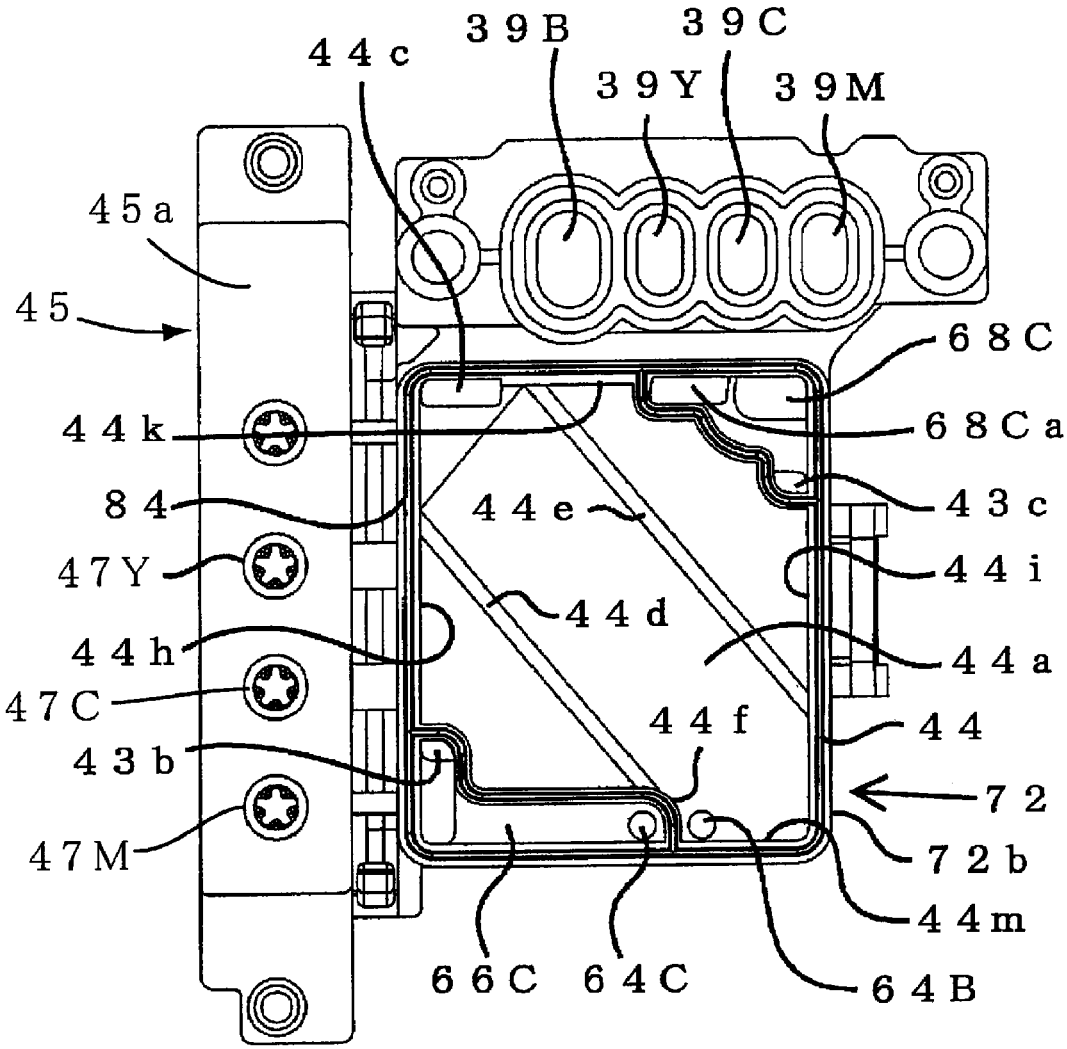
FIG. 19 is a bottom plan view of the lower ink case 72 shown in FIG. 18.
Figure 20:
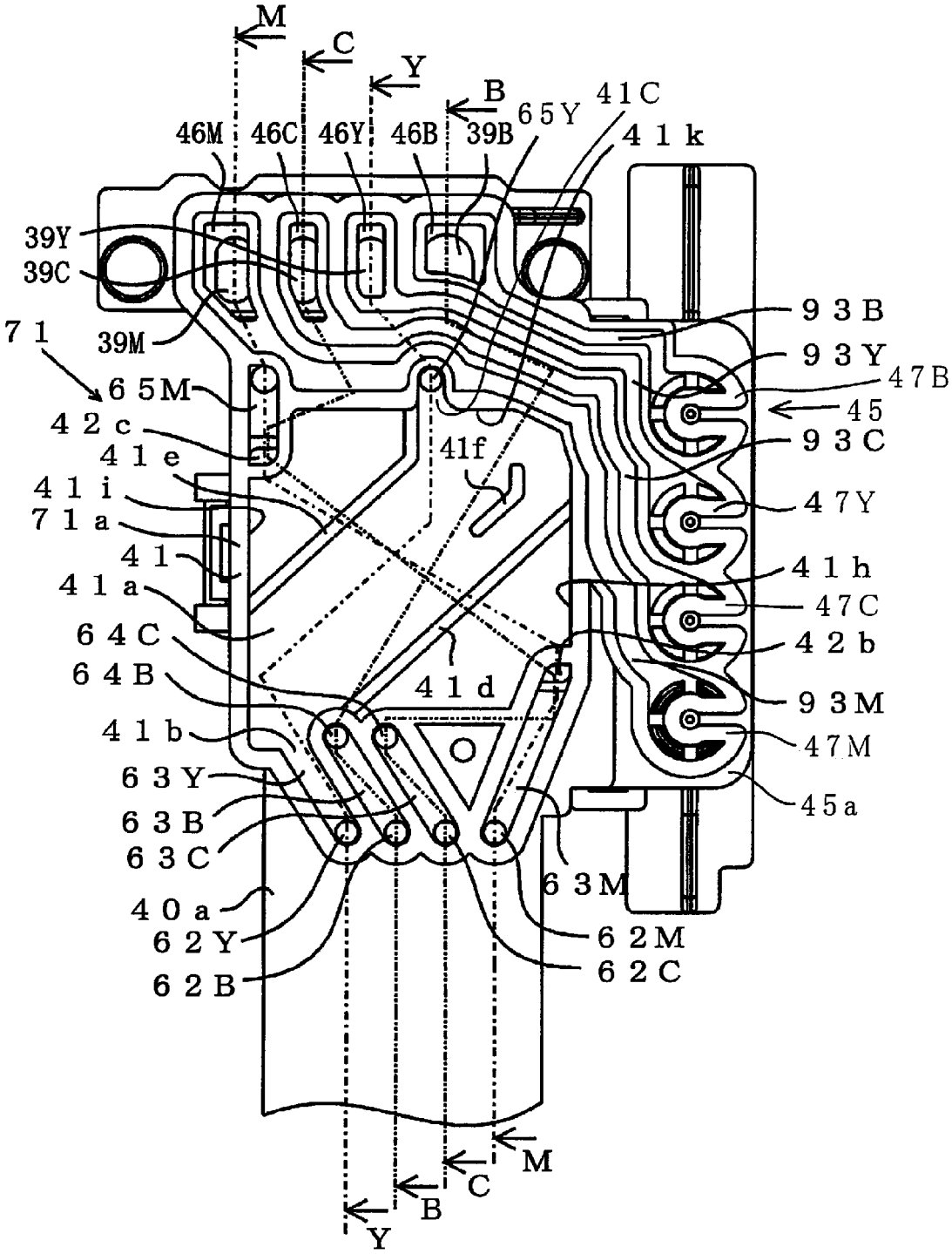
FIG. 20 is an enlarged top plan view of the upper ink case 71 employed in the second embodiment.
Figure 21:
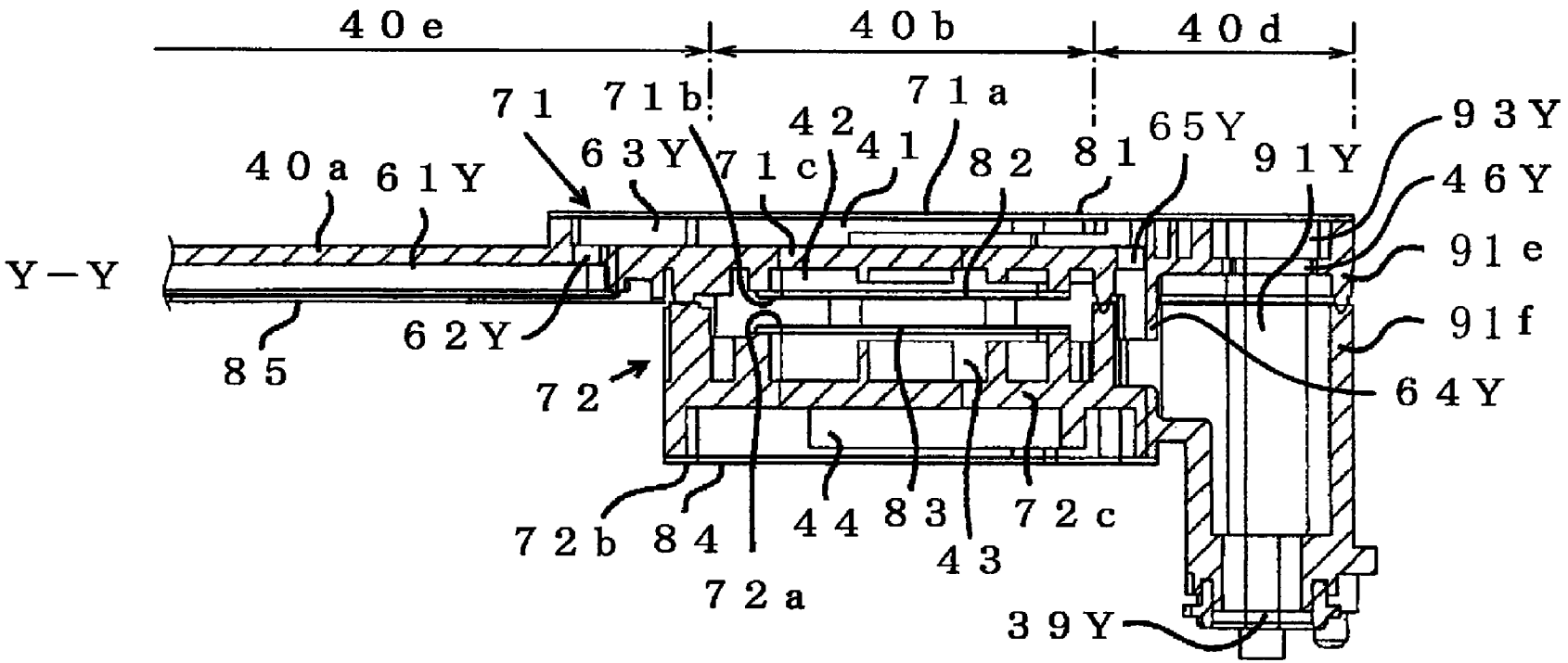
FIG. 21 is a cross-section view taken along Arrows Y-Y in FIG. 20.
Figure 22:
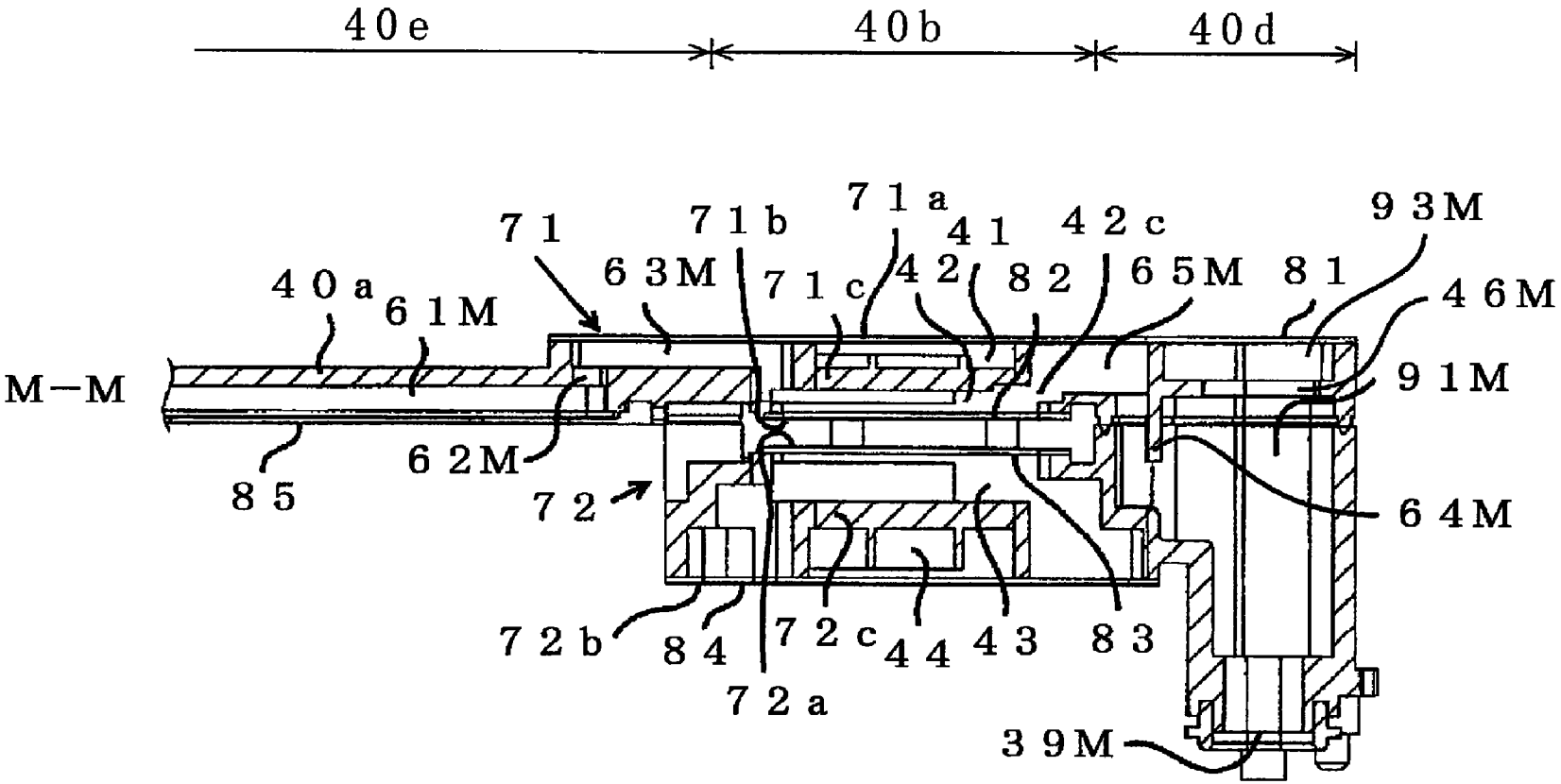
FIG. 22 is a cross-section view taken along Arrows M-M in FIG. 20.
Figure 23:
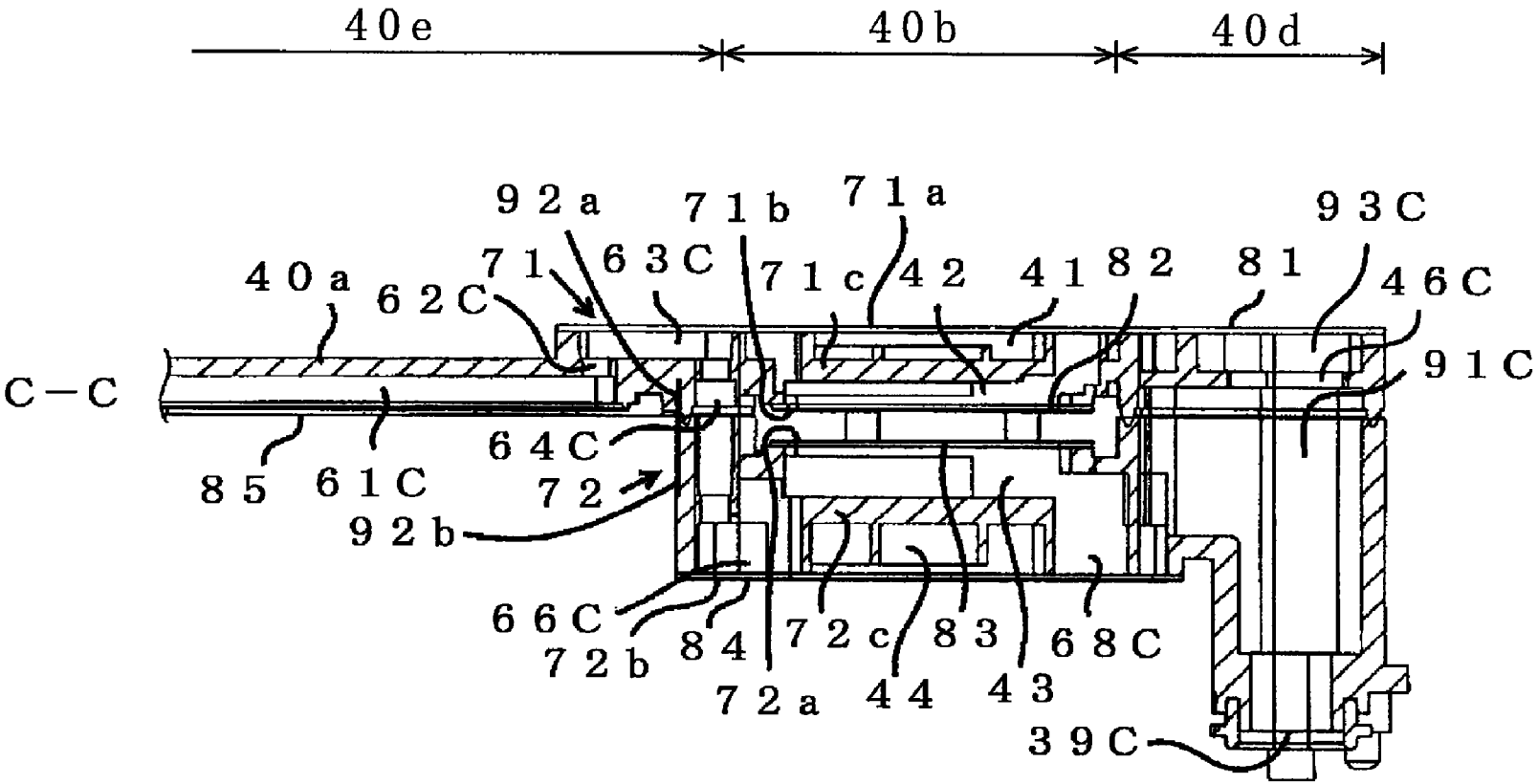
FIG. 23 is a cross-section view taken along Arrows C-C in FIG. 20.
Figure 24:
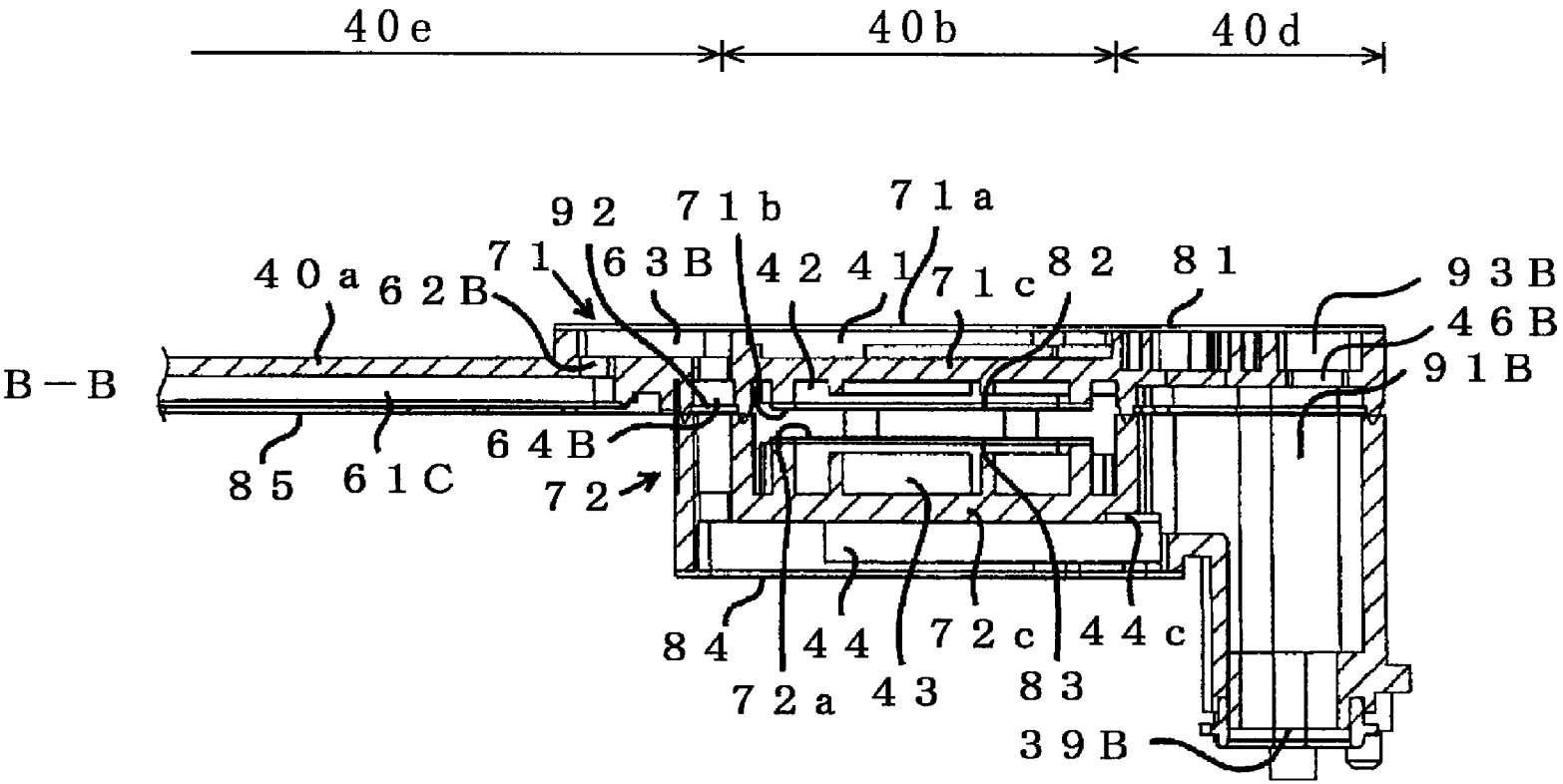
FIG. 24 is a cross-section view taken along Arrows B-B in FIG. 20.

More specifically described, the respective upper portions of the four ink-deliver passages 91Y through 91B corresponding to the four inks, respectively, are formed in the upper ink case 71, by dividing, with respective upper portions of three separation walls 91*g*, an inner space of a tubular wall 91*e* of the upper case 71; and the respective lower portions of the four passages 91Y through 91B are formed in the lower ink case 72, by dividing, with respective lower portions of the three separation walls 91*g*, an inner space of a tubular wall 91*f* of the lower case 72 (FIGS. 17 and 18). In a state in which the tubular wall 91*e* and the separation walls 91*g* of the upper ink case 71 are aligned with the tubular wall 91*f* and the separation walls 91*g* of the lower ink case 72, respectively, the respective upper portions of the four ink-deliver passages 91Y through 91B are joined to the respective lower portions of the same 91Y through 91B, by a bonding means such as supersonic welding or adhesion. Thus, the buffer tank 40 having the four ink-deliver chambers 41 through 44 arranged in the upward and downward directions is obtained.

Since the four ink-deliver chambers 41 through 44 are arranged in the upward and downward directions and extend parallel to each other, the four chambers 41 through 44 can enjoy respective substantially uniform characteristics with respect to the function of supplying inks to the ink-jet recording head 30. In addition, the four chambers 41 through 44 can have respective sufficiently large volumes without having to increase a height of the buffer tank 40 or the printer as a whole. Therefore, the present ink-jet recording apparatus can effectively damp the changes of pressure of the inks and thereby record images with high quality.

(Air-Discharge Passages)

As shown in FIGS. 20 through 25, the respective upper ends of the four ink-deliver passages 91Y through 91B, located above the four ink-deliver outlets 39Y through 39B, provide the four air-discharge outlets 46Y through 46B formed in the upper ink case 71. The four air-discharge outlets 46Y through 46B communicate with four air-discharge passages 93Y, 93M, 93C, 93B, respectively, that are formed as respective grooves in an upper surface 71*a* of the upper ink case 71, and the four air-discharge passages 93Y through 93B communicate with respective upper open ends of four air-discharge holes of the air-discharge valve device 45 that are provided along one side of a buffer portion 40*b* of a buffer tank 40 and correspond to the four inks, respectively. The air-discharge valve device 45 extends substantially parallel to the four air-discharge passages 93Y through 93B. Thus, the four air-discharge outlets 46Y through 46B as the respective upper open ends of the four ink-deliver passages 91Y through 91B communicate with the air-discharge valve device 45 via the four air-discharge passages 93Y through 93B, respectively. Respective upper openings of the four air-discharge passages 93M through 93B are closed by a flexible film 81.

In the upper surface 71*a* of the upper ink case 71, the four air-discharge passages 93Y through 93B are formed along an outer periphery of the yellow-ink deliver chamber 41, such that first the four passages 93Y through 93B are curved in the rightward direction from the respective upper open ends of the four ink-deliver passages 91Y through 91B and then are extended in the frontward direction to communicate with the air-discharge valve device 45, more specifically described, four air-discharge valves 47Y, 47M, 47C, 47B of the valve device 45, respectively.

Normally, the four air-discharge valves 47Y through 47B are in their closed states. Therefore, when the inks supplied from the ink tubes 14Y through 14B flow through the ink-deliver chambers 41 through 44 and the ink-deliver passages 91Y through 91B, the air contained by the inks naturally separates from the inks and additionally the air captured by respective filters (not shown) provided in the four ink-deliver outlets 39Y through 39B naturally move upward, so that the air is collected in the respective upper portions of the ink-deliver passages 91Y through 91B. The thus collected air can be discharged into the outer space via the air-discharge passages 93Y through 93B, when the air-discharge valve device 45 is operated and controlled in an appropriate manner to open one or more of the four air-discharge valves 47Y through 47B.

(Air-Discharge Valve Device)

The air-discharge valve device 45 (FIG. 20) includes an air-discharge valve box 45*a*, and the four air-discharge valves 47M through 47B that can open and close the corresponding air-discharge passages 93M through 93B are accommodated by the box 45*a*. Since the four air-discharge valves 47M through 47B have an identical construction, only the air-discharge valve 47M corresponding to the magenta ink is described below by reference to FIG. 25.

Figure 25:
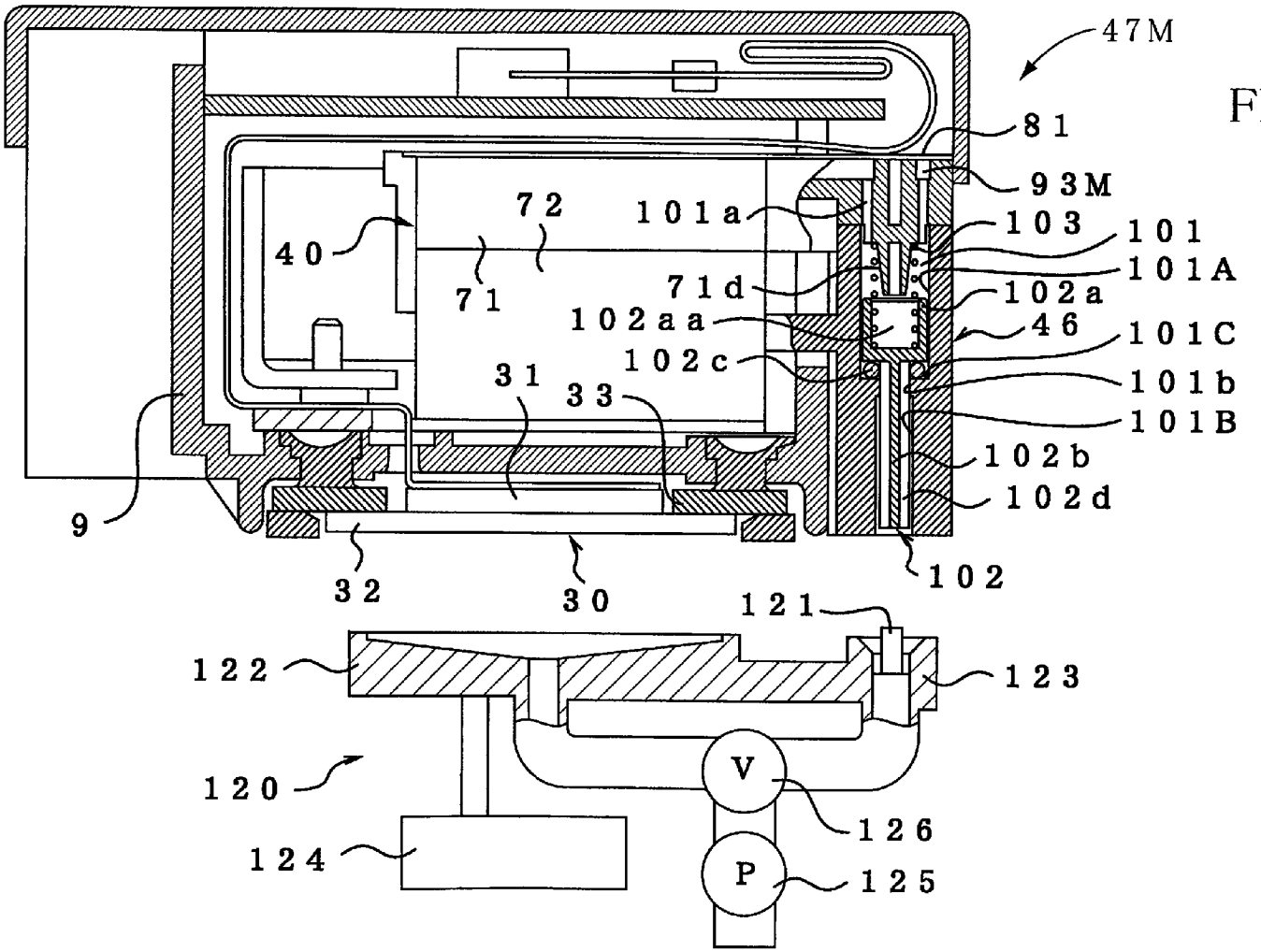
FIG. 25 is a cross-section view taken along Arrows 25-25 in FIG. 15.

As shown in FIG. 25, the air-discharge valve 47M has an air-discharge hole 101 communicating with the corresponding air-discharge passage 93M. The air-discharge hole 101 is elongate in the upward and downward directions and has upper and lower open ends. Thus, the air-discharge hole 101 functions as a valve chamber that has an upper port 101*a* and an intermediate port 101*b* and in which a valve member 102 is movable. The air-discharge valve device 45 has the four air-discharge holes 101 corresponding to the four inks, respectively. Each of the four air-discharge holes 101 includes an upper, large-diameter portion 101A and a lower, small-diameter portion 101B that communicate with each other via the intermediate port 101*b*.

An upper portion of the air-discharge valve box 45*a* that includes the upper port 101*a* and an engageable projection 71*d*, described later, is formed integrally with the upper ink case 71; and a lower portion of the box 45*a* that includes the large-diameter and small-diameter portions 101A, 101B is formed integrally with the lower ink case 72. When the upper and lower cases 71, 72 are joined to each other as described above, the upper and lower portions of the air-discharge valve box 45*a* are simultaneously joined to each other.

The valve member 102 includes a large-diameter valve portion 102*a*; a small-diameter valve rod 102*b* integrally connected to a lower end of the valve portion 102*a*; and an annular seal member 102*c* fitting on the rod 102*b*. The diameter of the valve portion 102*a* is larger than that of the valve rod 102*b*, and the seal member 102*c* is supported by the valve rod 102*b* such that the seal member 102*c* is held in contact with the valve portion 102*a*. The valve portion 102*a* is opposed, via the seal member 102*c*, to an annular surface 101C (i.e., a valve seat) that functions as a bottom surface of the large-diameter portion 101A and defines the intermediate port 101*b* as an upper open end of the small-diameter portion 101B. The large-diameter valve portion 102*a* and the small-diameter valve rod 102*b* of the valve member 102 are inserted into the large-diameter portion 101A and the small-diameter portion 101B of the air-discharge hole 101, respectively, such that respective annular gaps through which air (or gas) can flow are left between the valve portion 102*a* and an inner wall surface defining the large-diameter portion 101A and between the valve rod 102*b* and an inner wall surface defining the small-diameter portion 101B. Thus, the valve member 102 is provided in the air-discharge hole 101 such that the valve member 102 is slideable in an axial direction of the hole 101 that is parallel to a centerline of the same 101. The air-discharge valve 47M is opened by pushing the small-diameter valve rod 102*b* upward by a corresponding one of four projecting bars 121 of a maintenance unit 120. To this end, a lower end of the valve rod 102*b* is located in the vicinity of a lower open end of the small-diameter portion 101B, in the state in which the valve 47M is closed. The seal member 102*c* is preferably provided by, e.g., a packing member formed of an elastic material such as rubber. In the present embodiment, an O-right is used as the seal member 102*c*.

The annular surface 101C that defines the intermediate port 101*b* communicating with the atmosphere, functions as the valve seat, and the seal member 102*c* is provided between the annular surface 101C and the valve portion 102*a*. Therefore, the intermediate port 101*b* can be opened and closed by the valve portion 102*a* via the seal member 102*c* fitting on the valve rod 102*b*.

A coil spring 103 as a biasing member to bias the valve member 102 (i.e., the valve portion 102*a*) in a direction to close the intermediate port 102*b*, is provided in the large-diameter portion 101A. More specifically described, an upper end portion of the coil spring 103 fits on an outer surface of the engageable projection 71*d* of the upper ink case 71; and a lower end portion of the coil spring 103 fits in a recess 102*aa* formed in an upper portion of the valve portion 102*a*. The upper port 101*a* consists of a plurality of separate holes provided around the engageable projection 71*d*. Thus, the upper end of the coil spring 103 is not contacted with an inner wall surface defining the upper port 101*a*. Therefore, an air-flow passage through which the air (or gas) flows is formed around the coil spring 103.

The intermediate port 101*b* is opened to discharge the air, if the valve rod 102*b* is moved upward to compress the coil spring 103. Therefore, the air flowing from the upper port 101*a* is blocked by the compressed coil spring 103, and a quick flow of the air is produced between the compressed coil spring 103 and the inner wall surface defining the large-diameter portion 101A. That is, the gap between an outer surface of the compressed coil spring 103 and the inner wall surface defining the large-diameter portion 101A provides an air-flow passage having a low flow resistance. This air-flow passage cooperates with an outer surface of the valve portion 102*a* to define a block-free air-discharge passage that connects between the upper port 101*a* and the intermediate port 101*b* and that is free of blocks that may increase its flow resistance.

Thus, the coil spring 103 normally biases the valve portion 102*a* in the direction to cause the seal member 102*c* to contact the annular surface 101C. Therefore, at a normal time when the valve member 102 does not receive the pushing force of the projecting bar 121, the air-discharge valve 47M is in its closed state in which the intermediate port 102 is closed by the seal member 102*c*.

The valve rod 102*b* of the valve member 102 has a plurality of axial grooves 102*d* that extend over an entire length of the rod 102*b*. In a state in which the seal member 102 is accidentally separated from the valve portion 102*a*, the axial grooves 102*d* of the valve rod 102*b* function as gaps (i.e., air-discharge passages) assuring that the air can flow between the seal member 102*c* and the valve rod 102*b*. Therefore, even if such a phenomenon may occur that ink adheres to not only the annular surface 101C but also the seal member 102*c* that is held, in its closed state, in contact with the same 101C and accordingly only the valve rod 102*b* is pushed up while the seal member 102*c* remains adhered, with the ink functioning as adhesive, to the annular surface 101C, the air can flow through the axial grooves 102*d*. Thus, the air can be prevented from remaining in the ink-deliver passages 91M through 91B, or moving downward to the ink-jet recording head 30, and accordingly images can be recorded with high quality.

The maintenance unit 120 performs a cleaning operation to clean the nozzle-open surface of the ink-jet recording head 30; a recovering operation to apply suction to each of the inks; and a removing operation to remove the air accumulated in the buffer tank 40. To this end, the maintenance unit 120 includes a first cap member 122 that can cover and open the nozzle-open surface of the recording head 30 in which the nozzle arrays 35 through 38 open; and a plurality of second cap members 123 that can cover and open respective portions of a lower surface of the air-discharge valve device 45 (i.e., respective lower surfaces of the air-discharge valves 47M through 47B in which the respective lower ends of the small-diameter portions 101B open). The first and second cap members 122, 123 are supported by a vertically moving device 124, known in the art, such that the cap members 122, 123 are vertically movable. When the ink-jet recording head 30 is moved to, and stopped at, a waiting position where the recording head 30 does not perform any recording operations, the cap members 122, 123 are moved to their upper positions where the cap members 122, 123 closely contact the nozzle-open surface of the recording head 30 and the lower surface of the air-discharge valve device 45; and when the recording head 30 is moved to other positions, the cap members 122, 123 are moved to their lower positions away from those surfaces. The first cap member 122 is connected to a suction pump 125, known in the art, and, when the pump 125 is driven, the first cap member 122 removes, by suction, the inks with increased viscosities, and foreign matters, from the nozzle arrays 35 through 38.

Each of the four second cap members 123 includes the projecting bar 121; and when the each cap member 123 contacts the lower surface of the air-discharge valve device 45, the projecting bar 121 pushes up the valve member 102 against the biasing force of the coil spring 103 so as to move the seal member 102*c* away from the annular surface 101C level with the lower open end of the large-diameter portion 101A and thereby place the corresponding air-discharge valve 47 in its open state in which the intermediate port 101*b* is opened.

The four second cap members 123 are connected via a common flow passage to the suction pump 125 and, when the pump 125 is driven, respective amounts of air collected in the respective upper portions of the ink-deliver passages 91M through 91B are simultaneously sucked and discharged into the atmosphere. That is, the inks supplied from the ink tanks 5M through 5B to the ink-jet recording head 30 via the ink tubes 14M through 14B are temporarily held in the ink-deliver passages 91M through 91B, provided midway in the ink-flow passages, so that air is separated from each ink and is collected in the upper portion of the corresponding ink-deliver passage 91. This air is discharged by the operation of the suction pump 125.

The first cap member 122 and the group of second cap members 123 are selectively connected, by a switching valve 126, to the suction pump 125. The first cap member 122 and the group of second cap members 123 are simultaneously contacted, by the vertically moving device 124, with the nozzle-open surface of the recording head 30 and the lower surface of the air-discharge valve device 45. Subsequently, first, the second cap members 123, for example, are used to discharge the air collected in the upper portions of the ink-deliver passages 91M through 91B, and then the first cap member 122 is used to suck the deteriorated inks from the nozzle arrays 35 through 38. If air is discharged from the ink-deliver passages 91M through 91B, using the first cap member 122 only, then too large amounts of inks would be uselessly consumed. In contrast thereto, the present embodiment can enjoy such advantages that the air can be reliably discharged, and the recording head 30 can be efficiently restored, without having to uselessly consume much inks.

However, an operation to remove deteriorated inks from the nozzle arrays 35 through 38 and an operation to discharge air from the ink-deliver passages 91M through 91B may be carried out independent of each other. In addition, the suction of the suction pump 125 may be replaced with the application of positive pressure to the inks present in the ink tanks 5 so as to remove inks with increased viscosities, and foreign matters, from the nozzle arrays 35 through 38 and discharge air from the ink-deliver passages 91M through 91B. Alternatively, the suction of the suction pump 125 and the application of positive pressure to the inks may be simultaneously used.

(Operation of Air Discharging Device)

In the ink-jet recording apparatus constructed as described above, at a normal time when a recording operation is carried out by the ink-jet recording head 30, each of the four valve members 102 is normally pressed downward by the corresponding coil spring 103, so that the corresponding seal member 102*c* is held in contact with the corresponding valve portion 102*a* and the corresponding valve seat (i.e., the corresponding seal member 102*c* is sandwiched by the corresponding valve portion 102*a*, and the corresponding annular surface 101C defining the corresponding intermediate port 101*b*) and accordingly the corresponding air-discharge valve 47M is placed in its closed state.

Meanwhile, when the ink-jet recording head 30 is moved to, and stopped at, the waiting position, each of the valve rods 102*b* is pushed up by the projecting bar 121 of the corresponding second cap member 123, while the corresponding coil spring 103 is compressed. The corresponding seal member 102*c* is moved upward together with the corresponding valve portion 102*a*, or remains stuck to the corresponding annular surface 101C (i.e., the valve seat). In either case, the air can flow through the corresponding air-discharge hole 101 or the axial grooves 102*d* of the each valve rod 102. That is, the intermediate port 101*b* is opened, and the corresponding air-discharge valve 47 is placed in its open state. Thus, the air collected in the respective upper portions of the ink-deliver passages 91M through 91B can be discharged into the atmosphere via the respective intermediate ports 101*b*, the respective small-diameter portions 101B, and the suction pump 125.

The upper port 101*a* of each air-discharge valve 47 consists of the plurality of separate holes that are provided around the corresponding coil spring 103 and through each of which the air can flow into the air-discharge hole 101 as the valve chamber. Therefore, although, in the state in which each air-discharge valve 47 is in its open state, the corresponding coil spring 103 is compressed, the air can smoothly flow into the valve chamber. Thus, the compression of the coil spring 103 does not result in increasing the air-flow resistance of the air-discharge hole 101, i.e., purging different amounts of air in different air-purging operations.

Advantages of Present Embodiment (1) In the present embodiment, the plurality of ink-deliver passages 91 extend in the upward and downward directions over the substantially same lengths. Therefore, in each of the ink-deliver passages 91, air can be reliably separated from the corresponding ink before the ink flows into the corresponding ink-supply inlet of the ink-jet recording head 30, and the separated air can be collected in the upper portion of the each passage 91. Thus, the collected air can be discharged into the outer space via the corresponding air-discharge outlet 46 that can be opened and closed by the corresponding air-discharge valve 47.

(2) Since the air-discharge outlets 46 and the air-discharge passages 93 are formed in the ink cases 71, 72, the advantages described in the above paragraph (1) can be easily obtained.

(3) Since each of the two ink cases 71, 72 has the two ink-deliver chambers 41, 42, or 43, 44, and the upper portions (91*e*, 91*g*), or the lower portions (91*f*, 91*g*), of the ink-deliver passages 91, the four ink-deliver chambers 41, 42, 43, 44 arranged in the upward and downward directions, and the ink-deliver passages 91 connected to those chambers 41 through 44 can be easily formed by joining the two ink cases 71, 72 to each other.

(4) Since respective one surfaces of the four ink-deliver chambers 41 through 44 that extend parallel to each other are defined by the respective flexible diaphragms (i.e., the flexible films 81 through 84), those diaphragms can enjoy respective large areas without having to increase the overall height of the four chambers 41 through 44 in the upward and downward directions. This arrangement is advantageous for the ink-jet recording apparatus to damp effectively the changes of pressure of the inks and thereby record images with high quality.

(5) The ink-deliver passages 91 and the air-discharge valve device 45 extend substantially parallel to each other, and the air-discharge outlets 46 as the respective upper ends of the passages 91 communicate with the air-discharge valve device 45 via the respective air-discharge passages 93 formed in the upper surface 71*a* of the upper ink case 71. Thus, the advantages described in the above paragraphs (1) through (4) can be easily obtained.

(6) In the present embodiment, the buffer tank 40 that is moved with the ink-jet recording head 30, relative to the recording medium, has the four ink-deliver chambers 41 through 44. Therefore, the changes of pressure of the inks to be ejected from the recording head 30 can be effectively restrained and accordingly images can be recorded with high quality.

Additional Embodiment 2

In each of the above-described two embodiments, the inks flow from the ink-deliver chambers 41 through 44 to the respective lower portions of the ink-deliver passages 91 via respective plane surfaces (FIGS. 11 through 14, or FIGS. 21 through 24). In contrast, in the present, third embodiment, respective inks flow from respective ink-deliver chambers 41 through 44 to respective lower portions of respective ink-deliver passages 91 via respective inclined surfaces (i.e., inclined surfaces 48Ya, 48Ma, 48Ca, 48Ba shown in FIGS. 26 through 29).

The present embodiment relates to an ink-jet recording apparatus whose construction is similar to that of the ink-jet recording apparatus to which each of the above-described two embodiments relates. Thus, the same reference numerals as used in the above-described two embodiments are used to designate the corresponding elements of the third embodiment and the description thereof is omitted. The following description relates to only differences between the above-described two embodiments and the third embodiment. FIGS. 26 through 29 correspond to FIGS. 11 through 14, respectively.

Like the ink-jet recording apparatus to which each of the above-described two embodiments relates, an ink-output portion 40*d* of a buffer tank 40 of the present ink-jet recording apparatus has, in rear of a buffer portion 40*b*, the same number of ink-deliver passages 91Y, 91M, 91C, 91B as the number of the ink-deliver chambers 41 through 44, such that the ink-deliver passages 91Y through 91B are arranged in an array in a scanning direction in which an ink-jet recording head 30 is moved (FIG. 15 and FIGS. 26 through 29). The ink-deliver passages 91Y through 91B are formed such that in a space between the uppermost yellow-ink deliver chamber 41 and the lowermost black-ink deliver chamber 44, the passages 91Y through 91B are expanded frontward so as to overlap respective ink-flow outlets 41*c*, 44*c* of those two chambers 41, 44 in the upward and downward directions (FIGS. 16 through 19). The respective expanded portions of the ink-deliver passages 91Y through 91B provide respective ink-guide passages 48Y, 48M, 48C, 48B (FIGS. 26 through 29). The ink-guide passages 48Y through 48B are connected to the ink-deliver chambers 41 through 44, respectively.

The respective inks accommodated by the respective ink-deliver chambers 41 through 44 flow via the respective ink-guide passages 48Y through 48B into respective lower portions 94Y, 94M, 94C, 94B of the ink-deliver passages 91Y through 91B which portions are located at respective positions lower than the respective ink-deliver chambers 41 through 44. Thus, each of the ink-guide passages 48Y through 48B constitutes a portion through which a corresponding one of the inks flows from a corresponding one of the ink-deliver chambers 41 through 44 into the lower portion 48 of a corresponding one of the ink-deliver passages 91Y through 91B.

The ink-guide passages 48Y, 48M, 48C, 48B correspond to, and communicate with, the ink-deliver chambers 41, 42, 43, 44, respectively.

The four ink-deliver passages 91Y through 91B extend in the upward and downward directions over respective substantially same lengths. Therefore, in each of the ink-deliver passages 91Y through 91B, air is advantageously separated from the ink flowing into a corresponding one of the ink-supply inlets (e.g., 32*a*) of the ink-jet recording head 30, and the thus separated air is collected in an upper portion of the each passage 91, so that the collected air may be discharged into an outside space via a corresponding one of air-discharge outlets 46 that can be opened and closed by air-discharge valves 47, respectively. Thus, the respective upper portions of the ink-deliver passages 91Y through 91B provide respective air-collect spaces each of which collects the air separated from the ink that flows from a corresponding one of the ink-deliver chambers 41 through 44 into a corresponding one of the ink-deliver passages 91Y through 91B via a corresponding one of the ink-guide passages 48Y through 48B.

Respective bottom walls (i.e., portions of a lower ink case 72) defining the respective ink-guide passages 48Y through 48B include respective downstream-side portions, i.e., respective ink-deliver-passage-side portions having respective inclined guide surfaces 48Ya, 48Ma, 48Ca, 48Ba whose heights decrease in respective directions toward the corresponding ink-deliver passages 91Y through 91B. The respective inclined guide surfaces 48Ya through 48Ba provide respective ink-connect portions each of which maintains or promotes a connection between the ink present in a corresponding one of the ink-deliver chambers 41 through 44 and the ink present in the lower portion 94Y through 94B of a corresponding one of the ink-deliver passages 91Y through 91B that is located at the position lower than the corresponding ink-deliver chamber 41 through 44.

Therefore, as will be described later, even if respective large amounts of air may be collected in the respective upper portions of the ink-deliver passages 91Y through 91B, a probability that the collected air may flow into the ink-jet recording head 30 and accordingly the recording head 30 may fail to print characters or may print defective characters, can be lowered.

The ink-deliver passages 91Y through 91B are formed in both the upper and lower ink cases 71, 72, such that the ink-deliver passages 91Y through 91B extend parallel to each other in the upward and downward directions and have, as respective lower open ends thereof, respective ink-deliver outlets 39Y, 39M, 39C, 39B that are located at respective positions lower than the respective inclined guide surfaces 48Ya through 48Ba and that communicate with the ink-supply inlets (only the inlet 32*a* is shown in FIG. 4) of the ink-jet recording head 30 via ink-flow openings (only the opening 33*a* is shown in FIG. 4) of a reinforcing frame 33. Meanwhile, respective upper open ends of the ink-deliver passages 91Y through 91B provide respective air-discharge outlets 46Y, 46M, 46C, 46B that are provided along a plane (i.e., an upper surface 71*a* of the upper ink case 71) and that communicate with the outside space via the respective air-discharge valves 47Y through 47B that can open and close the outlets 46Y through 46B, respectively. FIG. 4 relates to each of the first and second embodiments and accordingly does not show any of the inclined guide surfaces 48Ya through 48Ba. However, all the elements shown in FIG. 4, except for the inclined guide surfaces 48Ya through 48Ba, are identical with the corresponding elements employed in the present, third embodiment.

(Communication between Ink-Deliver Chambers 41-44 and Corresponding Ink-Deliver Passages 91)

The ink-deliver chambers 41 through 44 employed in the present embodiment are respectively identical with the ink-deliver chambers 41 through 44 employed in each of the first and second embodiments, but the present embodiment differs from the two embodiments in that the present embodiment employs, as the ink-connect portions, the inclined guide surfaces 48Ya through 48Ba that are provided between the respective ink-flow outlets 41*c* through 44*c* of the ink-deliver chambers 41 through 44 and the corresponding ink-deliver passages 91Y through 91B. The following description relates to differences between the first and second embodiments and the present, third embodiment that are observed with respect to the communication between the ink-deliver chambers 41 through 44 and the corresponding ink-deliver passages 91Y through 91B.

The ink-flow outlet 41*c* of the yellow-ink deliver chamber 41 is formed through the upper ink case 71 in a direction from a bottom surface 41*a* of the deliver chamber 41 to a lower surface 71*b* of the case 71, and is connected to the ink-deliver passage 91Y (FIG. 17 or FIG. 26) via the ink-guide passage 48Y. A lower portion of the ink-flow outlet 41*c* is partially defined by a guide wall 64Y that projects downward from the lower surface 71*b* and separates the lower portion of the ink-flow outlet 41*c* from the ink-deliver passage 91Y. A lower end of the guide wall 64Y is lower than the upper end of the ink-deliver passage 91Y, and is spaced upward from an upper end of the inclined guide surface 48Ya. Thus, the lower portion of the ink-flow outlet 41*c* communicates with the lower portion 94Y (eventually, a bottom portion of the ink-deliver passage 91Y) via the inclined guide surface 48Ya.

The ink-flow outlet 42*c* of the magenta-ink deliver chamber 42 opens, in a bottom surface 42*a* of the deliver chamber 42, at a left-hand and rear corner diagonal to the ink-flow inlet 42*b* of the deliver chamber 42. The ink-flow outlet 42*c* is formed through the upper ink case 71, and is connected to one end portion of a connection passage 65M. The other end portion of the connection passage 65M is formed through the upper ink case 71 in the direction from an upper surface 71*a* of the case 71 to the lower surface 71*b* thereof, and is connected to the ink-deliver passage 91M via the ink-guide passage 48M. A lower open end of the other end portion of the connection passage 65M is partially defined by a guide wall 64M that projects downward from the lower surface 71*b* and separates the lower end portion of the other end portion of the connection passage 65M, from the ink-deliver passage 91M. A lower end of the guide wall 64M is lower than the upper end of the ink-deliver passage 91M, and is spaced upward from an upper end of the inclined guide surface 48Ma. Thus, the lower end portion of the other end portion of the connection passage 65M communicates with the lower portion 94M (eventually, a bottom portion of the ink-deliver passage 91M) via the inclined guide surface 48Ma.

Figure 28:
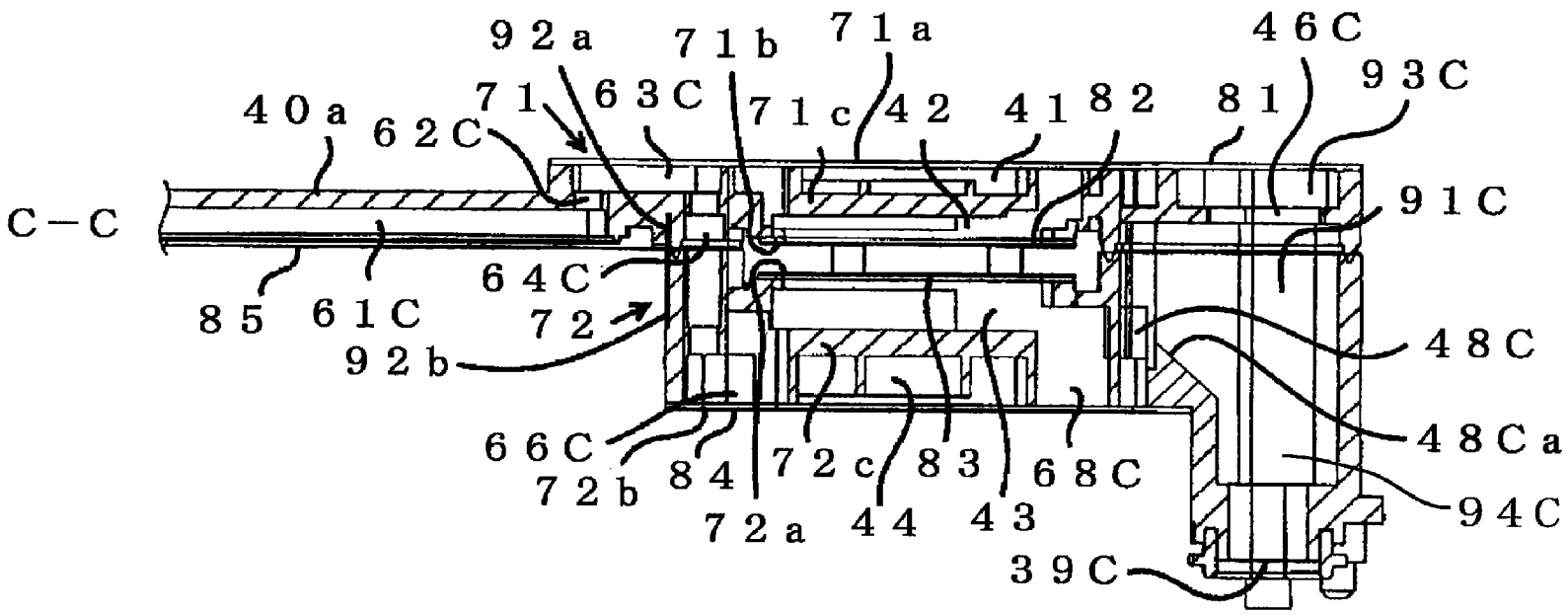
FIG. 28 is a cross-section view corresponding to FIG. 23 and showing the head holder employed by the third embodiment.

The ink-flow outlet 43*c* of the cyan-ink deliver chamber 43 opens, in a bottom surface 43*a* of the deliver chamber 43, at a left-hand and rear corner of the same 43. The ink-flow outlet 43*c* is formed through a thickness of the lower ink case 72, and is connected to one end portion of a connection passage 68C (FIG. 19) formed in a lower surface 72*b* of the case 72. The connection passage 68C and a rear portion of the ink-deliver chamber 44 overlap, in their plan view, the ink-deliver passages 91Y through 91B, and the other end 68Ca of the connection passage 68C is formed through the lower ink case 72 in the direction from the lower surface 72*b* of the case 72 to the upper surface 72*a* thereof, and opens in the ink-guide passage 48C, at a position lower than the upper end of the ink-deliver passage 91C. Thus, the other end 68Ca of the connection passage 68C communicates with the lower portion 94C (eventually, a bottom portion of the ink-deliver passage 91C) via the inclined guide surface 48Ca (FIG. 28).

The ink-flow outlet 44*c* of the black-ink deliver chamber 44 from which the black ink flows opens, in a bottom surface 44*a* of the deliver chamber 44, at a right-hand and rear corner of the same 44. The ink-flow outlet 44*c* is formed through the lower ink case 72 in the upward and downward directions, and opens in the ink-guide passage 48B, at a position lower than the upper end of the ink-deliver passage 91B. Thus, the ink-flow outlet 44*c* communicates with the lower portion 94B (eventually, a bottom portion of the ink-deliver passage 91B) via the inclined guide surface 48Ba.

(Flow of Inks)

In the present embodiment, the inks flow in the same manner as the manner in which the inks flow in each of the first and second embodiments, except that the inks flow from the respective ink-deliver chambers 41 through 44 into the respective ink-deliver passages 91Y through 91B via the respective ink-guide passages 48Y through 48B.

Figure 26:
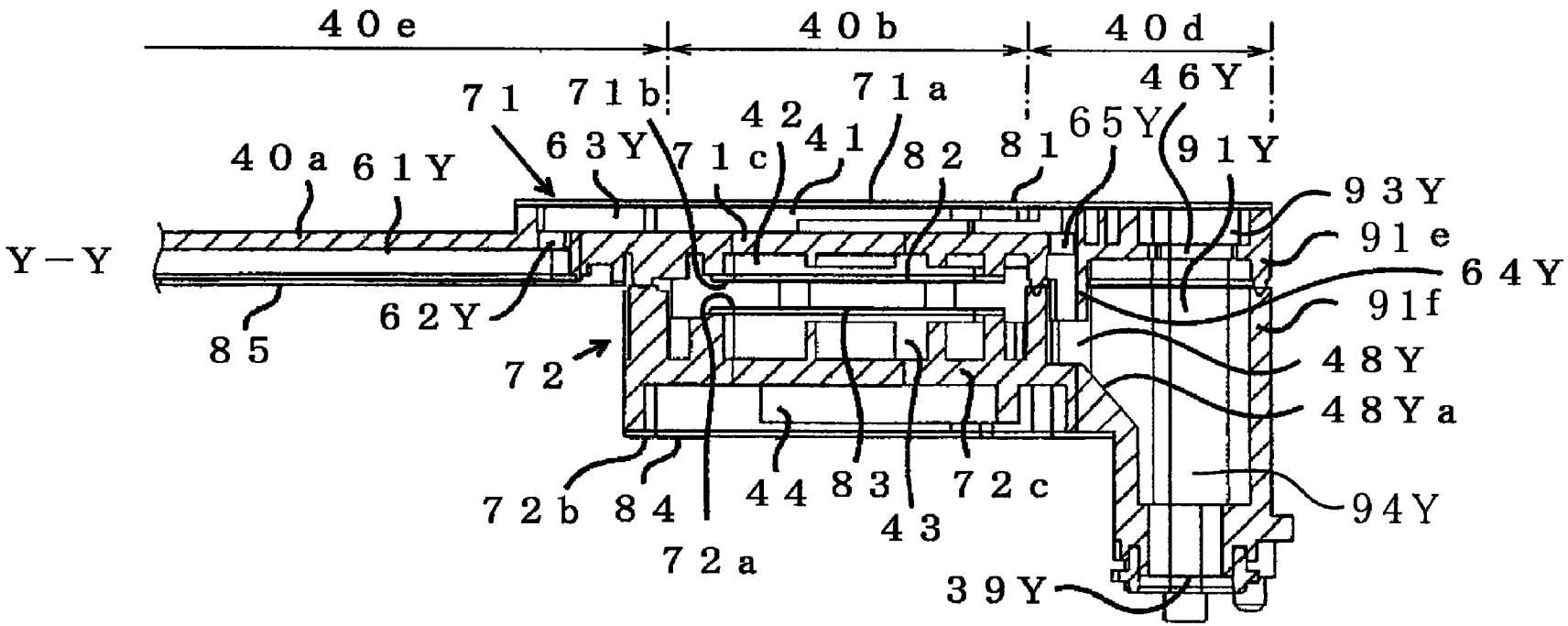
FIG. 26 is a cross-section view corresponding to FIG. 21 and showing a head holder of another ink-jet recording apparatus as a third embodiment of the present invention.
Figure 27:
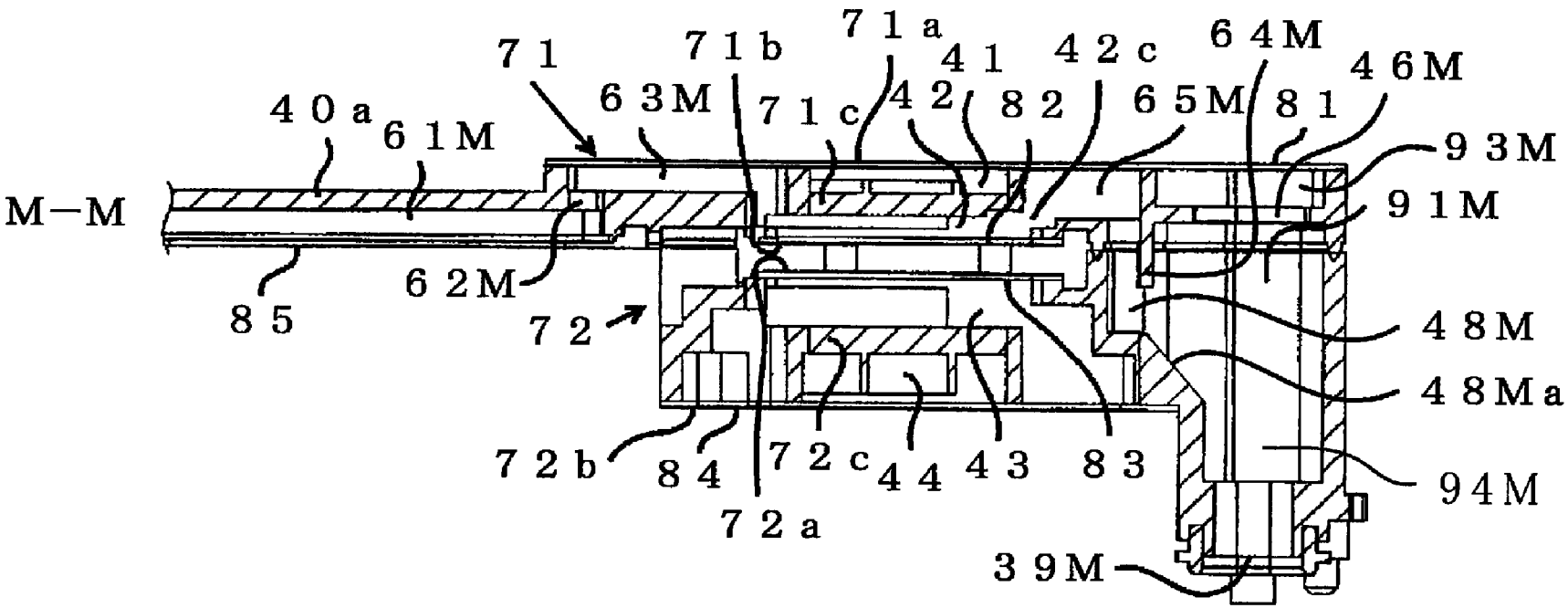
FIG. 27 is a cross-section view corresponding to FIG. 22 and showing the head holder employed by the third embodiment.
Figure 29:
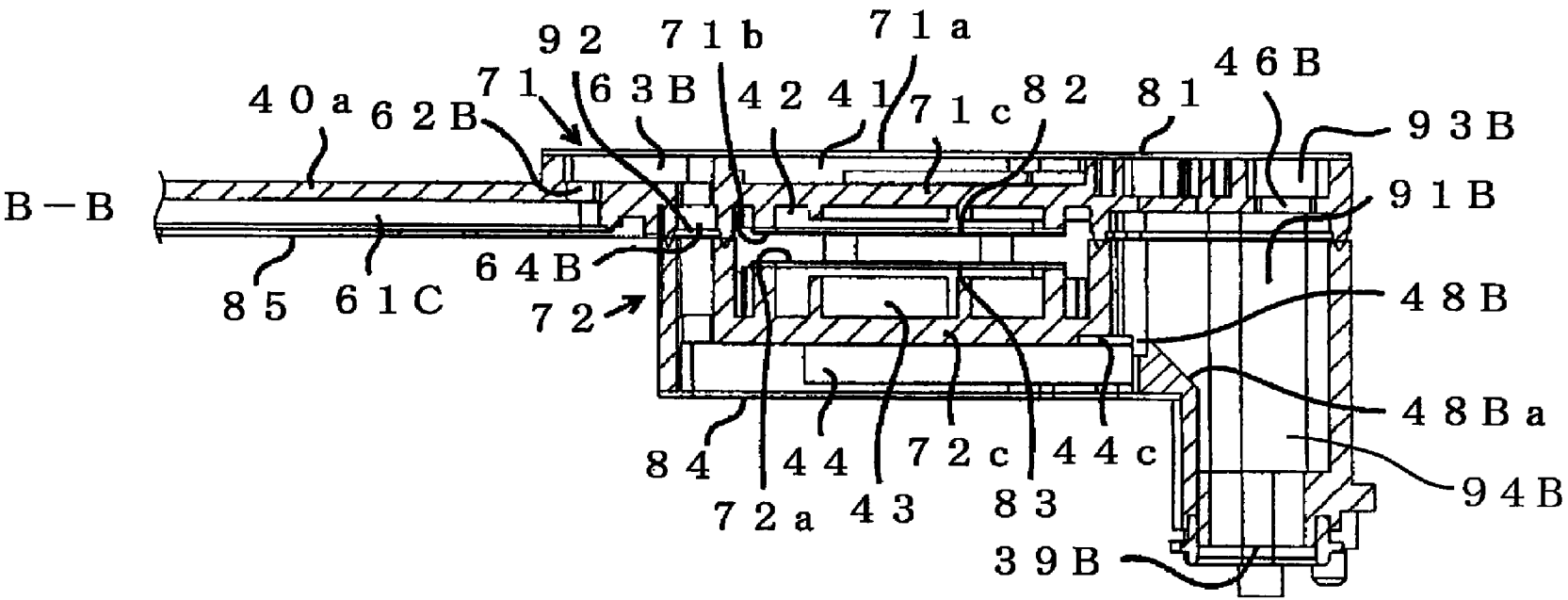
FIG. 29 is a cross-section view corresponding to FIG. 24 and showing the head holder employed by the third embodiment.

As shown in FIG. 26, the yellow ink flows from the ink-deliver chamber 41 into the ink-deliver passage 91Y via the ink-guide passage 48Y, and then flows from the ink-deliver outlet 39Y into the ink-jet recording head 30; as shown in FIG. 27, the magenta ink flows from the ink-deliver chamber 42 into the ink-deliver passage 91M via the ink-guide passage 48M, and then flows from the ink-deliver outlet 39M into the ink-jet recording head 30; as shown in FIG. 28, the cyan ink flows from the ink-deliver chamber 43 into the ink-deliver passage 91C via the ink-guide passage 48C, and then flows from the ink-deliver outlet 39C into the ink-jet recording head 30; and, as shown in FIG. 29, the black ink flows from the ink-deliver chamber 44 into the ink-deliver passage 91B via the ink-guide passage 48B, and then flows from the ink-deliver outlet 39B into the ink-jet recording head 30.

Thus, the inks flow from the respective ink-deliver chambers 41 through 44 into the respective ink-deliver passages 91Y through 91B via the respective ink-guide passages 48Y through 48B. Therefore, in each of the ink-deliver passages 91Y through 91B, air bubbles can be efficiently separated from the ink flowing into the each passage 91Y through 91B, and air bubbles captured by a filter (not shown) provided at a corresponding one of the ink-supply inlets (e.g., 32*a*) of the ink-jet recording head 30 can naturally move upward, so that the air bubbles are collected in the upper portion of the each passage 91Y through 91B. The thus collected air can be discharged into the outside space through a corresponding one of the air-discharge outlets 46Y through 46B that can be opened and closed by an air-discharge valve device 45.

(Supply of Inks)

Figure 30:
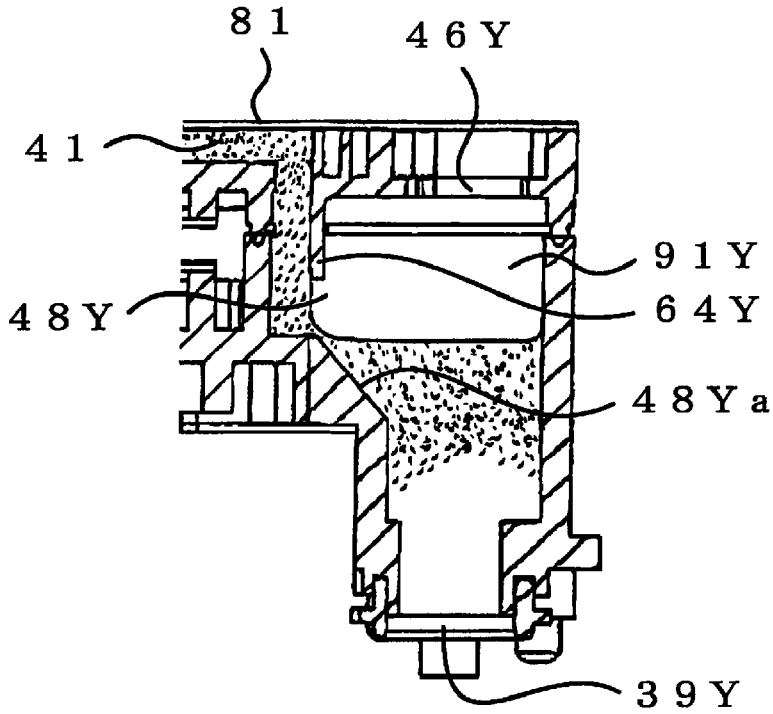
FIG. 30 is an enlarged cross-section view of a portion of the head holder shown in FIG. 26, for explaining a state in which an ink normally flows in that portion.
Figure 32:
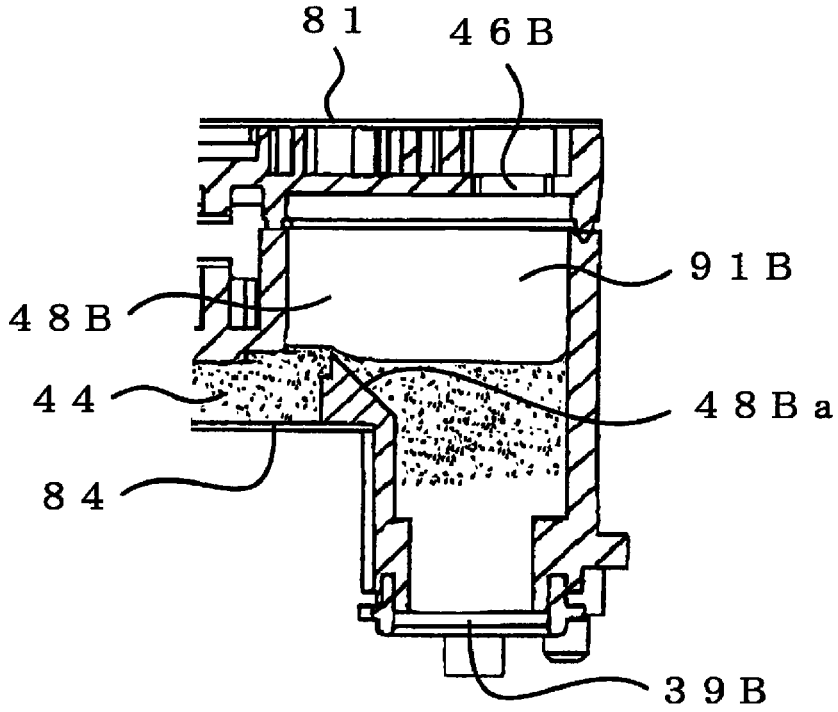
FIG. 32 is an enlarged cross-section view of a portion of the head holder shown in FIG. 29, for explaining a state in which an ink normally flows in that portion.

FIGS. 30 and 32 show a state in which a large amount of air is collected in the upper portion of each of the ink-deliver passages 91Y through 91B. As the amount of air collected in the upper portion of each ink-deliver passage 91Y through 91B increases, a level, i.e., an upper surface of the ink present in the each passage 91Y through 91B gradually lowers and accordingly a connection between the ink present in the each passage 91Y through 91B and the ink present in the corresponding ink-deliver chamber 41 through 44 gradually thins. For example, regarding the yellow ink shown in FIG. 30 (and also regarding the magenta ink), if the upper surface of the yellow ink present in the ink-deliver passage 91Y lowers to below the guide wall 64Y, then the ink delivered from the ink-flow outlet 41*c* of the ink-deliver chamber 41 is pushed toward the ink-guide passage 48M by the pressure of the air collected in the ink-deliver passage 91Y. However, even if the upper surface of the yellow ink present in the ink-deliver passage 91Y may lower to a position somewhat spaced downward from the upper end of the inclined guide surface 48Ya, the upper surface of the yellow ink can remain at a position sufficiently near to the ink present in the ink-deliver chamber 41 owing to the presence of the inclined guide surface 48Ya. In addition, owing to a surface tension of the ink and an attraction applied to the ink because of the consumption thereof by the ink-jet recording head 30, the connection between the ink present in the ink-deliver passage 91Y and the ink present in the ink-deliver chamber 41 can be maintained or promoted.

In addition, regarding the black ink shown in FIG. 32 (and also regarding the cyan ink), even if the upper surface of the black ink present in the ink-deliver passage 91B may lower to a position substantially level with the upper end of the inclined guide surface 48Ba, the ink exposed out of the ink-flow outlet 44*c* of the ink-deliver chamber 44 to the ink-guide passage 48B can remain sufficiently near to the upper surface of the ink present in the ink-deliver passage 91B owing to the presence of the inclined guide surface 48Ba. In addition, owing to a surface tension of the ink and an attraction applied to the ink because of the consumption thereof by the ink-jet recording head 30, the connection between the ink present in the ink-deliver passage 91B and the ink present in the ink-deliver chamber 44 can be maintained or promoted.

In contrast, if the respective inclined guide surfaces 48Ya, 48Ma, 48Ca, 48Ba of the ink-guide passages 48Y, 48M, 48C, 48B are replaced with respective horizontal surfaces, then it would be difficult for the inks to flow from the ink-deliver chambers 41 through 44 to the corresponding ink-deliver passages 91Y through 91B via those horizontal surfaces, in a state in which the respective upper surfaces of the inks present in the ink-deliver passages 91Y through 91B have lowered to below those horizontal surfaces. Thus, at an early stage, the connection between the ink present in each ink-deliver passage 91Y through 91B and the ink present in the corresponding ink-deliver chamber 41 through 44 would be broken. In the present embodiment, however, the connection between the ink present in each ink-deliver passage 91Y through 91B and the ink present in the corresponding ink-deliver chamber 41 through 44 can be maintained for a certain time duration thereafter.

Figure 31:
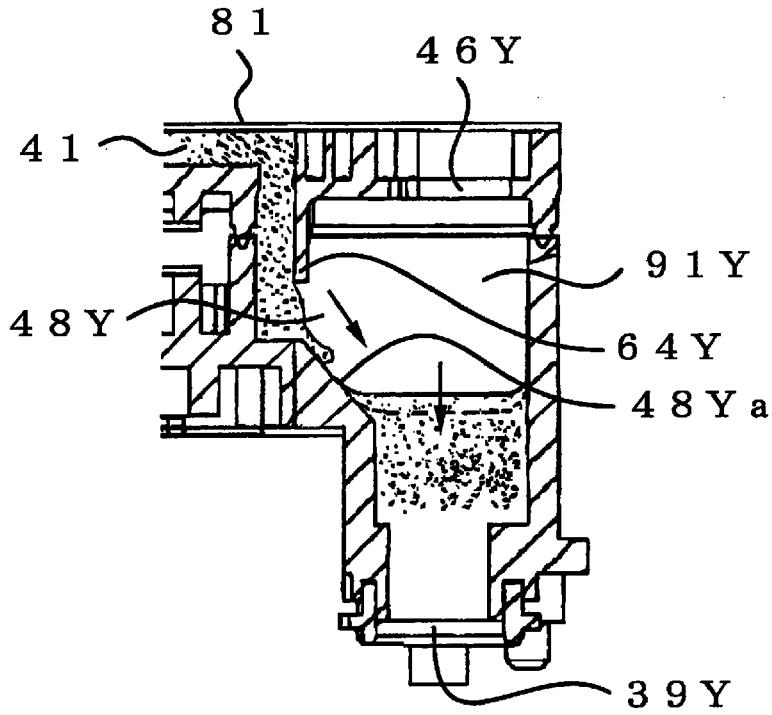
FIG. 31 is an enlarged cross-section view of the portion of the head holder shown in FIG. 26, for explaining a state in which the flowing of the ink is temporarily stopped.
Figure 33:
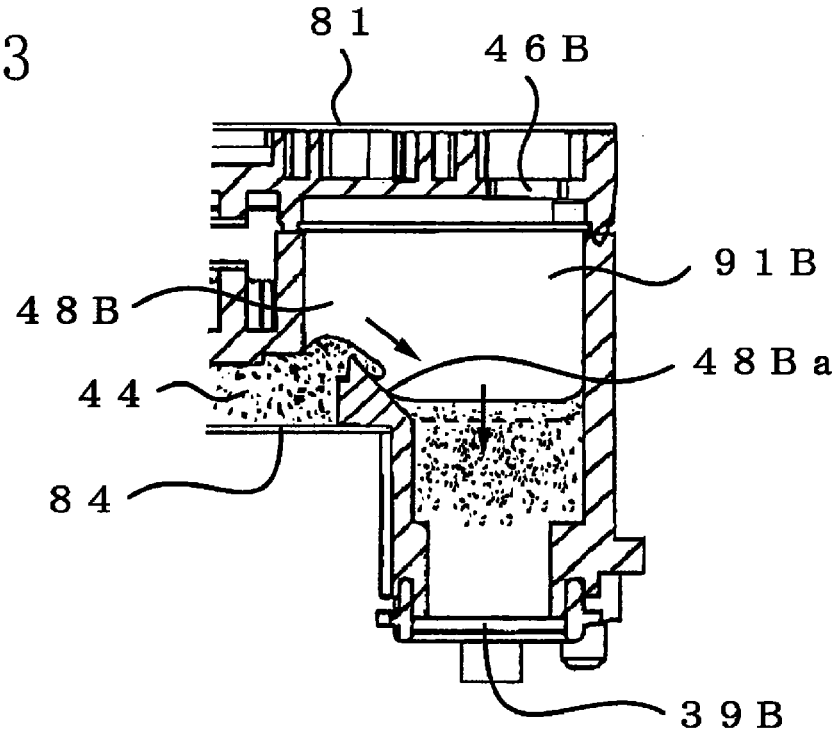
FIG. 33 is an enlarged cross-section view of the portion of the head holder shown in FIG. 29, for explaining a state in which the flowing of the ink is temporarily stopped.

FIGS. 31 and 33 show a state in which the upper surface of the ink present in each of the ink-deliver passages 91Y through 91B has further lowered and the connection between the ink present in the each ink-deliver passage 91Y through 91B and the ink present in the corresponding ink-deliver chamber 41 through 44 has been broken (even in this state, characters can be printed with the inks left in the ink-deliver passages 91Y through 91B). If a first cap member 122 is used to suck the inks from nozzle arrays 35 through 38, the upper surface of the ink present in each of the ink-deliver passages 91Y through 91B quickly lowers, so that the pressure of the air collected in the upper portion of the each passage 91Y through 91B lowers. Thus, regarding the yellow ink shown in FIG. 31 (and also regarding the magenta ink), the ink present in the ink-guide passage 48Y is sucked toward the ink-deliver passage 91Y, so that the ink may flow along the inclined guide surface 48Ya and quickly join with the ink present in the ink-deliver passage 91Y. In addition, regarding the black ink shown in FIG. 32 (and also regarding the cyan ink), the ink exposed out of the ink-flow outlet 44*c* to the ink-guide passage 48B is sucked up by a negative pressure, so that the ink may flow along the inclined guide surface 48Ba and quickly join with the ink present in the ink-deliver passage 91B.

In contrast, if the respective inclined guide surfaces 48Ya, 48Ma, 48Ca, 48Ba of the ink-guide passages 48Y, 48M, 48C, 48B are replaced with the above-described horizontal surfaces, then it would take a long time for the inks to flow from the ink-deliver chambers 41 through 44 to the ink-deliver passages 91Y through 91B via those horizontal surfaces and, for that long time, the air collected in the respective upper portions of the ink-deliver passages 91Y through 91B would be sucked toward the ink-jet recording head 30, so that the recording head 30 may fail to eject droplets of the inks or may eject defective ink droplets. In the present embodiment, the ink present in each ink-deliver chamber 41 through 44 can quickly join with the ink present in the corresponding ink-deliver passage 91Y through 91B via the corresponding inclined guide surface 48Ya through 48Ba. Therefore, respective sufficient amounts of inks that are needed to carry out the recording-head recovering operation can be supplied to the respective ink-deliver passages 91Y through 91B and accordingly the recording-head recovering operation can be carried out with reliability.

However, the present embodiment may be modified in the following manners:

(a) In the present embodiment, the ink-connect portions are provided in the respective bottom walls defining the respective ink-guide passages 48Y through 48B, i.e., are constituted by the respective inclined guide surfaces 48Ya through 48Ba, each in the form of one inclined plane surface, whose heights decrease in the respective directions toward the corresponding ink-deliver passages 91Y through 91B. However, each of the respective inclined guide surfaces 48Ya through 48Ba may not be constituted by one inclined plane surface, but may be constituted by two or more inclined plane surfaces that are combined to provide a bent, ridged surface or a bent, recessed surface.

(b) Alternatively, the ink-connect portions may be constructed by such respective inclined guide surfaces each of which is provided by not one or more inclined plane surfaces but one or more inclined, curved surfaces such as a curved, ridged surface(s) or a curved, recessed surface(s). Otherwise, each of the ink-connect portions may be constructed by one or more inclined elongate guide recesses that is or are provided in the bottom wall defining a corresponding one of the ink-guide passages 48Y through 48B and that has or have a bottom surface(s) whose height decreases in a direction toward a corresponding one of the ink-deliver passages 91Y through 91B.

Advantages of the Present Embodiment (1) The inclined guide surfaces 48Ya through 48Ba guide the inks delivered from the ink-deliver chambers 41 through 44 into the ink-guide passages 48Y through 48B, so that the inks can easily flow into the ink-deliver passages 91Y through 91B. That is, only the inclined guide surfaces 48Ya through 48Ba, provided in the bottom walls defining the ink-guide passages 48Y through 48B, can easily maintain or promote the respective connections between the inks present in the ink-deliver chambers 41 through 44 and the inks present in the respective lower portions 94Y through 94B of the ink-deliver passages 91Y through 91B that are located at the respective positions lower than the ink-deliver chambers 41 through 44.

(2) In the modified embodiment wherein one or more inclined elongate guide recesses is or are provided in the bottom wall defining each of the ink-guide passages 48Y through 48B, such that the inclined elongate guide recess(es) has or have a bottom surface(s) whose height decreases in a direction toward the corresponding ink-deliver passage 91Y through 91B, the ink delivered from the corresponding ink-deliver chamber 41 through 44 is guided by the inclined guide recess(es) and can easily flow into the corresponding ink-deliver passage 91Y through 91B. In particular, since the inclined guide recess(es) is or are elongate like grooves, the connection between the ink present in the corresponding ink-deliver chamber 41 through 44 and the ink present in the corresponding ink-deliver passage 91Y through 91B can be easily maintained or promoted.

(3) In the present ink-jet recording apparatus, the ink-jet recording head 30 ejects droplets of the inks while the plurality of ink-deliver chambers 41 through 44 and the ink-jet recording head 30 are moved relative to a recording medium. However, a probability that the air collected in the respective upper portions of the ink-deliver passage 91Y through 91B may be sucked into the recording head 30 and accordingly the recording head may fail to print characters or may print defective characters, can be lowered.

(4) Since the upper ink case 71 and the lower ink case 72 are joined to each other to provide the buffer tank 40, the ink-deliver chambers 41 through 44, the air-discharge outlets 46Y through 46*b*, the ink-deliver passages 91Y through 91B, and the ink-guide passages 48Y through 48B can be easily provided.

Additional Embodiment 3

(1) In each of the above-described three embodiments, the yellow ink, the magenta ink, the cyan ink, and the black ink are accommodated by the four ink-deliver chambers 41 through 44, respectively, in the order of description in the downward direction. However, this order may be changed. In the latter case, too, the same advantages as those of the above-described three embodiments can be obtained.

(2) The two ink cases 71, 72 may be arranged in the scanning direction, i.e., the leftward and rightward directions. In the latter case, a total dimension of the buffer tank 40 in the leftward and rightward directions can be reduced, and at least one of the advantages of the above-described three embodiments can be obtained.

What is claimed is:

1. An ink-jet recording apparatus, comprising:

a plurality of ink tanks which store a plurality of sorts of inks, respectively;

a plurality of tubes which respectively supply the inks stored by the ink tanks;

a buffer tank having a plurality of ink-deliver chambers which respectively accommodate the inks supplied from the ink tanks via the tubes; and an ink jet recording head to which the ink-deliver chambers deliver the inks, respectively, and which ejects droplets of the inks toward a recording medium while the buffer tank and the ink-jet recording head are moved relative to the recording medium, wherein the ink-deliver chambers have respective inner spaces, respective ink-flow inlets through which the respective inks supplied via the respective tubes flow into the respective inner spaces, and respective ink-flow outlets through which the respective inks flow from the respective inner spaces into respective ink-deliver passages each of which communicates with the ink-jet recording head, wherein the ink-flow inlet and the ink-flow outlet of each of the ink-deliver chambers are provided at respective positions that are substantially most distant from each other such that almost all portions of the inner space of said each ink-deliver chamber are located between the ink-flow inlet and the ink-flow outlet of said each ink-deliver chamber, wherein the inner space of said each of the ink-deliver chambers is flat along a plane containing a straight line connecting between the ink-flow inlet and the ink-flow outlet of said each ink-deliver chamber, such that respective dimensions of said inner space in a first direction and a second direction that are parallel to said plane and are perpendicular to each other are greater than a dimension thereof in a third direction perpendicular to said plane, wherein the buffer tank includes a plurality of flexible diaphragms each of which defines one surface of the inner space of a corresponding one of the ink-deliver chambers which surface extends parallel to the plane along which the inner space of said one ink-deliver chamber is flat, and wherein the ink-deliver chambers are arranged such that the respective planes along which the respective inner spaces of the ink-deliver chambers are flat are parallel to each other and have respective different positions in the third direction perpendicular to said respective planes.

2. The ink jet recording apparatus according to claim 1, wherein the buffer tank includes at least one case having a chamber-define wall including, as a portion thereof, a partition wall via which at least two ink-deliver chambers of the plurality of ink-deliver chambers are adjacent to each other and extend parallel to each other, and wherein the respective ink-flow inlets of said at least two ink-deliver chambers are provided at respective different positions in a direction parallel to the partition wall, and the respective ink-flow outlets of said at least two ink-deliver chambers are provided at respective different positions in the direction parallel to the partition wall.

3. The ink jet recording apparatus according to claim 2, wherein the buffer tank includes a plurality of said cases each of which has said at least two ink-deliver chambers, and wherein the cases are joined to each other such that the cases extend parallel to each other.

4. The ink jet recording apparatus according to claim 3, wherein one of the cases has, in one of opposite surfaces thereof, a plurality of ink-introduce passages each of which is connected, at one of opposite ends thereof, to a corresponding one of the tubes, and wherein an other of the opposite ends of said each of the ink-introduce passages is formed through the chamber-define wall of at least one of the cases so as to be connected to a corresponding one of the ink-deliver chambers of the cases.

5. The ink jet recording apparatus according to claim 2, wherein said at least one case has, in one of opposite surfaces thereof, a plurality of ink-introduce passages each of which is connected, at one of opposite ends thereof, to a corresponding one of the tubes, and an other of the opposite ends of at least one of the ink-introduce passages is formed through the chamber-define wall of said at least one case so as to be connected to at least one of said at least two ink-deliver chambers that is formed in an other of the opposite surfaces of said at least one case.

6. The ink jet recording apparatus according to claim 2, wherein the ink-deliver passages corresponding to the ink-deliver chambers open along one side of the buffer tank that is opposed to the ink-jet recording head, and wherein said at least two ink-deliver chambers of the plurality of ink-deliver chambers are adjacent to each other via the partition wall as said portion of the chamber-define wall of said at least one case, and the ink-flow outlet of at least one of said at least two ink-deliver chambers that is provided in one of opposite surfaces of said at least one case is formed through said at least one case from said one of the opposite surfaces thereof to an other of the opposite surfaces thereof, and is connected to at least one of the ink-deliver passages.

7. The ink jet recording apparatus according to claim 1, further comprising a plurality of air-discharge valves each of which can be opened and closed, wherein respective upper ends of the ink-deliver passages are connected to an outer space via the respective air-discharge valves.

8. The ink jet recording apparatus according to claim 1, further comprising a plurality of air-discharge valves each of which can be opened and closed, wherein the ink-deliver chambers are arranged in upward and downward directions such that the ink-deliver chambers extend parallel to each other, the ink-deliver passages extend in the upward and downward directions over respective substantially same lengths, each of the ink-deliver chambers communicates with an intermediate portion of a corresponding one of the ink-deliver passages, respective upper portions of the ink-deliver passages provide respective air-collect spaces each of which collects an air, respective lower open ends of the ink-deliver passages provide respective ink-deliver outlets which communicate with respective ink-supply inlets of the ink jet recording head, respective upper open ends of the ink-deliver passages provide respective air-discharge outlets which are provided along a plane, and the respective air-discharge outlets are connected to an outer space via the respective air-discharge valves.

9. The ink jet recording apparatus according to claim 1, wherein the ink-deliver passages include respective lower portions each of which is located at a position lower than a corresponding one of the ink-deliver chambers and which have respective ink-deliver outlets through which the respective inks are supplied to respective ink-supply inlets of the ink-jet recording head, and the buffer tank further includes a plurality of ink-connect portions each of which maintains or promotes a connection between the ink present in the inner space of a corresponding one of the ink-deliver chambers and the ink present in the lower portion of a corresponding one of the ink-deliver passages.

10. An ink jet recording apparatus, comprising:

a plurality of ink tanks which store a plurality of sorts of inks, respectively;

a plurality of tubes which respectively supply the inks stored by the ink tanks;

a buffer tank having a plurality of ink-deliver chambers which respectively accommodate the inks supplied from the ink tanks via the tubes; and an ink jet recording head to which the ink-deliver chambers deliver the inks, respectively, and which ejects droplets of the inks toward a recording medium while the buffer tank and the ink-jet recording head are moved relative to the recording medium, wherein the ink-deliver chambers have respective inner spaces, respective ink-flow inlets through which the respective inks supplied via the respective tubes flow into the respective inner spaces, and respective ink-flow outlets through which the respective inks flow from the respective inner spaces into respective ink-deliver passages each of which communicates with the inkjet recording head, and wherein the buffer tank includes a plurality of cases which are stacked on each other and each of which has at least two ink-deliver chambers of the plurality of ink-deliver chambers, one of the cases has, in one of opposite surfaces thereof, a plurality of ink-introduce passages each of which is connected, at one of opposite ends thereof, to a corresponding one of the tubes, and an other of the opposite ends of each of at least two ink-introduce passages of the plurality of ink-introduce passages is formed through at least one of the cases in a direction in which the cases are stacked on each other, and is connected to the ink-flow inlet of a corresponding one of at least two ink-deliver chambers of the plurality of ink-deliver chambers.

11. The ink jet recording apparatus according to claim 10, wherein the inner space of each of the ink-deliver chambers is flat in a direction parallel to a direction in which the ink inlet and the ink outlet of said each ink-deliver chamber are distant from each other, wherein the buffer tank includes a plurality of flexible diaphragms each of which defines one surface of the inner space of a corresponding one of the ink-deliver chambers which surface extends parallel to the direction in which said inner space is flat, and wherein the ink-deliver chambers are arranged such that the respective directions in which the respective inner spaces thereof are flat are parallel to each other.

12. The ink jet recording apparatus according to claim 11, wherein each of at least two cases of the plurality of cases has a partition wall via which said at least two ink-deliver chambers of said each case are adjacent to each other, and wherein said at least two cases are joined to each other such that said at least two cases extend parallel to each other.

13. The ink jet recording apparatus according to claim 12, wherein each of the plurality of cases has said partition wall via which said at least two ink-deliver chambers of said each case are adjacent to each other, such that each of said at least two ink-deliver chambers opens at one of opposite sides thereof that is opposite to the partition wall, and said one side of said each ink-deliver chamber is closed by a corresponding one of the plurality of flexible diaphragms, wherein the respective ink-flow inlets of said at least two ink-deliver chambers are provided at respective different positions in a direction parallel to the partition wall, and the respective ink-flow outlets of said at least two ink-deliver chambers are provided at respective different positions in the direction parallel to the partition wall, and wherein the plurality of cases include at least one pair of adjacent cases which are arranged adjacent to each other and which are joined to each other such that the respective flexible diaphragms corresponding to the respective one ink-deliver chambers of the two cases of said at least one pair are spaced from, and opposed, to each other and extend parallel to each other.

14. The ink jet recording apparatus according to claim 12, wherein the buffer tank includes the cases each of which has said at least two ink-deliver chambers and the cases are stacked on, and joined to, each other such that the cases extend parallel to each other, and wherein the respective ink-flow inlets and the respective ink-flow outlets of the respective ink-deliver chambers provided in respective surfaces of the cases that are opposed to each other, are provided at respective positions inside respective positions where said other of the opposite ends of said each of said at least two ink-introduce passages and the plurality of ink-deliver passages are formed through said at least one of the cases.

15. The ink jet recording apparatus according to claim 14, wherein said one of the cases has, in said one of the opposite surfaces thereof, the plurality of ink-introduce passages which are arranged in an array and said each of which is connected, at said one of the opposite ends thereof, to said corresponding one of the tubes, wherein two array-end ink-introduce passages located at opposite ends of the array of ink-introduce passages are connected to said two ink-deliver chambers of said one case, and wherein at least two ink-introduce passages located between said two array-end ink-introduce passages are connected to said at least two ink-deliver chambers of at least one of the cases that is different from said one case.

16. An ink jet recording apparatus, comprising:

a plurality of cases which cooperate with each other to have a plurality of ink-deliver chambers which accommodate a plurality of sorts of inks, respectively;

a plurality of ink-deliver passages through which the inks are delivered from the ink-deliver chambers, respectively;

an ink-jet recording head which has a plurality of ink-supply inlets which communicate with the plurality of ink-deliver passages, respectively; and a plurality of air-discharge valves each of which can be opened and closed, wherein the ink-deliver chambers are arranged in upward and downward directions such that the ink-deliver chambers extend parallel to each other, wherein the ink-deliver passages are located outside the ink-deliver chambers in a direction perpendicular to the upward and downward directions, and extend in the upward and downward directions over respective substantially same lengths, wherein each of the ink-deliver chambers communicates with an intermediate portion of a corresponding one of the ink-deliver passages in the upward and downward directions, and respective upper portions of the ink-deliver passages that are higher than the respective intermediate portions thereof provide respective air-collect spaces each of which collects an air, wherein respective lower open ends of the ink-deliver passages provide respective ink-deliver outlets which communicate with the respective ink-supply inlets of the ink jet recording head, wherein an upper case of the plurality of cases has the respective upper portions of the ink-deliver passages that have the respective air-discharge outlets, and a lower case of the plurality of cases has respective lowers portions of the ink-deliver passages that have the respective ink-deliver outlets, wherein the ink-deliver chambers are arranged in the upward and downward directions such that the respective upper portions of the ink-deliver passages are connected to the respective lower portions thereof, and wherein respective upper open ends of the air-collect spaces provide respective air-discharge outlets which are provided along a plane, and the respective air-discharge outlets communicate with an outer space via the respective air-discharge valves.

17. The ink jet recording apparatus according to claim 16, wherein the upper case has an upper ink-deliver chamber of the plurality of ink-deliver chambers, wherein the air-discharge outlets are provided in a plane surface of the upper case, wherein the air-discharge valves are provided along one side of at least the upper case, and wherein the apparatus further comprises a plurality of air-discharge passages which are provided along the plane surface of the upper case and through which the air-discharge outlets communicate with the air-discharge valves.

18. The ink jet recording apparatus according to claim 16, further comprising a plurality of flexible diaphragms which define respective one surfaces of the ink-deliver chambers that extend parallel to each other and each of which is flexible due to a change of pressure of the ink present in a corresponding one of the ink-deliver chambers.

19. The ink-jet recording apparatus according to claim 16, further comprising an air-discharge-valve box which is provided along one side of at least one of the plurality of cases such that the air-discharge-valve box extends substantially parallel to the ink-deliver passages and which accommodates the air-discharge valves, wherein the apparatus further comprises a plurality of air-discharge passages which are provided in an upper surface of said at least one case and through which the respective air-discharge outlets provided by the respective upper open ends of the air-collect spaces communicate with the respective air-discharge valves.

20. The ink jet recording apparatus according to claim 16, further comprising a plurality of ink tanks which store the inks, respectively, and a plurality of ink-supply tubes which supply the inks stored by the ink tanks, to the ink-deliver chambers, respectively, wherein each of the ink-deliver chambers delivers a corresponding one of the inks to the ink-jet recording head, and the ink-jet recording head ejects drops of the inks toward a recording medium while the ink-deliver chambers and the ink jet recording head are moved relative to the recording medium.

21. An ink jet recording apparatus, comprising:

at least one ink-deliver chamber which accommodates at least one ink;

at least one ink-deliver passage which extends in upward and downward directions, through which said at least one ink is delivered from said at least one ink-deliver chamber, and which includes a lower portion that is located at a position lower than said at least one ink-deliver chamber and that has an ink-deliver outlet;

an ink jet recording head having at least one ink-supply inlet to which said at least one ink is supplied through the ink-deliver outlet of said at least one ink-deliver passage; and at least one ink-connect portion which maintains or promotes a connection between the ink delivered from said at least one ink-deliver chamber and the ink present in the lower portion of said at least one ink-deliver passage, wherein the ink jet recording apparatus comprises at least one wall defining said at least one ink-deliver chamber and said at least one ink-deliver passage, wherein said at least one wall includes a lower portion which is provided between said at least one ink-deliver chamber and the lower portion of said at least one ink-deliver passage and which comprises said at least one ink-connect portion, and wherein said at least one ink-connect portion includes at least one inclined guide surface whose height decreases in a direction from said at least one ink-deliver chamber toward the lower portion of said at least one ink-deliver passage.

22. The ink jet recording apparatus according to claim 21, comprising:

a plurality of said ink-deliver chambers which accommodate a plurality of said sorts of inks, respectively;

a plurality of ink tanks which store the inks, respectively; and a plurality of ink-supply tubes which supply the inks stored by the ink tanks, to the ink-deliver chambers, respectively, wherein each of the ink-deliver chambers delivers a corresponding one of the inks to the ink-jet recording head, and the ink-jet recording head ejects drops of the inks toward a recording medium while the ink-deliver chambers and the ink jet recording head are moved relative to the recording medium.

23. The ink jet recording apparatus according to claim 21, wherein an upper portion of said at least one ink-deliver passage has an air-discharge outlet through which an air collected in said upper portion is discharged.

24. The ink jet recording apparatus according to claim 23, comprising:

a plurality of said ink-deliver chambers which accommodate a plurality of said sorts of inks, respectively;

a plurality of said ink-deliver passages which extend in the upward and downward directions, through which the inks are delivered from the ink-deliver chambers, respectively, which include respective said lower portions that are located at respective positions lower than the corresponding ink-deliver chambers and that have respective said ink-deliver outlets, and which include respective said upper portions that have respective said air-discharge outlets through which respective airs collected in said respective upper portions are discharged;

a plurality of said ink-connect portions each of which maintains or promotes the connection between the ink delivered from a corresponding one of the ink-deliver chambers and the ink present in the lower portion of a corresponding one of the ink-deliver passages; and a buffer tank including an upper case and a lower case which are joined to each other and which have the ink-deliver chambers, wherein the upper case has the respective upper portions of the ink-deliver passages that have the respective air-discharge outlets, and the lower case has the respective lower portions of the ink-deliver passages that have the respective ink-deliver outlets, and additionally has the ink-connect portions.

25. An ink jet recording apparatus, comprising:

at least one ink-deliver chamber which accommodates at least one ink;

at least one ink-deliver passage which extends in upward and downward directions, through which said at least one ink is delivered from said at least one ink-deliver chamber, and which includes a lower portion that is located at a position lower than said at least one ink-deliver chamber and that has an ink-deliver outlet;

an ink jet recording head having at least one ink-supply inlet to which said at least one ink is supplied through the ink-deliver outlet of said at least one ink-deliver passage; and at least one ink-connect portion which maintains or promotes a connection between the ink delivered from said at least one ink-deliver chamber and the ink present in the lower portion of said at least one ink-deliver passage, wherein the ink jet recording apparatus comprises at least one wall defining said at least one ink-deliver chamber and said at least one ink-deliver passage, wherein said at least one wall includes a lower portion which is provided between said at least one ink-deliver chamber and the lower portion of said at least one ink-deliver passage and which comprises said at least one ink-connect portion, and wherein said at least one ink-connect portion includes at least one elongate guide recess having a bottom surface which is inclined such that a height of the bottom surface decreases in a direction from said at least one ink-deliver chamber toward the lower portion of said at least one ink-deliver passage.

* * * * *